US010190268B2

(12) United States Patent
Pietila et al.

(10) Patent No.: US 10,190,268 B2
(45) Date of Patent: Jan. 29, 2019

(54) CONCRETE SCREEDING SYSTEM WITH BOOM MOUNTED SCREED HEAD

(71) Applicant: SOMERO ENTERPRISES, INC., Fort Myers, FL (US)

(72) Inventors: Mark A. Pietila, Atlantic Mine, MI (US); Philip D. Halonen, Calumet, MI (US); James E. Kangas, Calumet, MI (US); Philip J. Quenzi, Atlantic Mine, MI (US)

(73) Assignee: SOMERO ENTERPRISES, INC., Fort Myers, FL (US)

( * ) Notice: Subject to any disclaimer, the term of this patent is extended or adjusted under 35 U.S.C. 154(b) by 0 days.

(21) Appl. No.: 15/708,604

(22) Filed: Sep. 19, 2017

(65) Prior Publication Data

US 2018/0080184 A1 Mar. 22, 2018

Related U.S. Application Data

(60) Provisional application No. 62/420,636, filed on Nov. 11, 2016, provisional application No. 62/396,585, filed on Sep. 19, 2016.

(51) Int. Cl.
*E01C 19/00* (2006.01)
*E01C 19/40* (2006.01)

(52) U.S. Cl.
CPC ..... *E01C 19/40* (2013.01); *E01C 19/006* (2013.01)

(58) Field of Classification Search
CPC ..... E01C 19/006; E01C 19/40
USPC ..... 404/86, 102, 118, 120
See application file for complete search history.

(56) References Cited

U.S. PATENT DOCUMENTS

| | | | |
|---|---|---|---|
| 3,841,777 | A | 10/1974 | Domenighetti |
| 3,976,092 | A | 8/1976 | Coja et al. |
| 4,180,170 | A | 12/1979 | Meinken |
| 4,262,696 | A | 4/1981 | Oury |
| 4,280,771 | A | 7/1981 | Schwing et al. |
| 4,519,768 | A | 5/1985 | Murai et al. |

(Continued)

FOREIGN PATENT DOCUMENTS

| | | |
|---|---|---|
| CN | 2230792 | 7/1996 |
| CN | 2799744 | 7/2006 |

(Continued)

OTHER PUBLICATIONS

International Search Report and Written Opinion dated Apr. 5, 2018 for corresponding PCT Application No. PCT/IB2017/055679.

(Continued)

*Primary Examiner* — Raymond W Addie
(74) *Attorney, Agent, or Firm* — Honigman Miller Schwartz and Cohn, LLP

(57) ABSTRACT

A concrete screeding device for screeding uncured concrete placed at a support surface includes a screed head having a grade setting device and a vibrating member, and an extendable and retractable boom. A base end of the boom is attached at a base structure and the screed head is supportable at a distal end of the boom. The boom is extendable so as to position the screed head at a distance of at least 20 feet from the base structure, and the screed head is movable between its extended location and the base structure to screed the concrete placed at the support surface.

26 Claims, 52 Drawing Sheets

(56) References Cited

U.S. PATENT DOCUMENTS

| | | | | |
|---|---|---|---|---|
| 4,699,543 | A * | 10/1987 | Mio | E02B 5/02 404/104 |
| 4,712,697 | A | 12/1987 | McGowan | |
| 4,930,935 | A | 6/1990 | Quenzi et al. | |
| 5,139,157 | A | 8/1992 | Korthaus | |
| 5,288,166 | A | 2/1994 | Allen et al. | |
| 5,328,295 | A | 7/1994 | Allen | |
| 5,567,075 | A | 10/1996 | Allen | |
| 6,129,481 | A | 10/2000 | Tapio et al. | |
| 6,142,180 | A | 11/2000 | Woodling et al. | |
| 6,202,013 | B1 | 3/2001 | Anderson et al. | |
| 6,226,955 | B1 | 5/2001 | Lorrigan | |
| 6,588,976 | B2 | 7/2003 | Quenzi et al. | |
| 6,668,497 | B1 | 12/2003 | Mayer et al. | |
| 6,729,796 | B1 | 5/2004 | Green | |
| 7,044,681 | B2 | 5/2006 | Quenzi et al. | |
| 7,121,762 | B2 | 10/2006 | Quenzi et al. | |
| 7,543,851 | B2 | 6/2009 | Wolfram et al. | |
| 7,909,059 | B2 | 3/2011 | Wehner et al. | |
| 8,152,409 | B1 * | 4/2012 | Lignnan | E01C 19/006 404/118 |
| 9,028,168 | B1 | 5/2015 | Knapp | |
| 9,297,171 | B1 | 3/2016 | Ligman | |
| 2001/0048850 | A1 | 12/2001 | Quenzi et al. | |
| 2003/0068200 | A1 | 4/2003 | Quenzi et al. | |
| 2006/0008323 | A1 | 1/2006 | Torvinen | |
| 2006/0018715 | A1 | 1/2006 | Halonen et al. | |
| 2010/0196096 | A1 | 8/2010 | Halonen et al. | |
| 2011/0088920 | A1 | 4/2011 | Paull | |
| 2014/0294504 | A1 | 10/2014 | Kieranen et al. | |
| 2015/0361681 | A1 | 12/2015 | Dao | |

FOREIGN PATENT DOCUMENTS

| | | |
|---|---|---|
| CN | 102864936 | 1/2013 |
| CN | 203451124 | 2/2014 |
| EP | 0635450 | 1/1995 |
| WO | WO2016/131977 | 8/2016 |
| WO | WO2016/174136 | 11/2016 |

OTHER PUBLICATIONS

ScreedSaver Max, ProCSS, Dec. 13, 2016, retrieved from: http://www.procss.eu/en/products/screedsaver-max-en.html.

* cited by examiner

DUAL PIVOTING BOOM MOUNTING MECHANISM
NON 360 DEGREE ROTATION, SINGLE ACTING HYDRAULIC CYLINDERS ON RETRACT STROKE. EACH MEMBER COULD ROTATE UP TO 180 DEGREES.

Inventors: Mark A. Pietila, Philip D. Halonen, James E. Kangas and Philip J. Quenzi
Title: CONCRETE SCREEDING SYSTEM WITH BOOM MOUNTED SCREED HEAD
Serial No.: 15/708,604
Docket No.: SOM01 P-341B
Replacement Sheet No.: 14/52

TOWER MOVEMENT CUSHIONING/COUNTERACTION

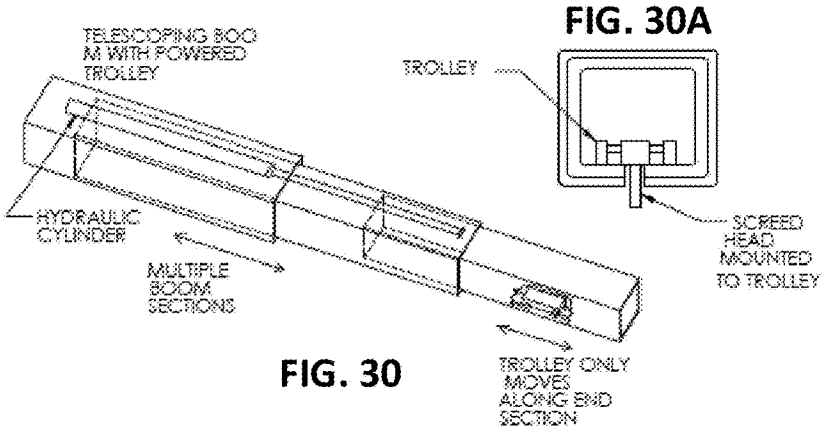
FIG. 30A
FIG. 30
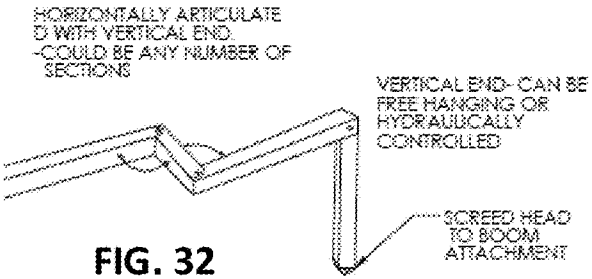
FIG. 32
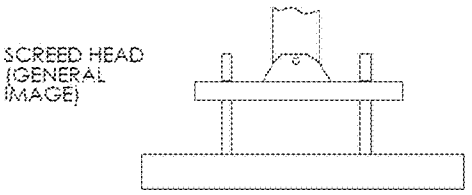
FIG. 29A
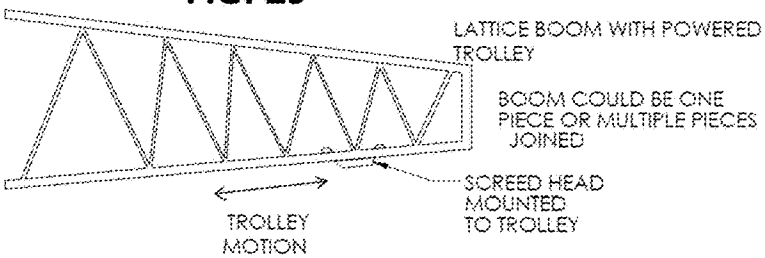
FIG. 29
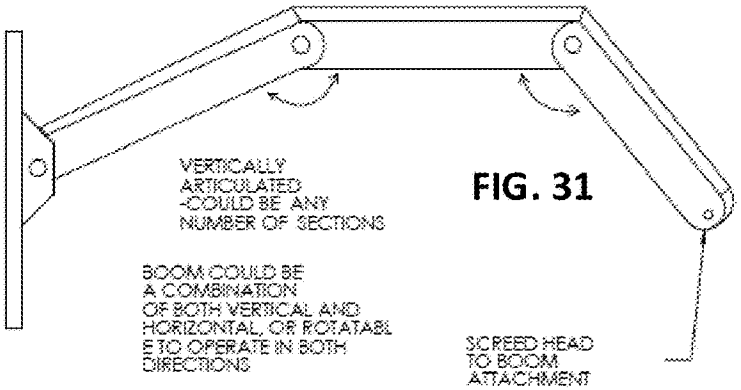
FIG. 31

1- TOWER, MAY BE TRACTOR
2- BOOM
3- CARRIER
4- STABILIZING MECHANISM, MAY BE RETRACTABLE, MAY BE OPTIONAL
5- LEVELING CYLINDER
6- SCREED HEAD, HORIZONTAL AND VERTICAL MOVEMENT, MAY OR MAY NOT HAVE AUGER
7- HEAD SWIVEL, MAY BE ROTATED HYDRAULICALLY, MAY BE PIN MOUNTED TO BOOM WITH LEVELING CYLINDER OR FIXED
8- SWIVEL HEAD LEVELING CYLINDER-USED WITH OR WITHOUT CYLINDER 5

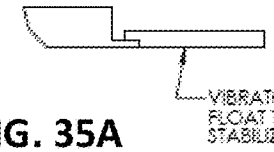
FIG. 35A
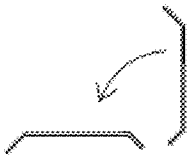
FIG. 35B
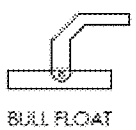
FIG. 35E
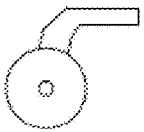
FIG. 35D
FIG. 35C
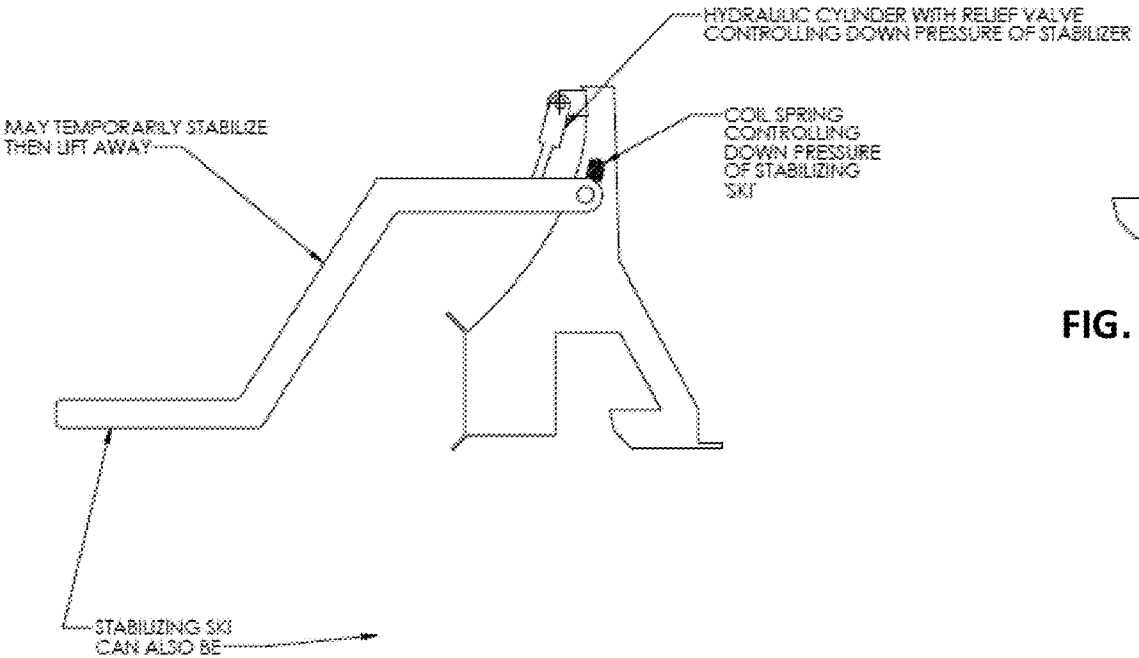
FIG. 35

MSHR HEAD ATTACHMENT TO BOOM

MSHR POWERED HEAD ROTATION

THIS CAN APPLY TO MANY/ALL HEAD/TRACK CONCEPTS

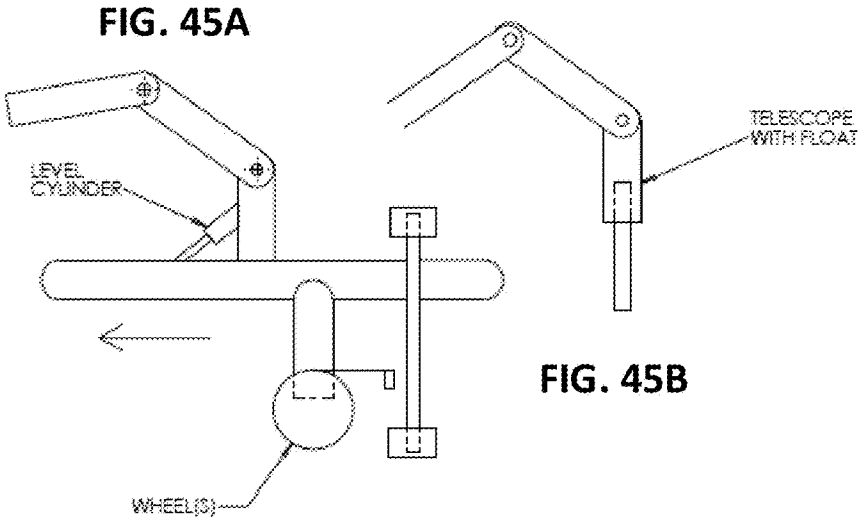
FIG. 45A
FIG. 45B
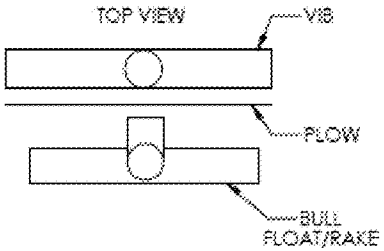
FIG. 45C
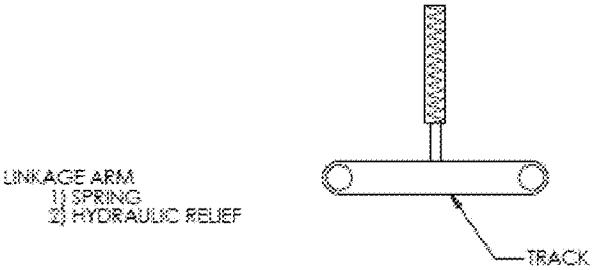
FIG. 45F
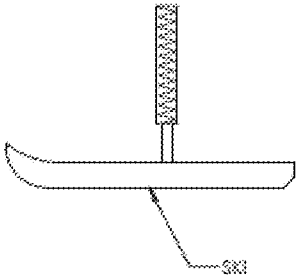
FIG. 45E
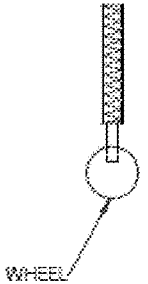
FIG. 45D

CONCRETE SCREEDING SYSTEM WITH BOOM MOUNTED SCREED HEAD

CROSS REFERENCE TO RELATED APPLICATIONS

The present application claims the filing benefits of U.S. provisional applications, Ser. No. 62/420,636, filed Nov. 11, 2016, and Ser. No. 62/396,585, filed Sep. 19, 2016, which are hereby incorporated herein by reference in their entireties.

FIELD OF THE INVENTION

The present invention relates generally to an apparatus and method for leveling and smoothing of freshly poured concrete that has been placed over a surface.

BACKGROUND OF THE INVENTION

Screeding devices or machines are used to level and smooth uncured concrete to a desired grade. Known screeding machines typically include a screed head, which includes a vibrating member and a grade setting device, such as a plow and an auger device. The screed head is vertically adjustable, such as in response to a laser leveling system, to establish the desired grade at the vibrating member. Examples of such screeding machines are described in U.S. Pat. Nos. 4,655,633; 4,930,935; 6,227,761; 7,044,681; 7,175,363; 7,396,186 and 9,234,318, which are hereby incorporated herein by reference in their entireties.

SUMMARY OF THE INVENTION

The present invention provides a screeding machine that is mountable to a tower or truck or trailer or structure, with an articulating boom or telescoping boom (or other type of extendable/retractable boom) that is adjustable to span large distances, and with a screed head disposed at the distal end of the boom for screeding areas at large distances from the tower or structure.

According to an aspect of the present invention, a concrete screeding device or system for screeding uncured concrete placed at a support surface comprises a screed head comprising a grade setting device and a vibrating member, and an extendable and retractable boom. The base end of the boom is attached at a base structure (such as a concrete placing tower) and the screed head is supportable at a distal end of the boom. The boom is extendable so as to position the screed head at almost any distance between the base structure (such as around zero feet or so from the base structure) and a maximum distance of at least about 20 feet from the base structure. The base end of the boom may be pivotally attached at the concrete placing tower and the concrete screeding device is operable to pivot said boom at least about 180 degrees about a longitudinal or vertical axis of the concrete placing tower.

The boom may comprise an articulating boom having a plurality of boom sections pivotally joined to adjacent boom sections. For example, at least some of the boom sections pivot relative to other boom sections about a generally vertical pivot axis, or about a generally horizontal pivot axis.

The distal end of the boom may comprise a screed head support that supports the screed head. A stabilizing mechanism may be disposed at the screed head support to stabilize the screed head support at the support surface during a screeding pass of the screed head. The screed head may thus be movable along the screed head support to perform a screeding pass when the stabilizing mechanism is engaged with the support surface.

The screed head may comprise a floating screed head, and the boom may be adjustable to place the screed head at a location remote from the base end of the tower, whereby the screed head is unsupported by the boom and floats on the placed uncured concrete. The screed head is then movable along the concrete to screed the concrete. For example, the screed head may be movable along the concrete via at least one cable that is adjustable to pull the screed head in a screeding direction, or the screed head may be self-propelled along the concrete to move in a screeding direction.

Therefore, the screeding device of the present invention provides a boom that can reach remote locations at substantial distances from its base structure (such as a concrete pumping tower). The boom can extend to position the screed head at the desired location to perform multiple screed passes at locations where a known screeding machine may not readily access.

According to another aspect of the present invention, a screeding device is provided that is operable to screed remote regions of placed concrete that is remote from where the operator of the screeding device is located. The screeding device may comprise a remote controlled, low ground pressure device or vehicle that is maneuverable on top of the placed concrete surface. Optionally, the screeding device may comprise a low ground pressure device that is maneuverable by an operator that moves or controls an elongated handle or control element that is attached at the screeding device. The distal end of the elongated handle may be attached to a motorized low ground pressure device that supports the screed head thereat and is used to position the screed head at a target location for a start of a screed pass. Optionally, the operator may position a floating screed head or device at a remote location, whereby a cable or other pulling means may operate to pull the screed head over the placed concrete surface to screed a portion of the placed concrete surface.

Therefore, the present invention provides a screeding device that assists or enhances screeding concrete on structural decks and other job sites. The screeding device or system reduces manpower required for screeding the concrete and may create a higher quality floor or surface, while reducing later remedial work on the floor or surface.

These and other objects, advantages, purposes and features of the present invention will become apparent upon review of the following specification in conjunction with the drawings.

BRIEF DESCRIPTION OF THE DRAWINGS

FIG. 12 is a top plan view of the boom attached at the tower, with a sensor that senses proximity of the boom with objects or other booms or the like;

FIGS. 29-32 are views of various types of booms suitable for mounting the screed head, including a lattice boom with a trolley, a telescoping boom with a trolley, a vertically articulating boom and a horizontally articulating boom;

FIGS. 35, 35A, 35B, 35C, 35D, and 35E show optional stabilizing mechanisms or devices for stabilizing the outer boom section and/or screed head at the placed concrete;

FIGS. 45A-F are views of different screed heads that are supported at the outer end of the boom and are movably supported at the concrete, such as via wheels or skis or tracks or the like;

DESCRIPTION OF THE PREFERRED EMBODIMENTS

Figure 1:
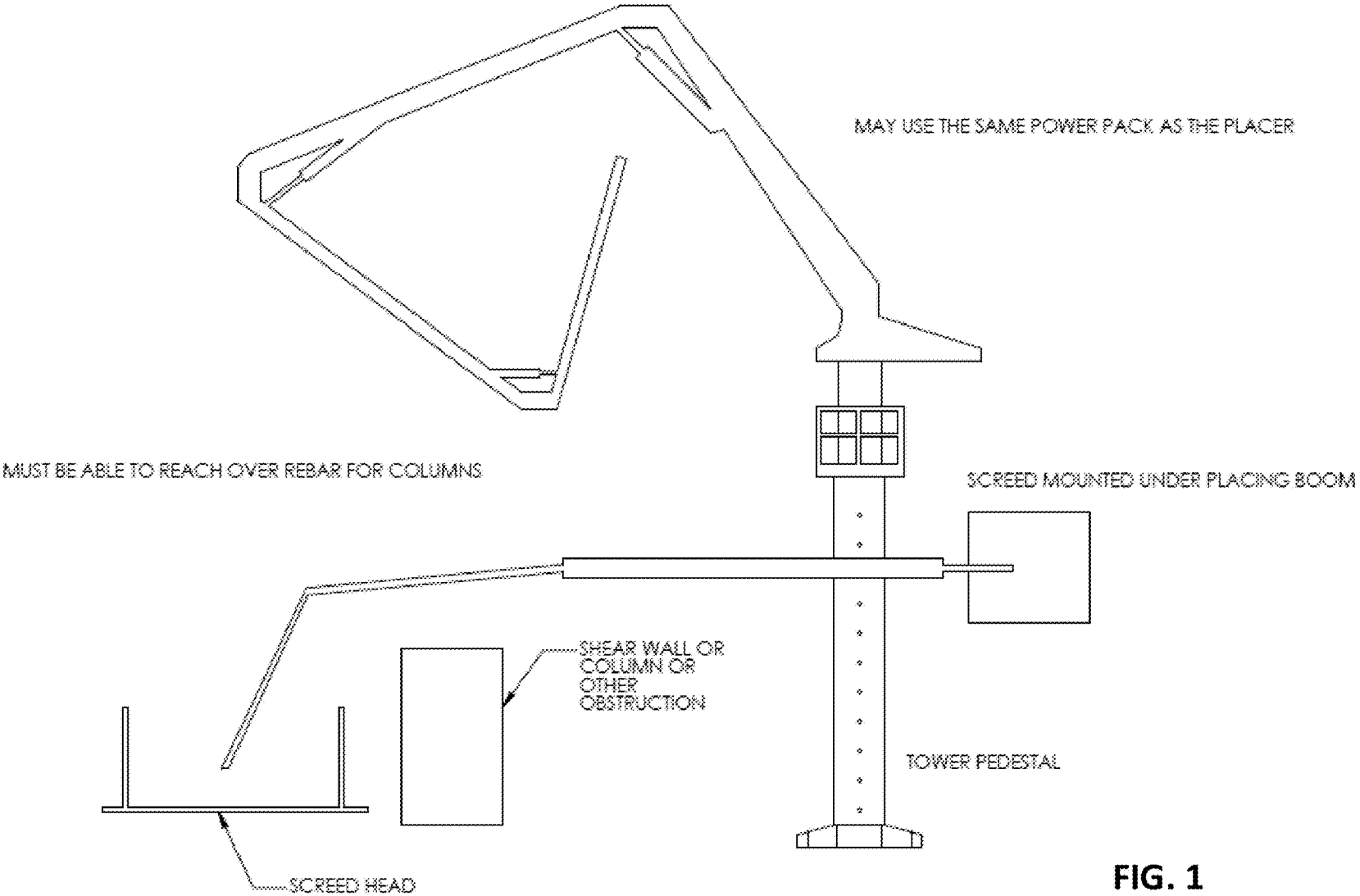
FIG. 1 is a perspective view of a concrete screeding machine that is mounted to a tower pedestal and incorporates an articulating boom and screed head of the present invention.
Figure 2:
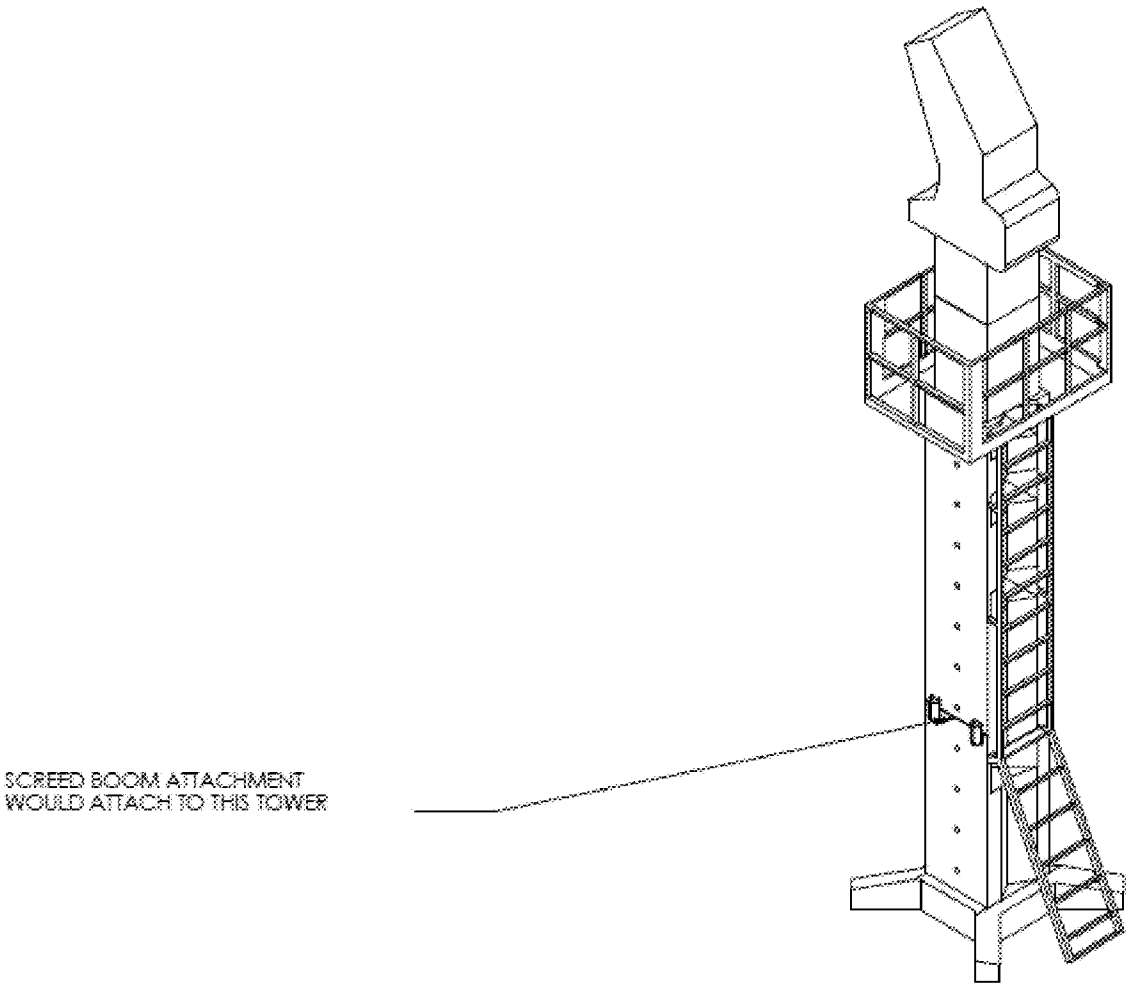
FIG. 2 is a perspective view of the tower pedestal of FIG. 1.
Figure 3:
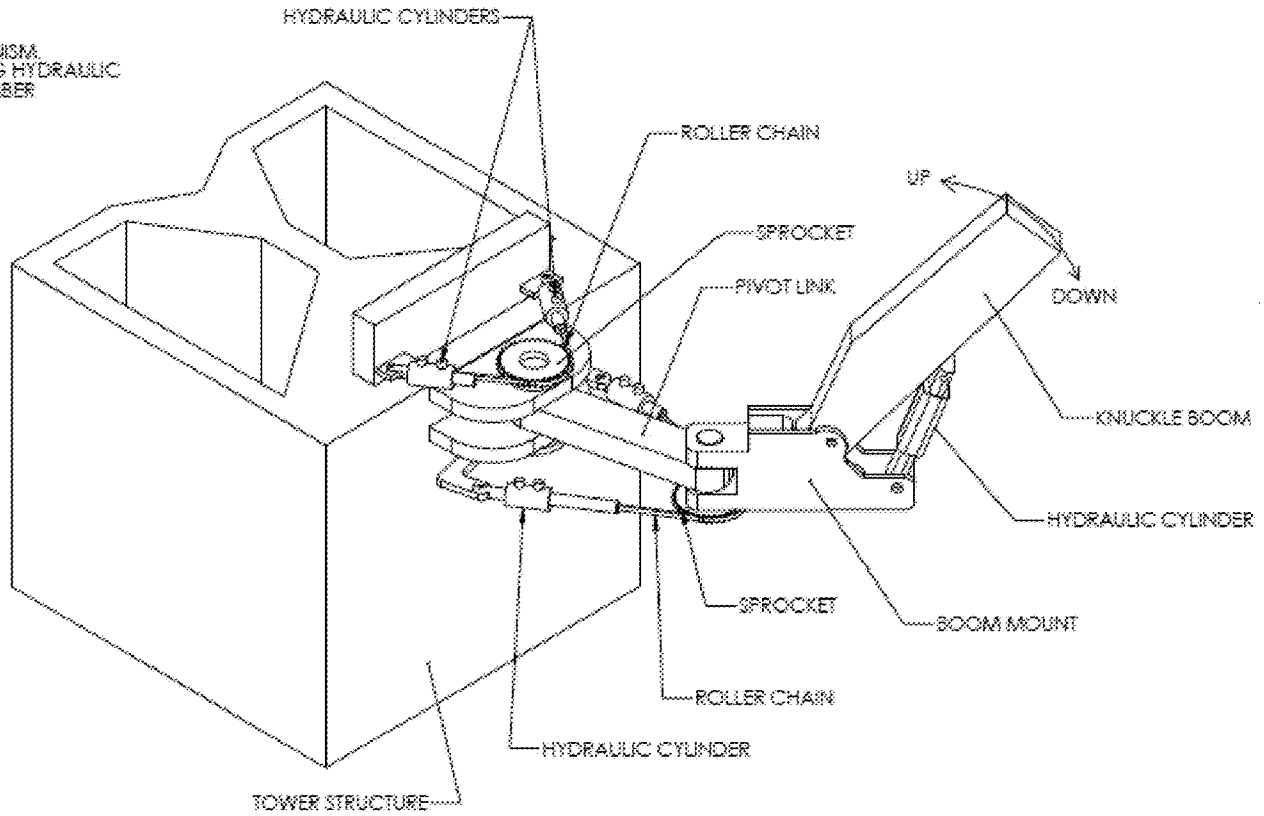
FIG. 3 is a perspective view of a dual pivoting boom mounting mechanism for mounting the boom to the tower in accordance with the present invention.
Figure 5:
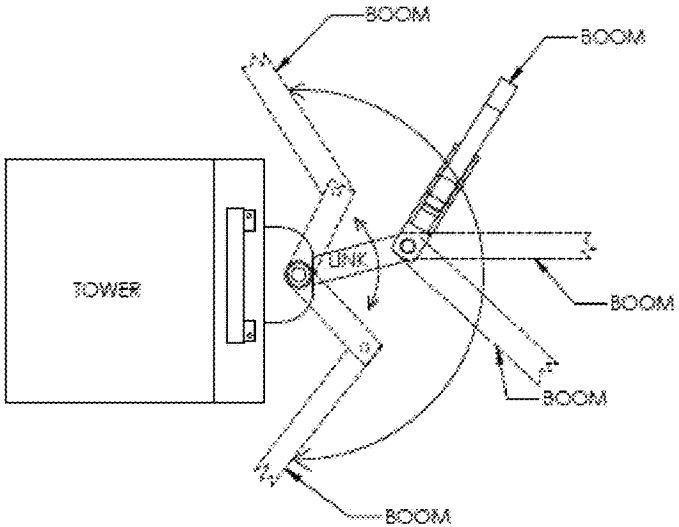
FIGS. 4 and 5 are additional views of the boom mounted at the tower in FIG. 3.
Figure 4:
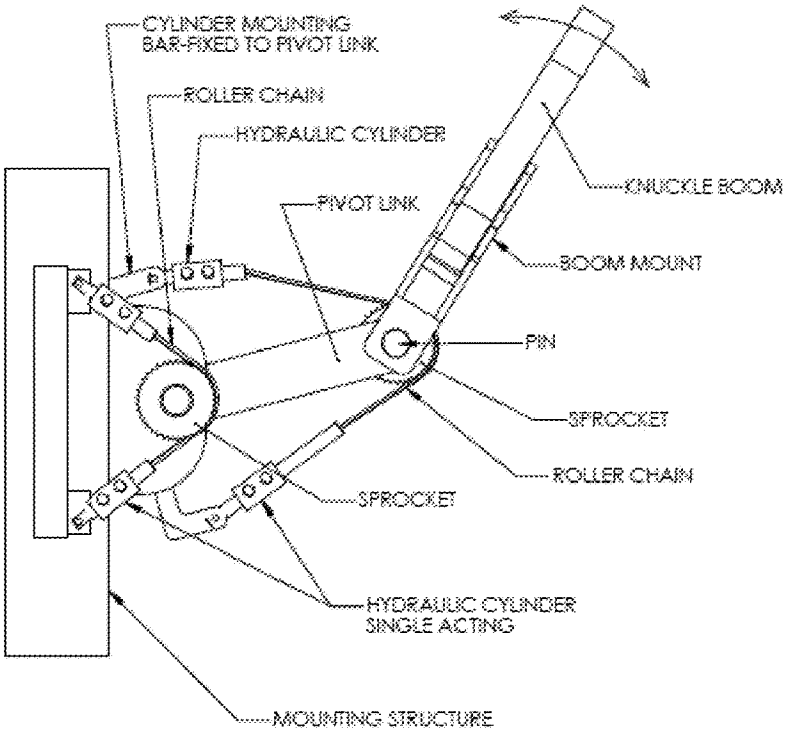
Figure 6:
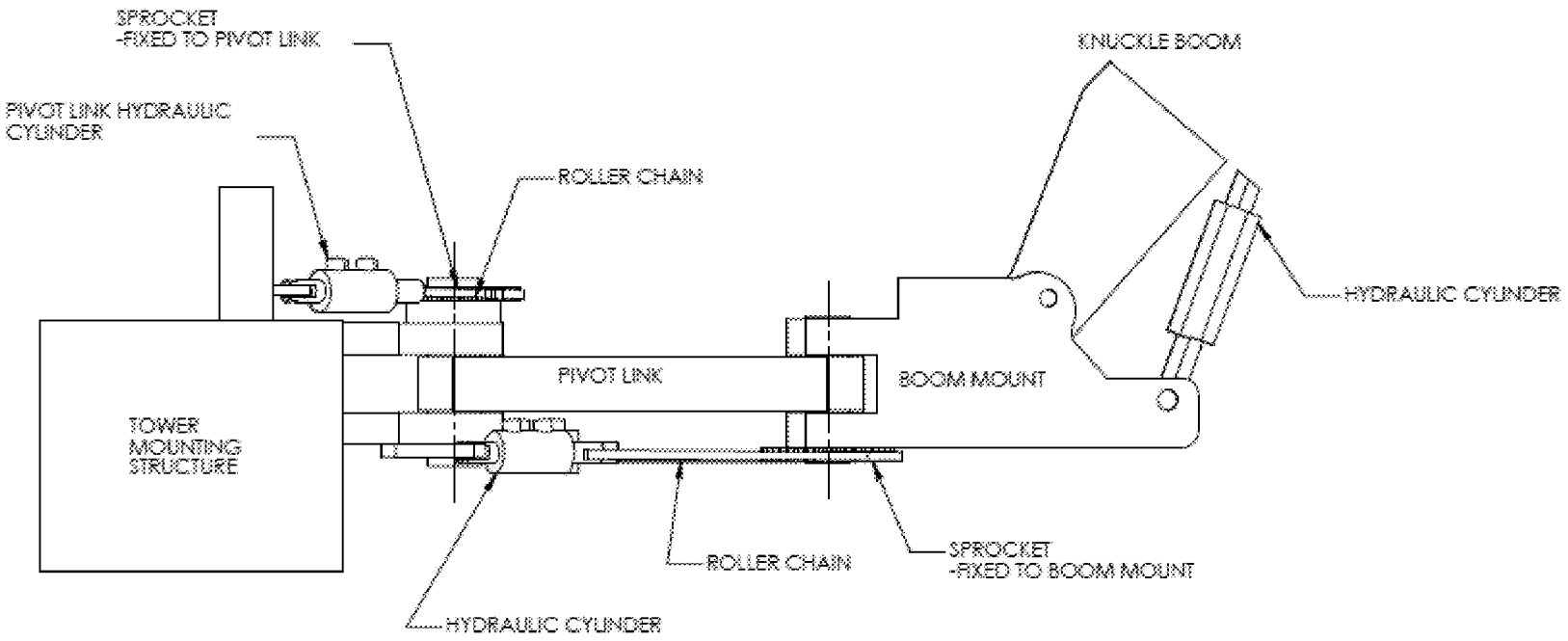
FIG. 6 is a side view of the boom mounting mechanism for mounting the boom to the tower.
Figure 7:
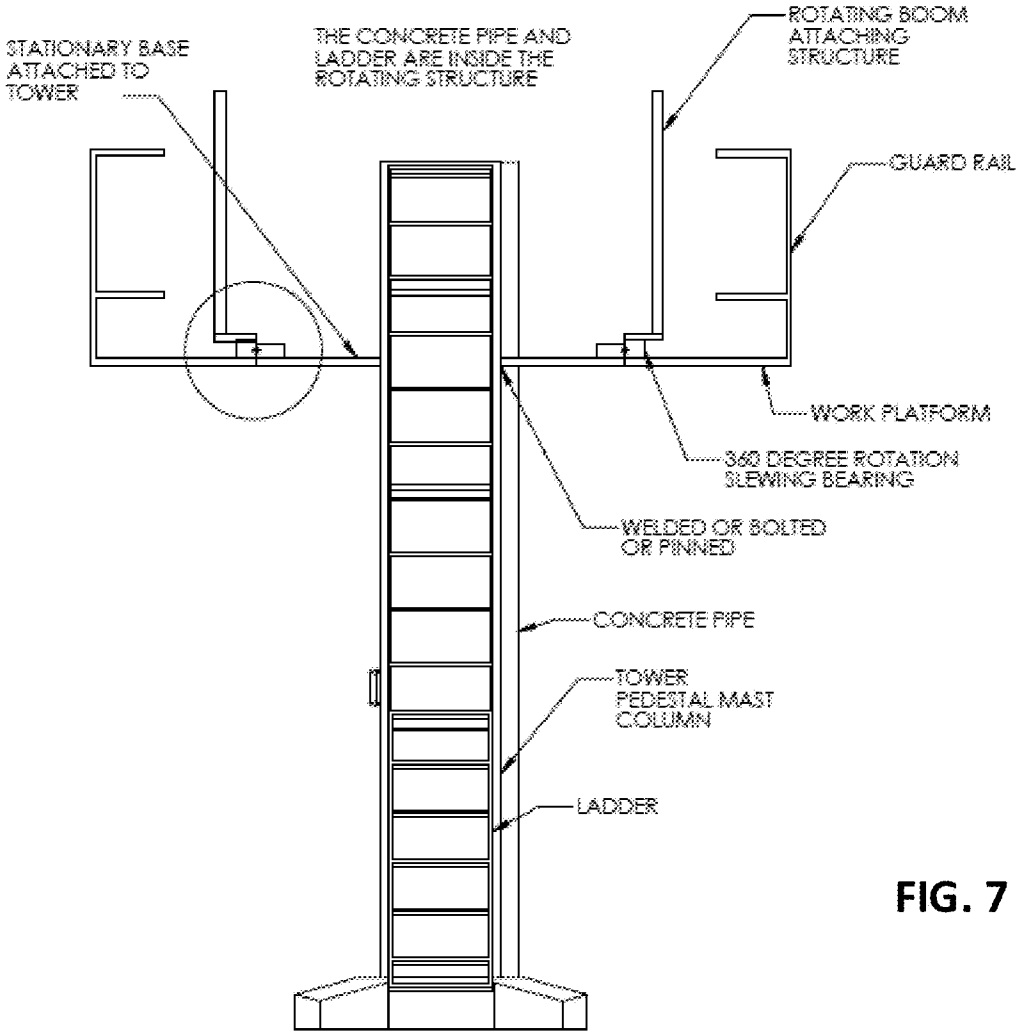
FIG. 7 is a side elevation and partial sectional view of another boom mounting mechanism for mounting the boom to the tower, with an alternative rotation mechanism shown in FIG. 7A.
Figure 7A:
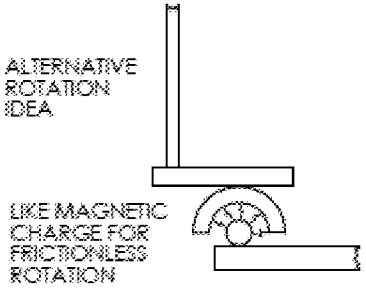

Referring now to the drawings and the illustrative embodiments depicted therein, a screed head is disposed at or attached at an outer end of a large boom (such as a lattice boom, an articulating boom (with sections that pivot about horizontal and/or vertical pivot axes) or telescoping boom), with the base end of the boom pivotally mounting at a tower structure, such as a tower that supports a concrete pumping device for placing concrete at locations remote from the tower. The boom is adjustable and extendable to reach and position the screed head at almost any location from at or near the base or tower up to at least about 20 feet from the tower, preferably at least about 50 feet from the tower and more preferably about 80 feet (or more) from the tower (for example, the boom may, when fully extended, reach up to about 120 feet or thereabouts away from the tower), in order to position the screed head at locations where the concrete pumping system can reach with its upper boom structure (typically mounted at the upper end of the tower). The screed head includes a plow and a vibrating element and is operable (when positioned at freshly placed concrete at a desired or appropriate screeding area) to set or establish the desired grade of the uncured concrete and to screed the concrete as the screed head is moved over the uncured concrete. The screed head is movable over the concrete via movement of the boom or via movement of a support trolley at the boom or movement of a telescoping outer boom section of the boom or via movement or control of a cable system attached at the boom and screed head or via driving of a moving device at the screed head or the like. After the screed head has completed a screed pass at the screeding location, the boom may lift the screed head from the concrete and move the screed head to another location at the uncured concrete to begin another screed pass.

The boom is adjustable to move the screed head over the placed concrete, while the screed head, when positioned at the beginning of a screed pass is operable to establish a desired grade of the concrete surface and smooth or finish or screed the concrete. The screed head or a screed head support (that supports the screed head during the screed passes) may include a stabilizing device or mechanism that contact the ground surface to stabilize the screed head support and screed head at the support surface during the screeding operation.

The screeding machine and the screeding head or assembly may utilize aspects similar in construction and/or operation of the screeding machines and screeding heads described in U.S. Pat. Nos. 4,655,633; 4,930,935; 6,227,761; 6,976,805; 7,044,681; 7,121,762; 7,175,363; 7,396,186; 7,850,396 and/or 9,234,318, and/or U.S. Publication Nos. US-2007-0116520; US-2010-0196096 and/or US-2014-0294504, which are all hereby incorporated herein by reference in their entireties, such that a detailed discussion of the overall construction and operation of the screeding machines and screeding heads need not be repeated herein.

The boom is pivotally mounted at a tower pedestal of a concrete placing tower and boom, and is preferably extendable to lengths comparable to the reach of the placing boom, such that the boom and screed head can reach and screed the concrete placed by the placing boom and pumping system. As shown in FIG. 1, the boom may be mounted high enough on the tower (or may be otherwise adjustable) to reach over walls or partial walls or structures. The base end of the boom is adjustably or pivotally or rotatably mounted at the tower, such as via various pivoting boom mounting mechanisms, such as shown in FIGS. 3-10. For example, and such as shown in FIGS. 3-6, a pivot mechanism may include a first actuator and mechanism that pivots a base arm or link of the boom about 180 degrees relative to the tower (such as via a sprocket and chain and actuators that move the chain to rotate the sprocket), while another actuator and mechanism (such as via another sprocket and chain and actuators that move the chain to rotate the sprocket) pivots the boom relative to an outer end of the base arm or link, thus providing over 180 degrees of reach of the boom around the tower. If the boom sections articulate about vertical pivot axes (such as shown in FIG. 32), the pivot mechanism and boom of FIGS. 3-6 would be able to position the screed head at almost any position 360 degrees around the boom. If the boom can extend to, when fully extended, position the screed head about 50 feet or about 100 feet or more from the tower at any location around the tower, the boom and screed head assembly of the present invention can provide enhanced screeding coverage of a large support surface.

Figure 8:
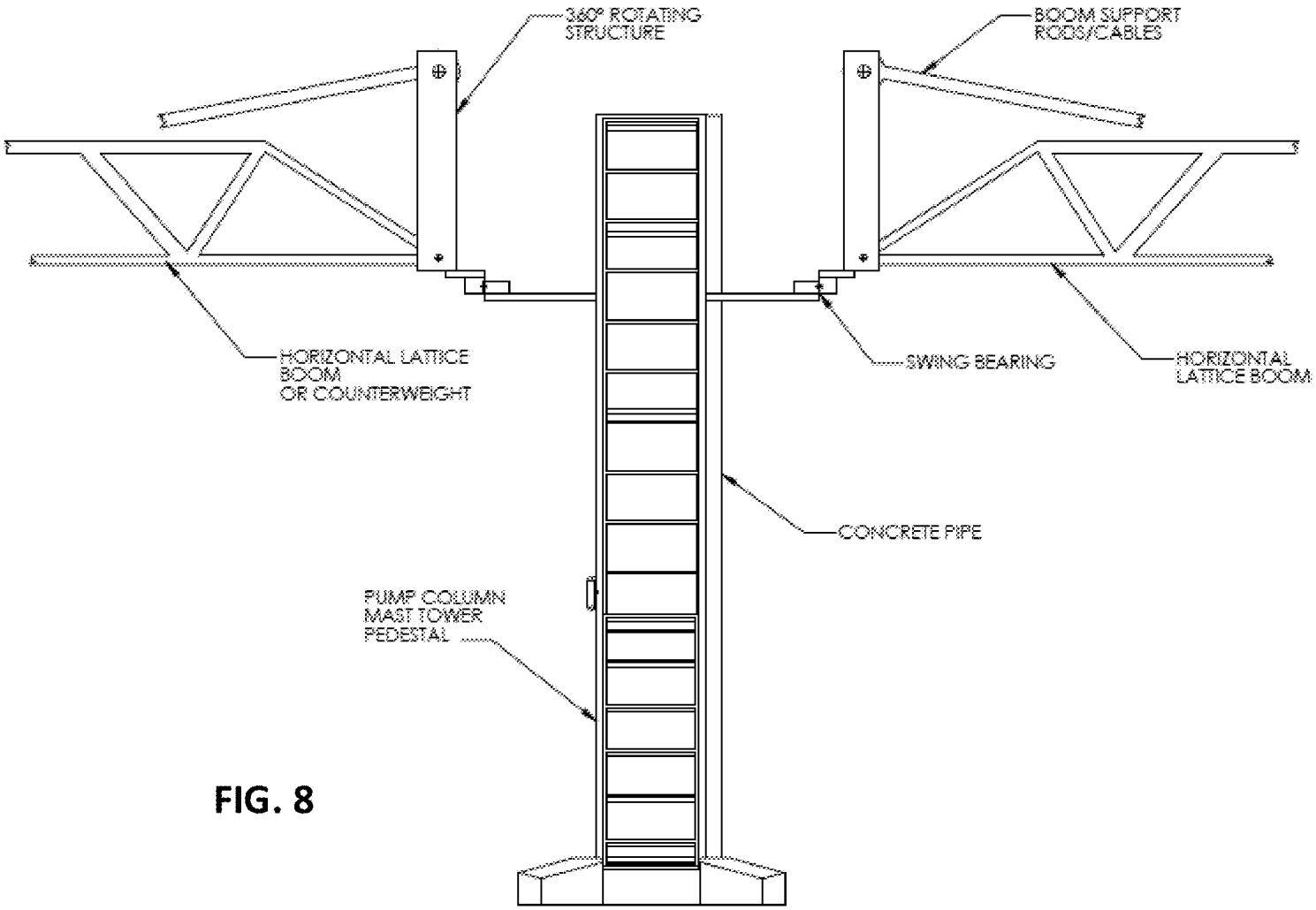
FIGS. 8 and 9 are side elevations and partial sectional views of another boom mounting mechanism for mounting the boom to the tower, with a counterweight boom opposite the screed head boom to balance the boom and screed head at the tower.
Figure 9:
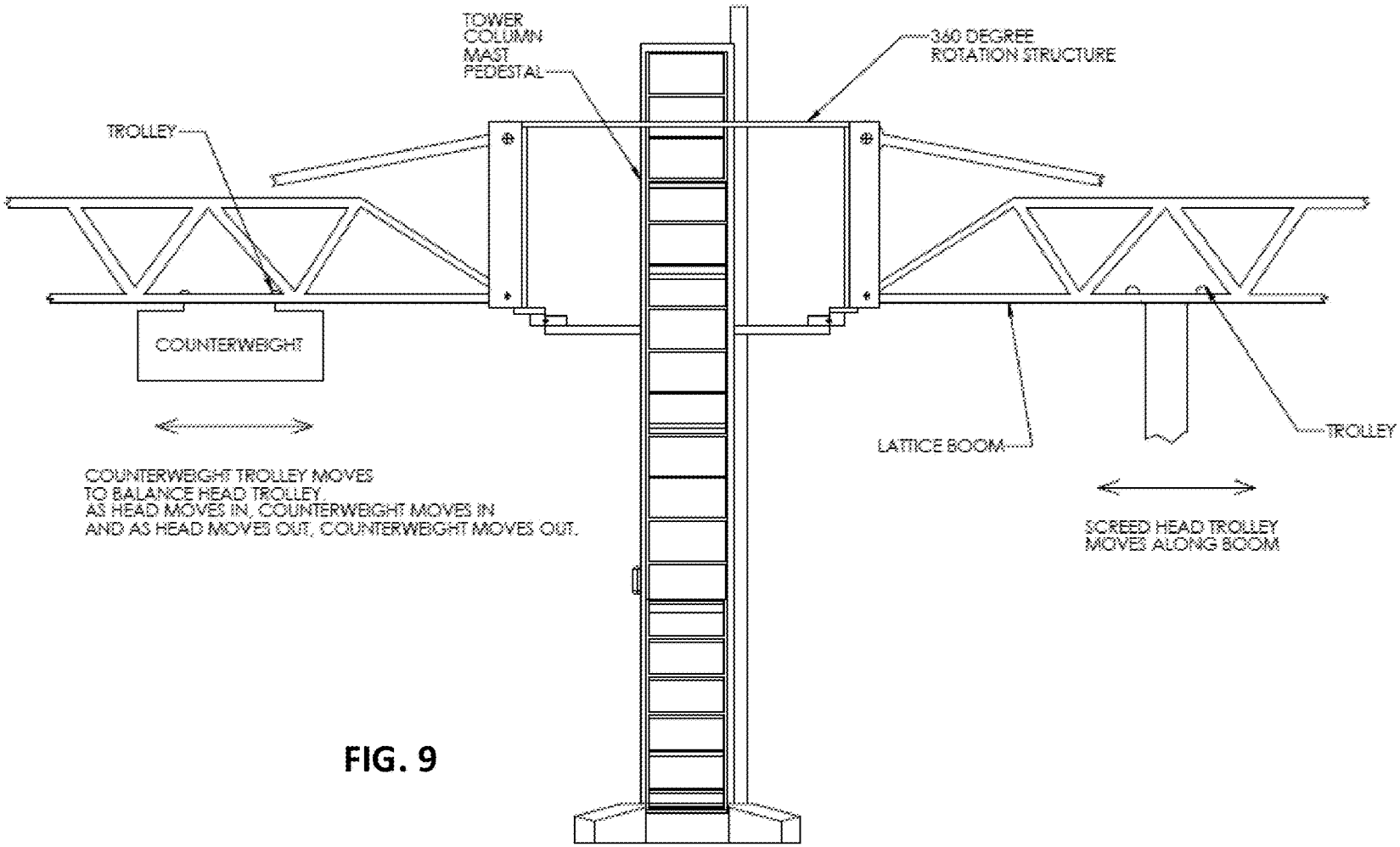
Figure 10:
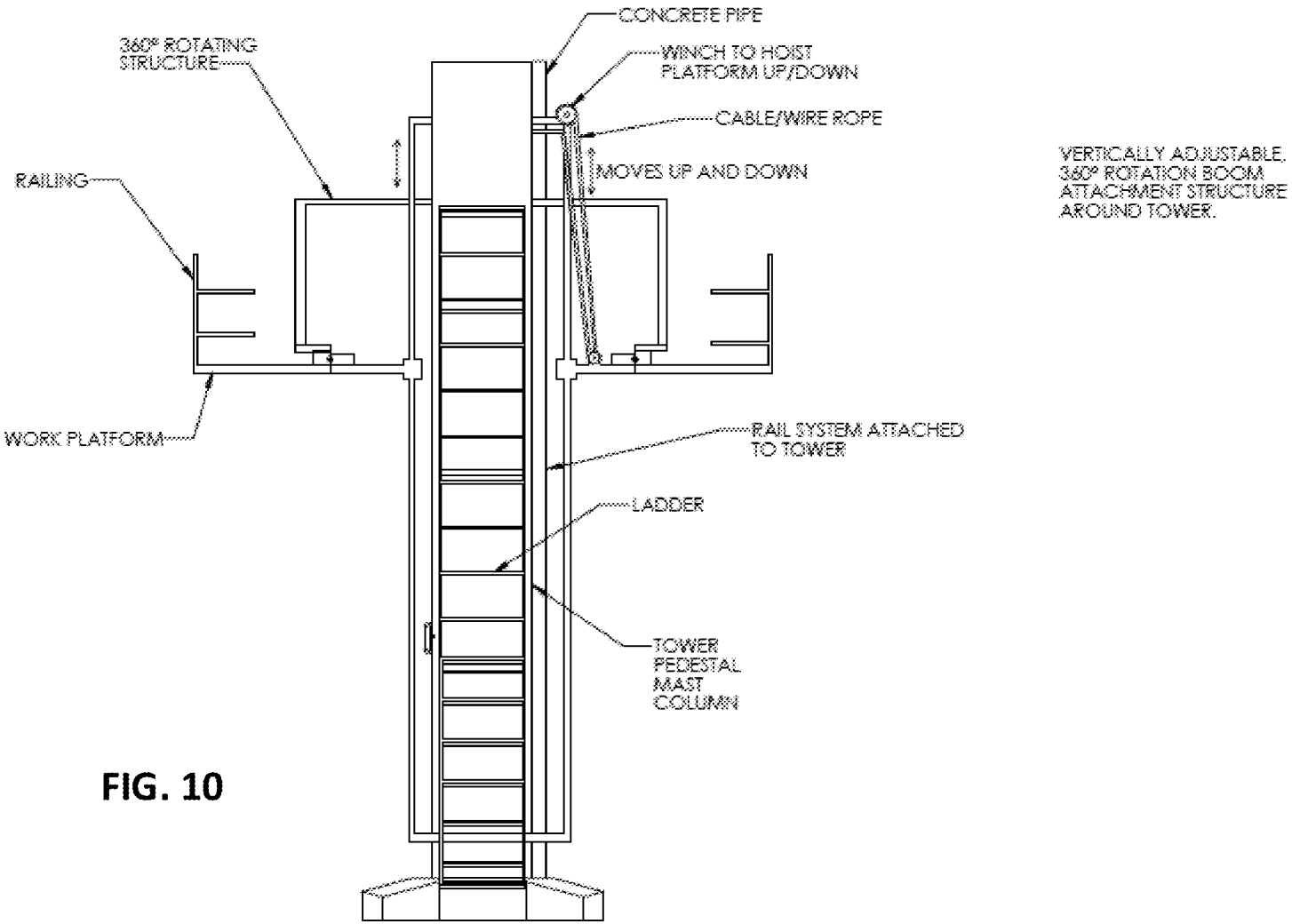
FIG. 10 is a side elevation and partial sectional view of another boom mounting mechanism for mounting the boom to the tower.

The boom may attach at the tower via any suitable means. Optionally, for example, the boom may attach at an outer region or around the tower (such as shown in FIGS. 3-7, 7A, 9 and 10), where the boom may be added to an existing tower without having to adapt the tower. Optionally, the boom may rotatably attach to a tower section (such as shown in FIG. 8), where two sections of the tower may be separated and the tower section of the boom inserted, with the boom tower section including a section of concrete pumping pipe that is connected at either end to the separated tower sections.

Figure 19:
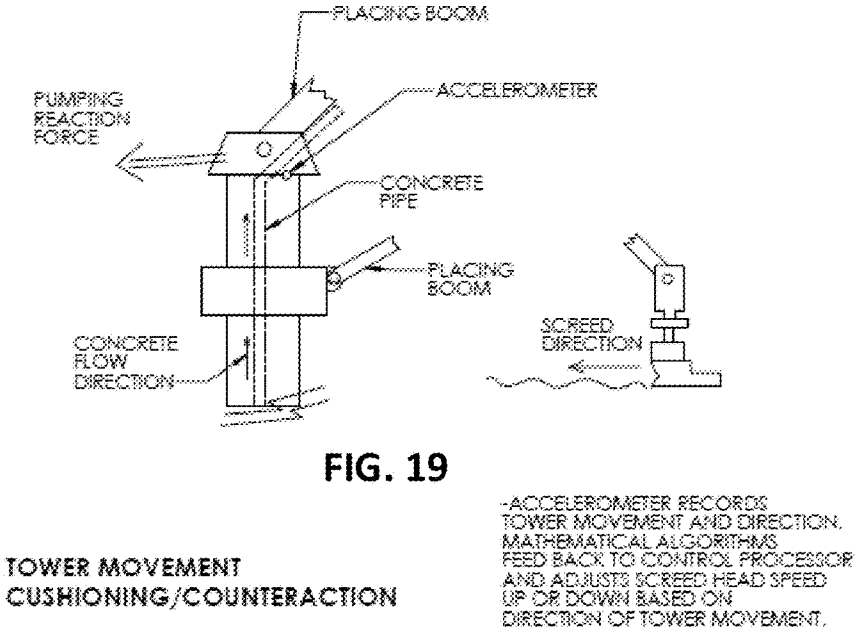
FIG. 19 is a view of the screed head and boom mounted at a tower, showing use of an accelerometer at the tower, whereby movement of the screed head is adjusted based on determined movement of the tower.
Figure 18:
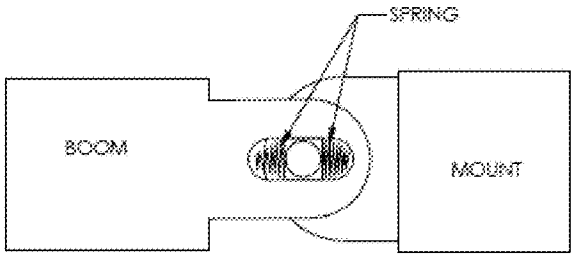
FIGS. 17 and 18 are views of a screed head boom and tower mounting construction, showing use of a shock absorber to limit movement of the boom and screed head when the tower moves or shakes during concrete pumping.
Figure 17:
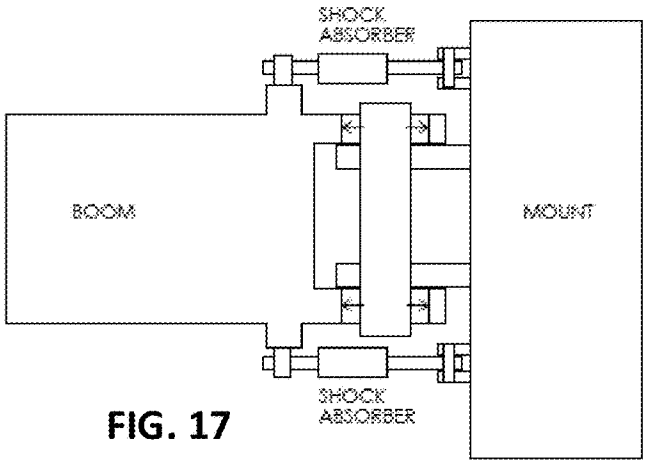
Figure 21:
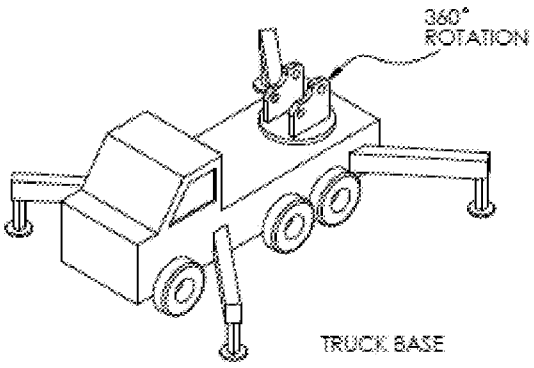
FIG. 21 is a perspective view of a 360 degree rotating mounting structure for mounting the screed head boom at a truck base.
Figure 23:
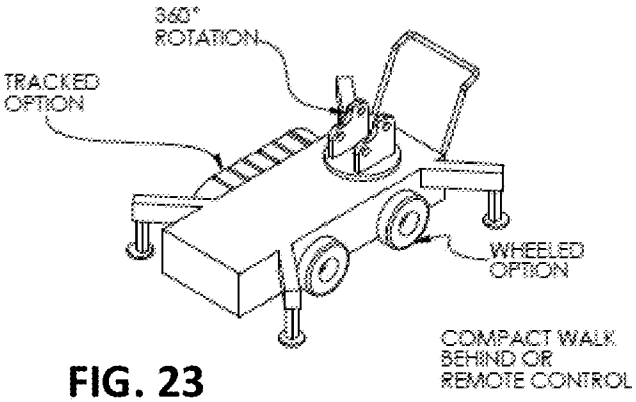
FIG. 23 is a perspective view of a 360 degree rotating mounting structure for mounting the screed head boom at a manually movable apparatus having wheels or tracks or the like, and having stabilizer legs to hold the apparatus in a selected position during use and operation.
Figure 20:
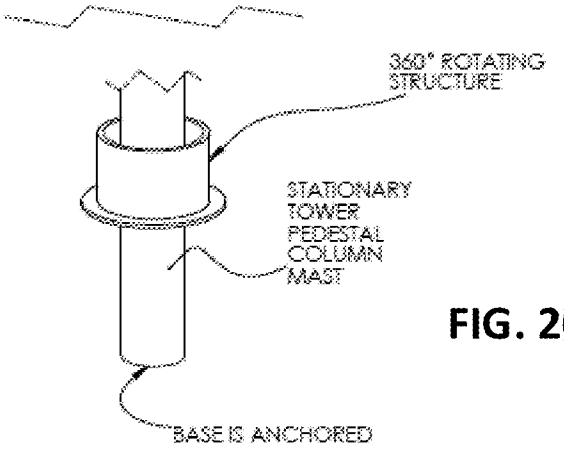
FIG. 20 is a perspective view of a 360 degree rotating mounting structure for mounting the screed head boom at a tower pedestal.
Figure 22:
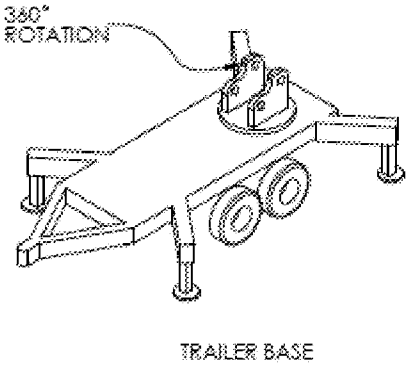
FIG. 22 is a perspective view of a 360 degree rotating mounting structure for mounting the screed head boom at a trailer base.
Figure 24:
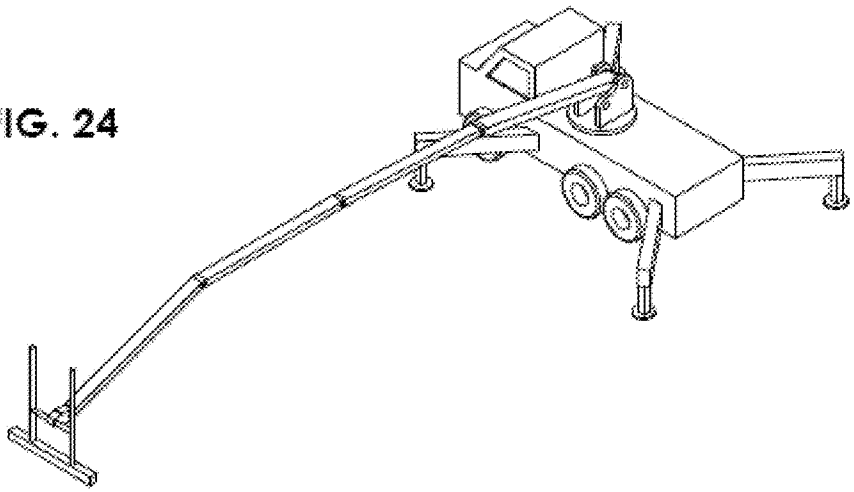
FIGS. 24 and 25 are views of the screed head and boom mounted at a truck base.
Figure 25:
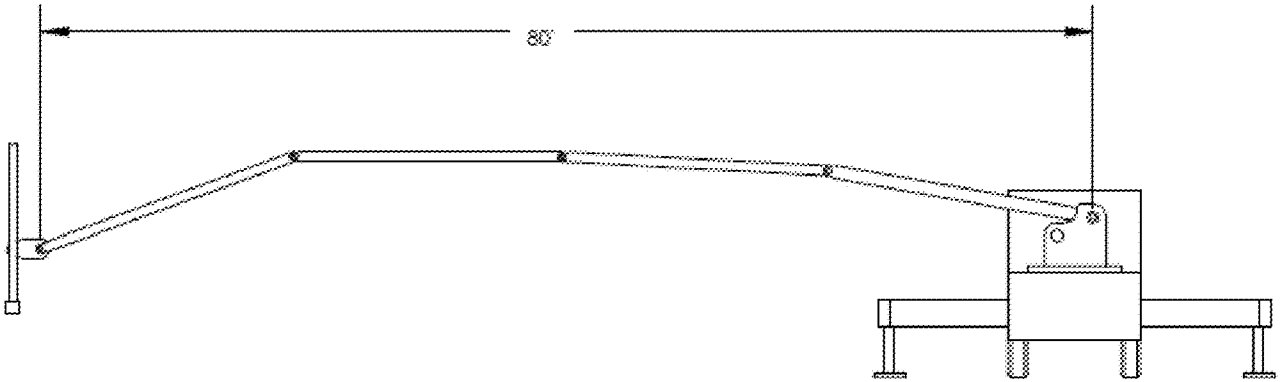
Figure 26:
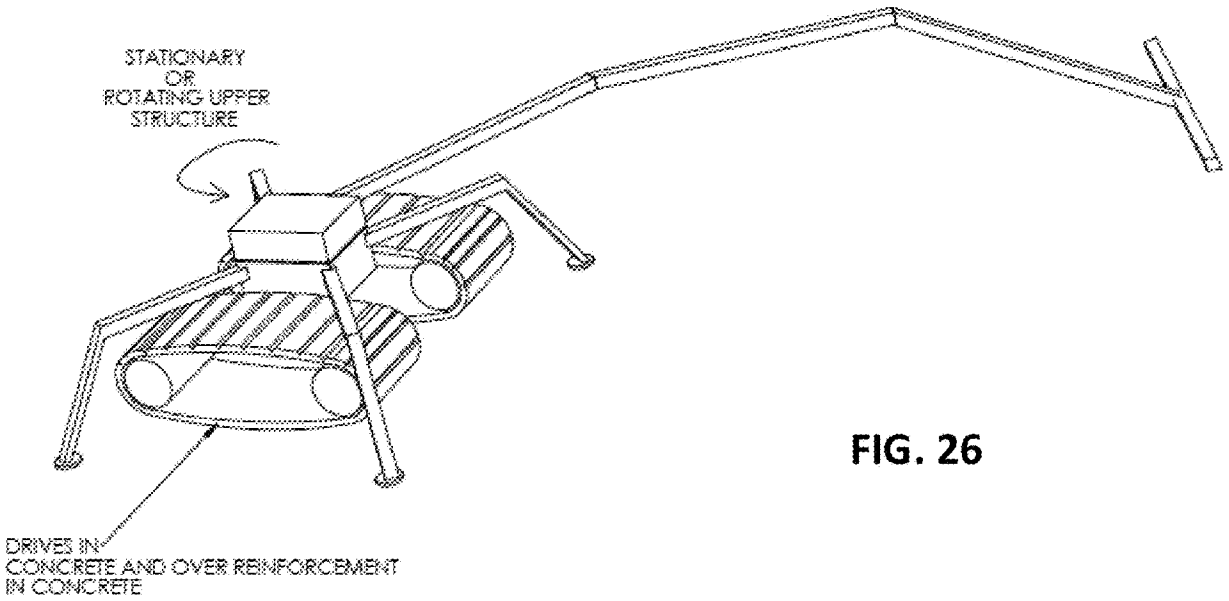
FIGS. 26 and 26A are a perspective view of the screed head and boom mounted at a tractor driven device and a perspective view of augers that could be mounted to the tractor driven device, respectively.
Figure 26A:
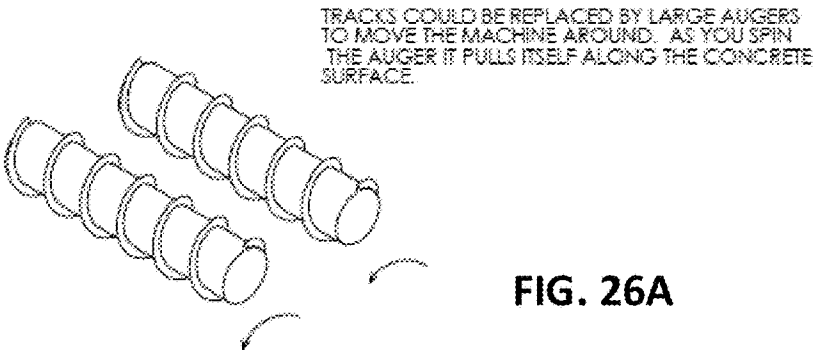
Figures 27, 27A:
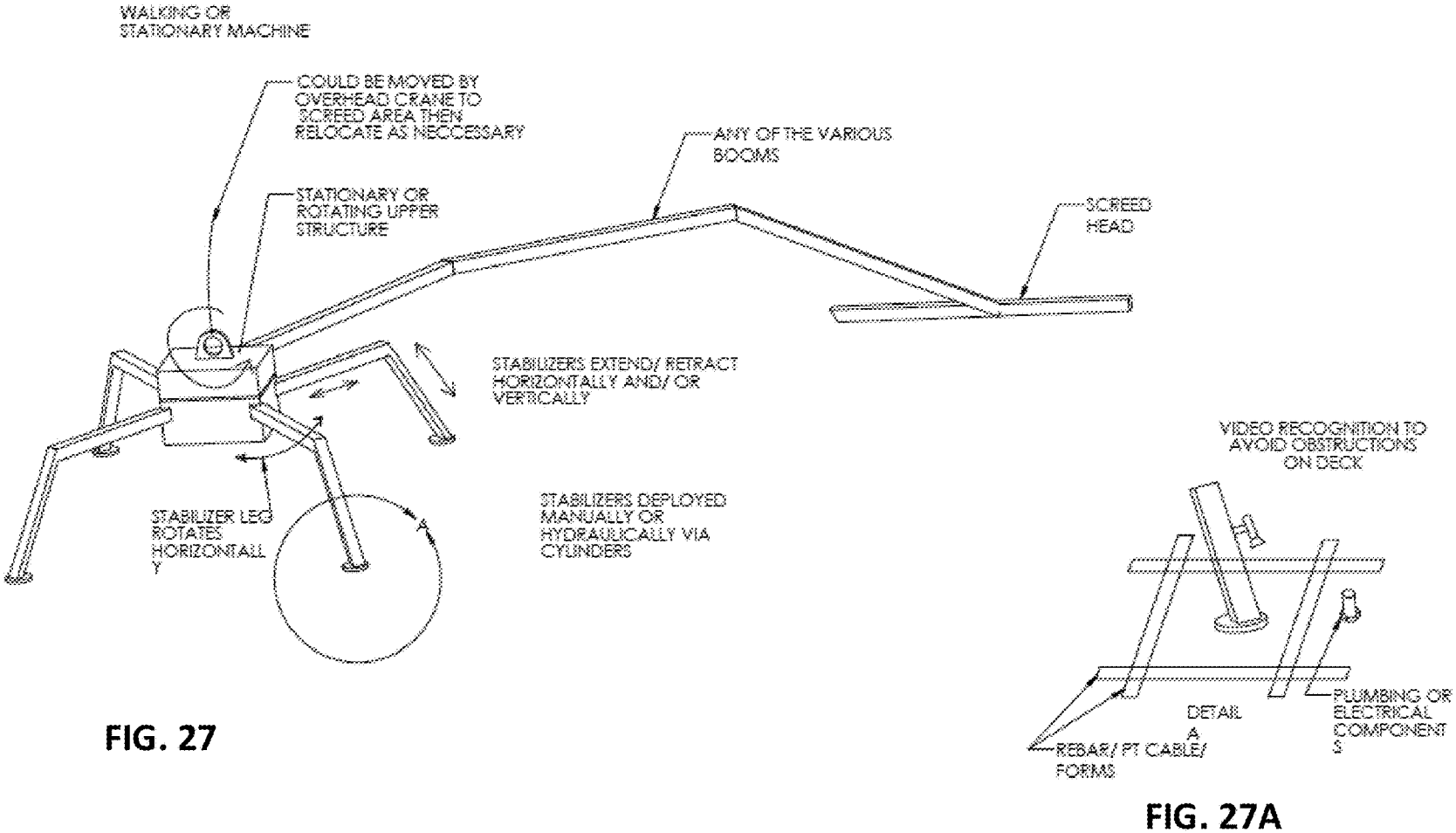
FIGS. 27 and 27A are a perspective view of the screed head and boom mounted at a multi-legged device and an enlarged view of a leg with a video recognition device, respectively.
Figure 28:
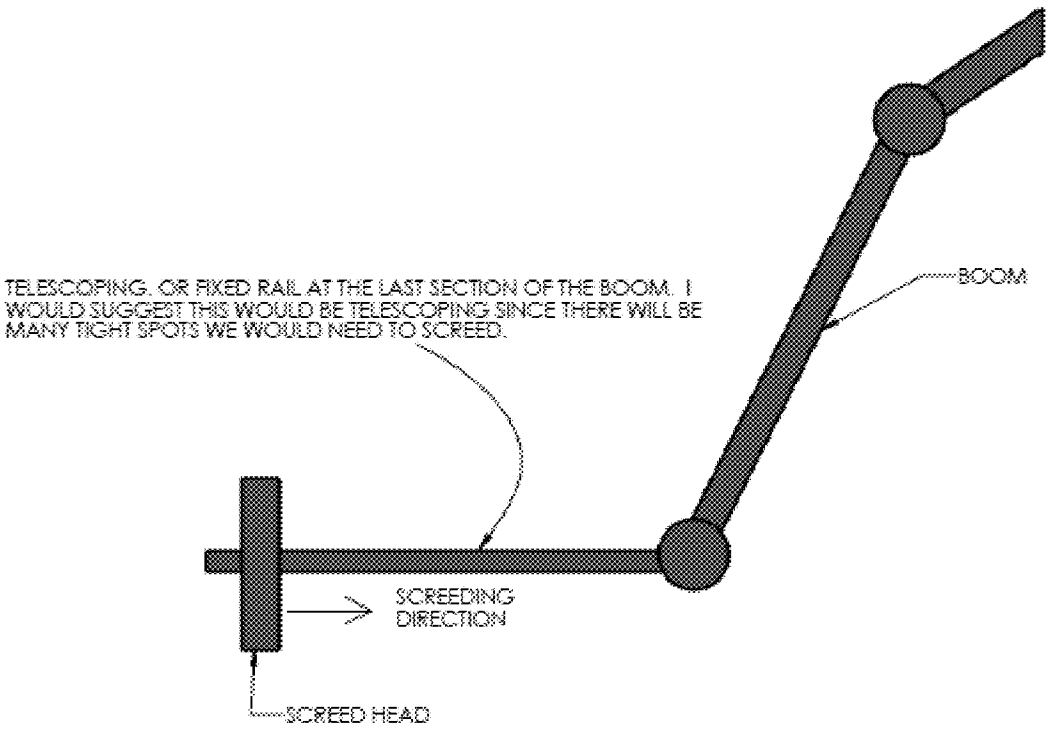
FIG. 28 is a view of a screed head at a telescoping boom section of an articulating boom that is mounted at or extends from a tower or other structure.
Figure 33:
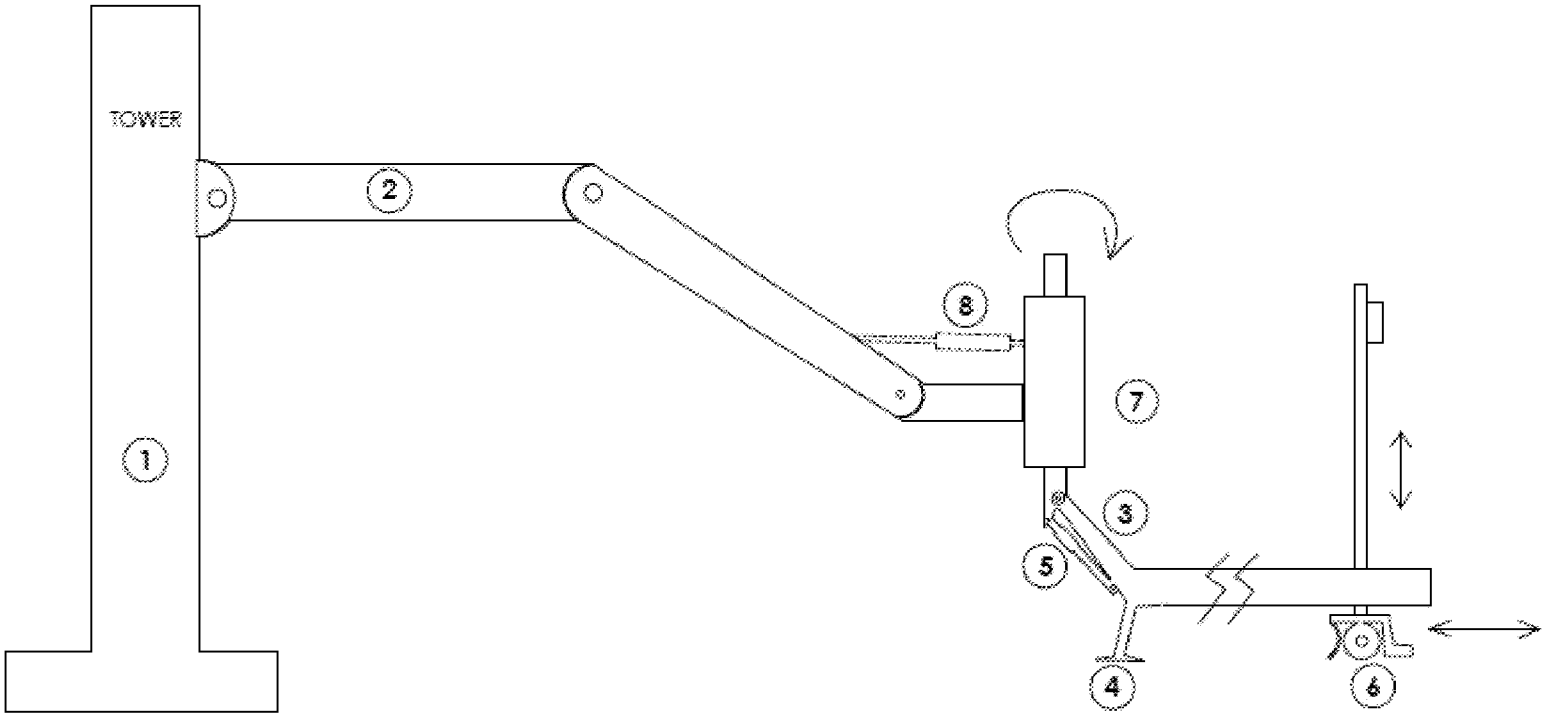
FIG. 33 is a side elevation of a boom and screed head at a tower, with a head swivel 7 and leveling cylinder 5 to position an outer boom section or carrier 3 and screed head 6 at a desired screeding location, with a stabilizing mechanism 4 at the outer boom section to stabilize the outer boom section and the screed head during operation of the screed head.
Figure 34:
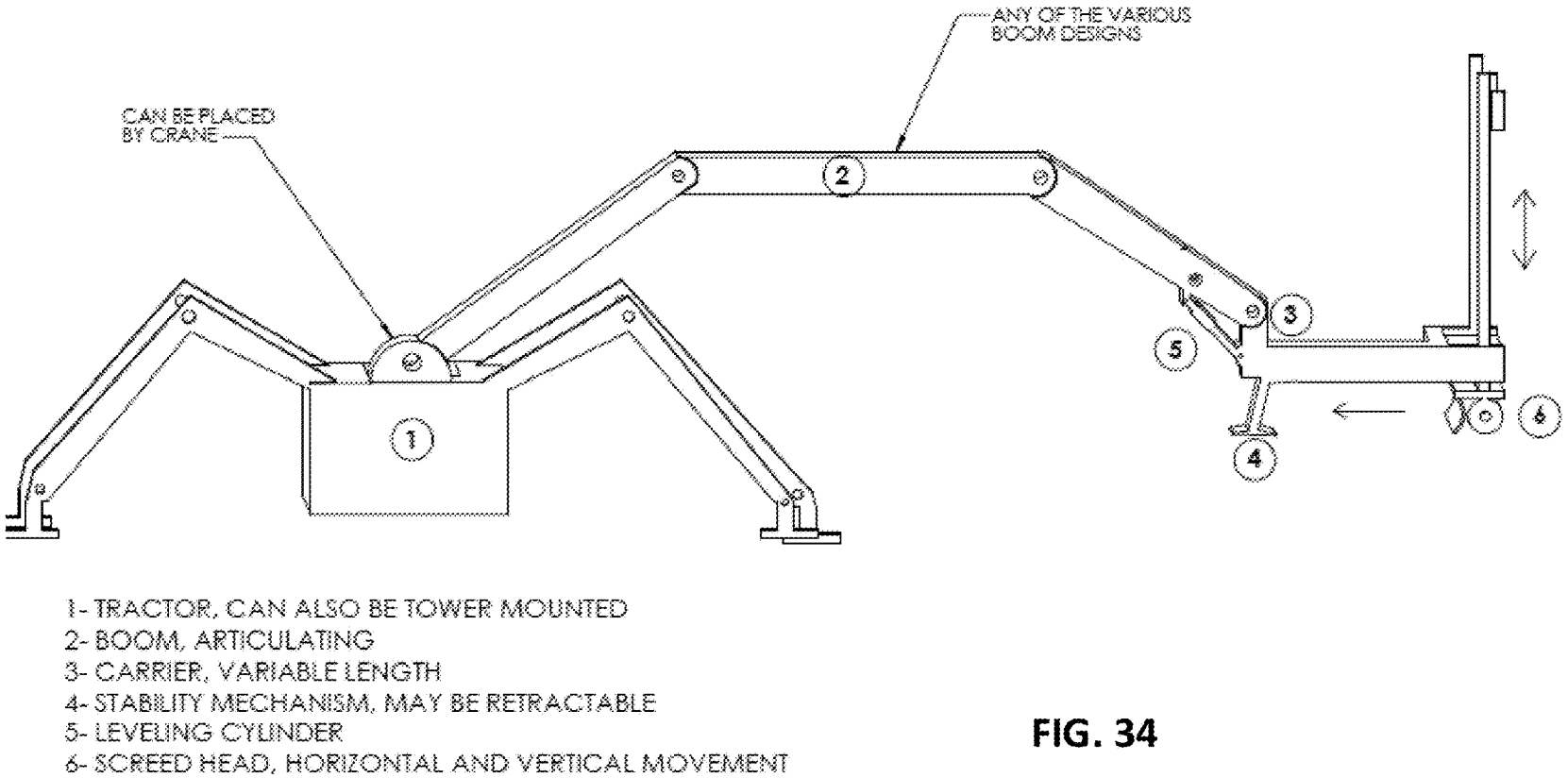
FIG. 34 is a side elevation of a boom and screed head at a tractor device, with a leveling cylinder 5 to position or level an outer boom section or carrier 3 and screed head 6 at a desired screeding location, with a stabilizing mechanism 4 at the outer boom section to stabilize the outer boom section and the screed head during operation of the screed head.

Due to bounce or instability that may occur when the boom and screed head are extended away from the tower (particularly when the concrete is being pumped through the tower for placement of the concrete at the support surface), a boom counterweight (see FIGS. 8 and 9) may be provided opposite the screed head boom to assist in balancing the screed head during operation. Optionally, and such as shown in FIGS. 17-19, the system may include shock absorbers to absorb such movements of the tower, or may measure such movements (such as via an accelerometer) and control the screed head responsive to the measured movements of the tower.

Figure 11:
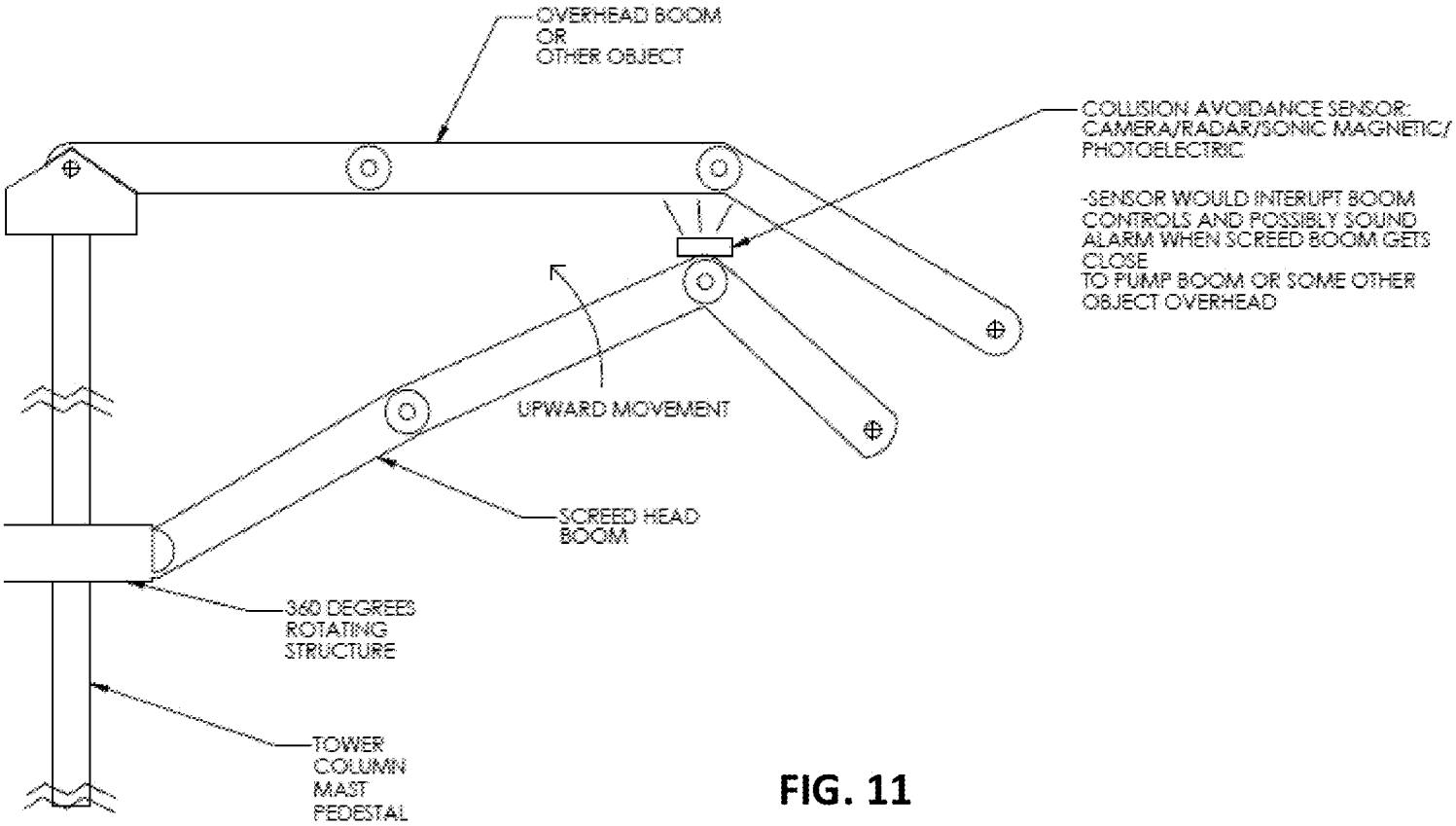
FIG. 11 is a side elevation of another boom attached at a tower, with the boom including a collision avoidance sensor to avoid impacting a concrete placing of pumping boom overhead the screeding boom.
Figure 12:
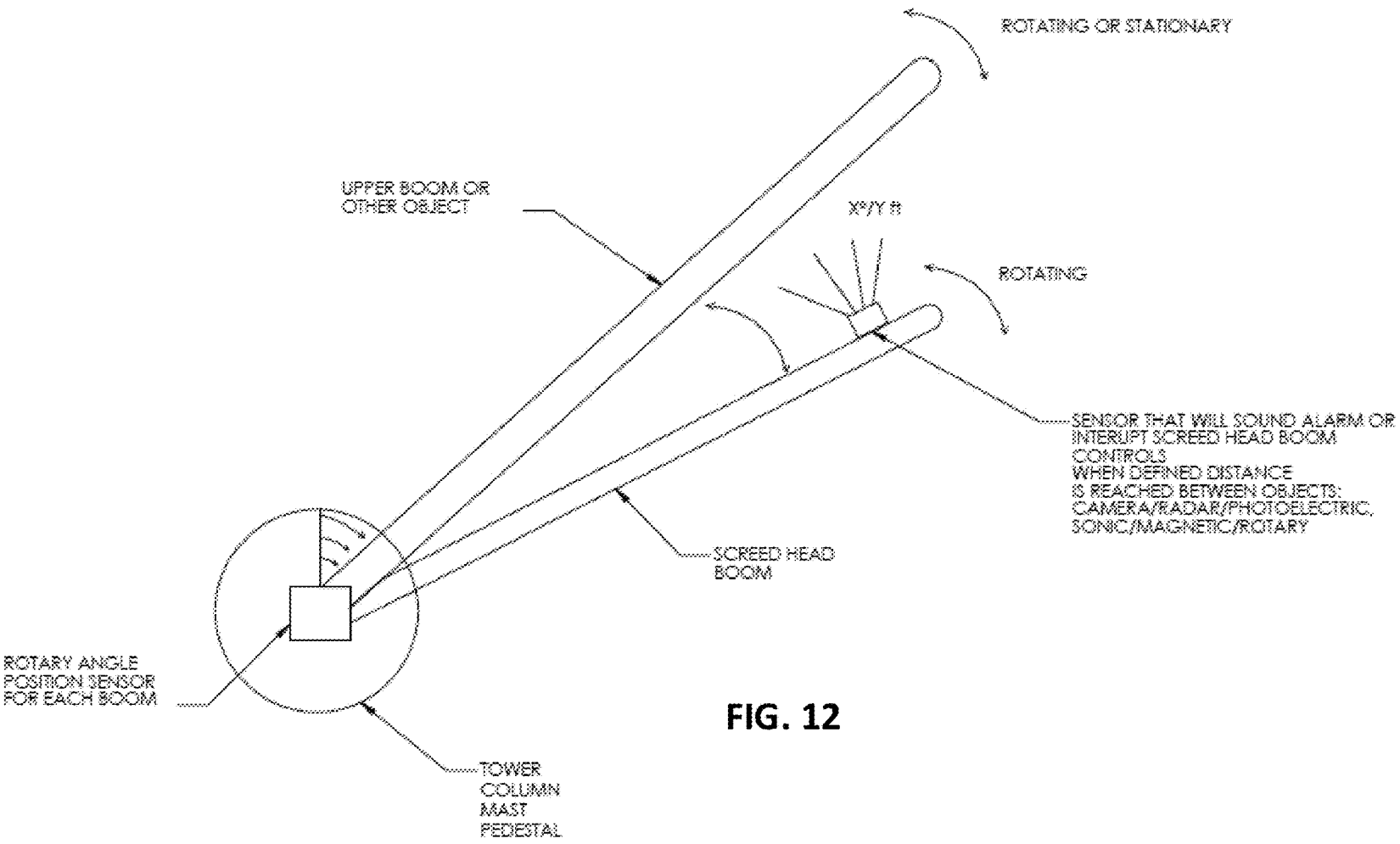
Figure 15:
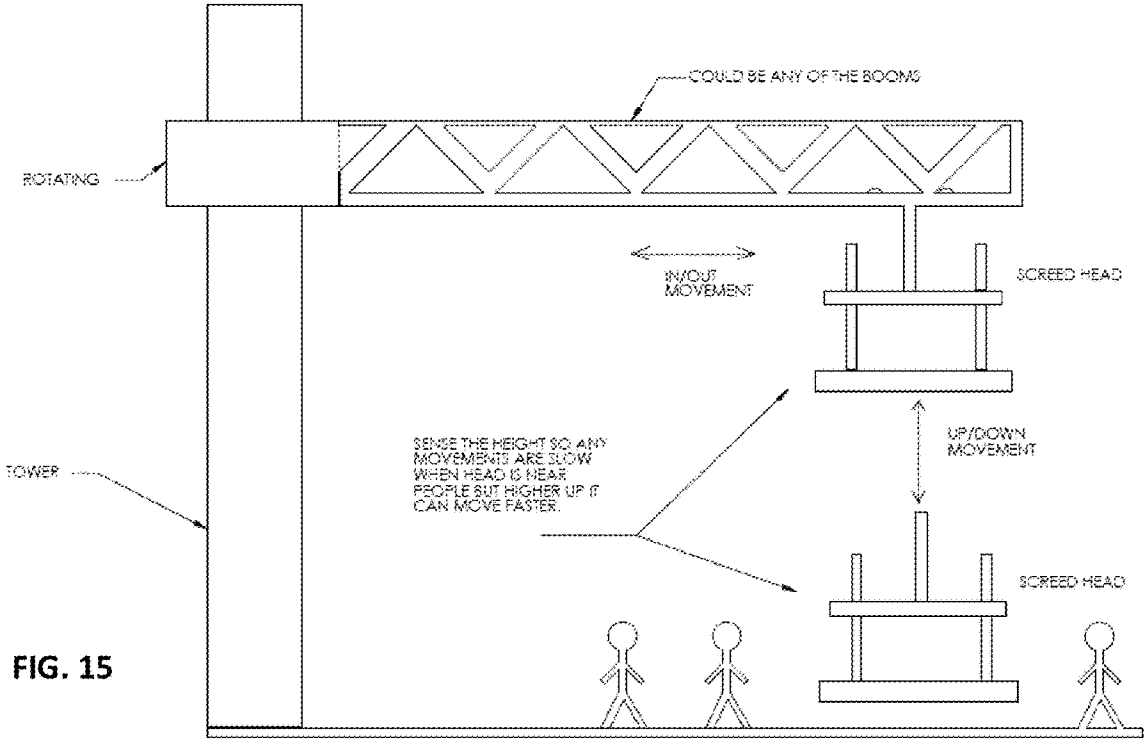
FIG. 15 is a side elevation of the boom and screed head, showing use of height sensors so that movement of the screed head is slowed when the screed head is at a level where it may be near people at the ground level.

During operation, the boom may articulate and/or move in various directions to achieve the desired location of the screed head (such as via control and operation of multiple actuators or hydraulic cylinders mounted at the boom joints and connected between an outer end of one boom section and an inner end of an adjacent boom section). Thus, it is desirable to provide sensors or the like that detect when the boom may be moving in a path towards an object. For example, and such as shown in FIGS. 11, 12 and 15, the boom may include a proximity sensor or collision avoidance sensor to sense the proximity of the boom to the overhead concrete placing boom or any other object (such as a wall or machinery or a person at the support surface). Such a sensor may comprise a camera or image-based sensor or an ultrasonic sensor or a radar sensor or any sensing device or system that is capable of determining proximity of the boom to another object or structure. The system may generate an alert when such proximity to an object is determined, or the system may stop movement of the boom to avoid any collision with the determined object.

Figure 13:
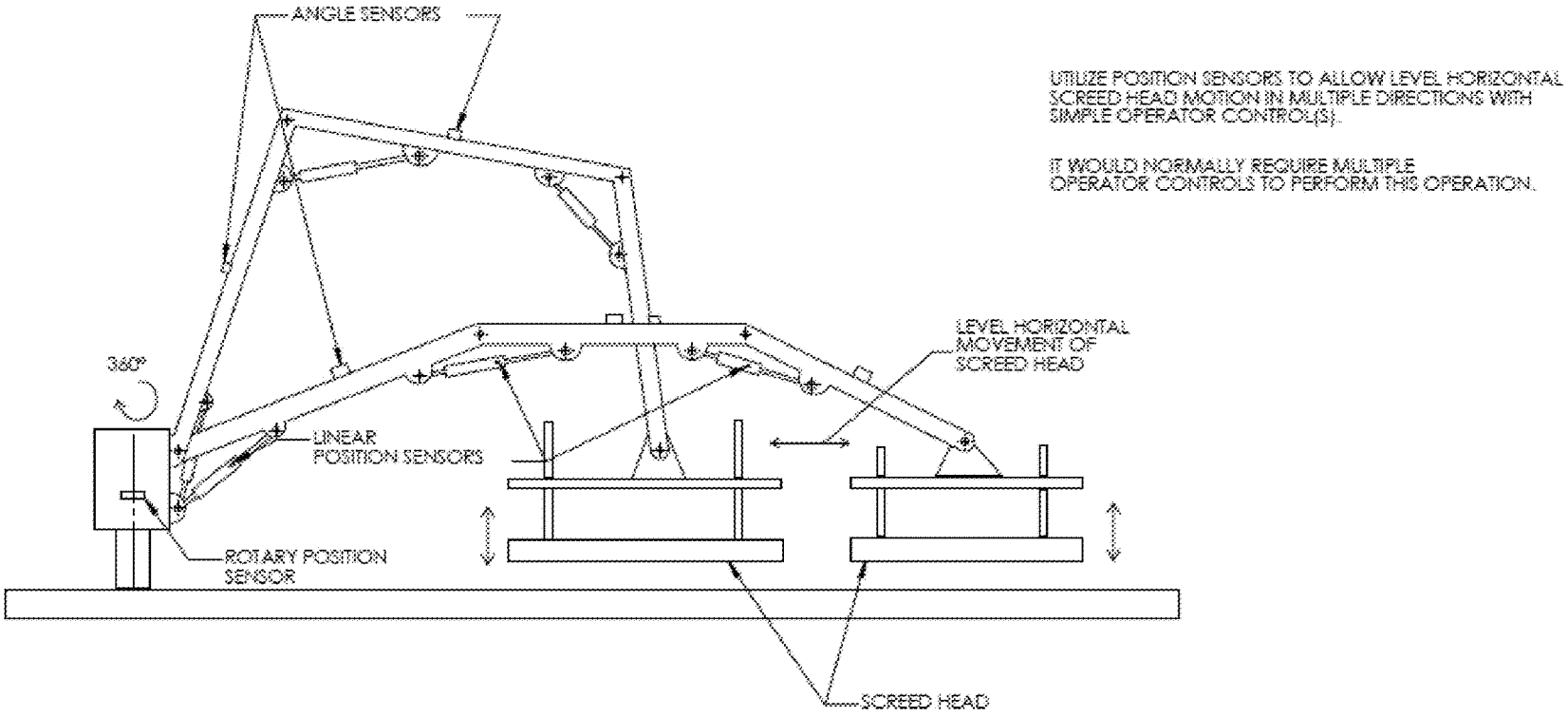
FIG. 13 is a side elevation of a boom and screed head attached at a tower structure, shown with position sensors at each boom section or arm to maintain the screed head level during adjustment of one or more of the boom sections, with the boom shown in an extended state A and a retracted state B.

Optionally, the boom and/or screed head may include sensors to assist in placing the screed head at the support surface at the right location and at the right orientation (e.g., level). For example, and such as shown in FIG. 13, the boom arms or sections and actuators may include position sensors and/or level sensors or the like, whereby the system (knowing the orientation of each boom arm) may determine the orientation of the screed head, and may adjust one or more of the actuators to maintain or adjust the orientation of the screed head as the articulating boom is adjusted to position the screed head at the screeding location. By knowing the rotational angle of the base portion at the column or base structure, and the angle of each of the boom sections relative to the adjacent boom section (which can be determined by the degree of extension of the actuator at each pivot joint) and the level or orientation of each boom section, the position and orientation of the screed head relative to the base structure can be determined.

Figure 14:
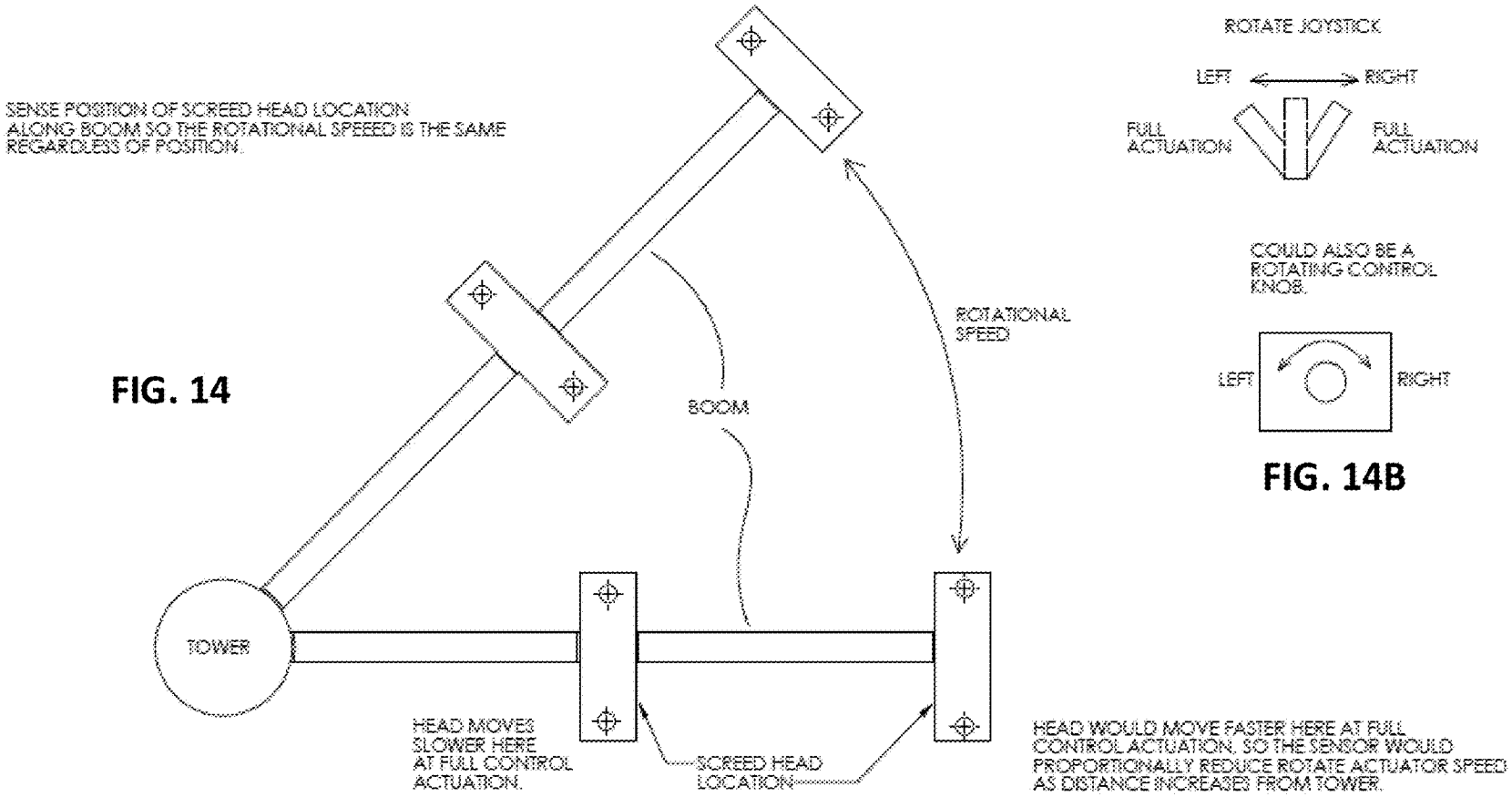
FIG. 14 is a top plan of the boom and screed head, showing use of a positional sensor that determines the position of the screed head from the tower, whereby a rotational speed or swing speed of the boom is adjustable so that the ground speed of the screed head is controlled according to how far from the pivot axis the screed head is located, with the boom may be adjusted via a joystick (FIG. 14A) or a rotating control knob (FIG. 14B)
Figure 16:
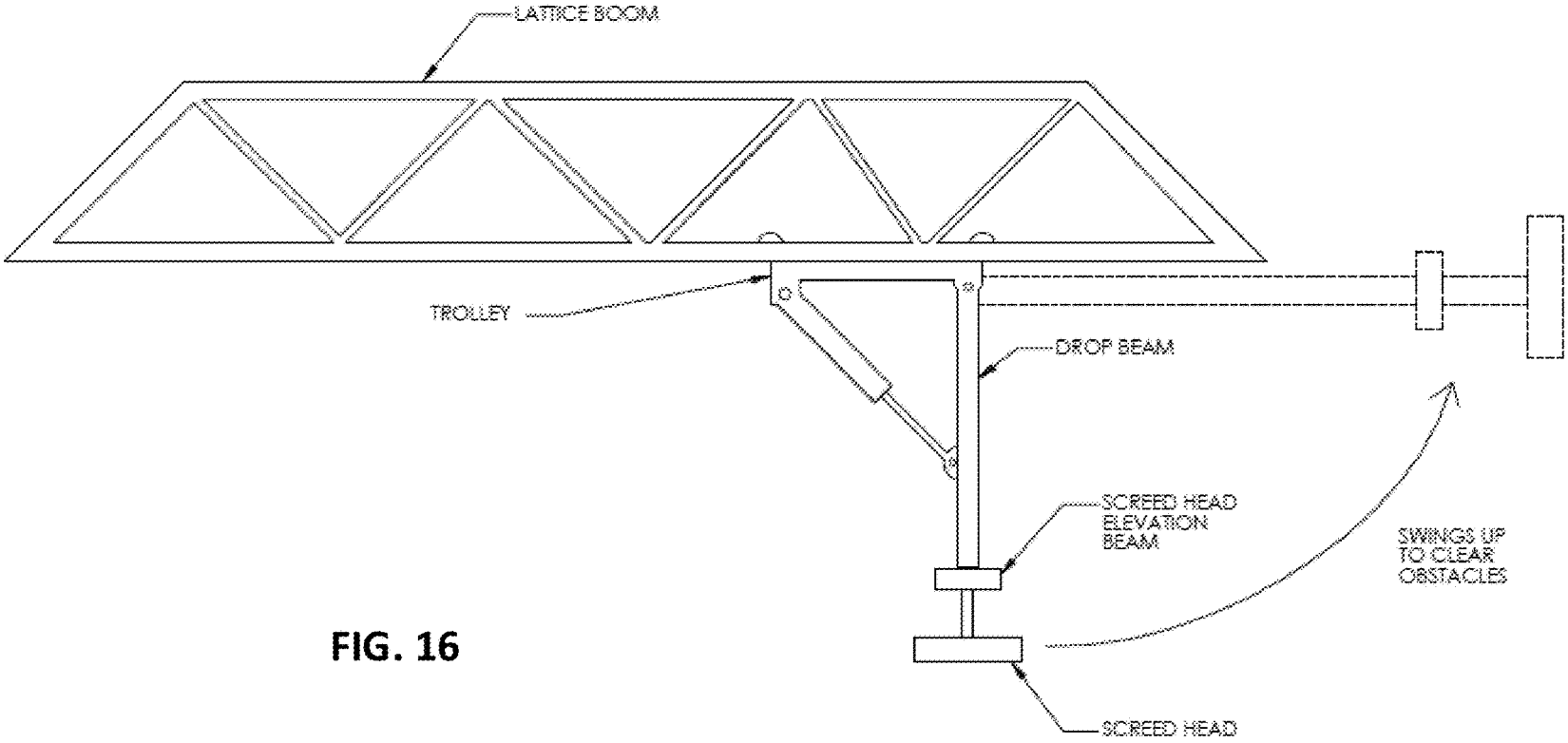
FIG. 16 is a side elevation of the boom and screed head, showing a trolley movable along a lattice boom, with the trolley pivotally supporting the screed head to allow the screed head to pivot or swing upward to clear obstacles as the trolley is moved along the boom or the boom is pivoted about the tower.

The system may also utilize position sensors at the screed head to determine how far the screed head is from the tower (or pivot axis of the boom), whereby, when the boom is pivoted about its center axis, the speed of such pivoting may be adjusted depending on the location of the screed head relative to the pivot axis (see, for example, FIGS. 14, 14A, and 14B). The speed of boom and screed head movements may also be limited responsive to a height or proximity sensor, such as shown in FIG. 15 (and the screed head may be moved or retracted to provide additional clearance when it is determined to be near people or the like, such as shown in FIG. 16).

Although shown and described as being pivotally mounted at a concrete placing tower, aspects of the present invention are suitable for use with a boom and screed head mounted at a truck or trailer or other movable device or apparatus, such as shown in FIGS. 20-27 and 27A. The boom also may comprise various types of booms, such as a lattice boom (comprising one or more sections that may be pivotally joined) with a trolley that moves along the boom to move the screed head (FIGS. 29 and 29A), or such as a telescoping boom, optionally with the screed head mounted to a trolley that is movable along at least one of the multiple telescoping boom sections (FIGS. 30 and 30A), or such as a vertically articulating boom, where the boom sections pivot relative to one another about generally horizontal pivot axes (FIG. 31), or such as a horizontally articulating boom, where the boom sections pivot relative to one another about generally vertical pivot axes (FIG. 32), or any combination of various boom sections to achieve the desired reach and control of the boom and screed head. For example, and such as shown in FIG. 32, the boom may have horizontally articulating sections, with the outer section (at which the screed head support or screed head may attach) being vertically articulating relative to the inward adjacent section, in order to allow the boom to position the screed head at the support surface.

Figure 36:
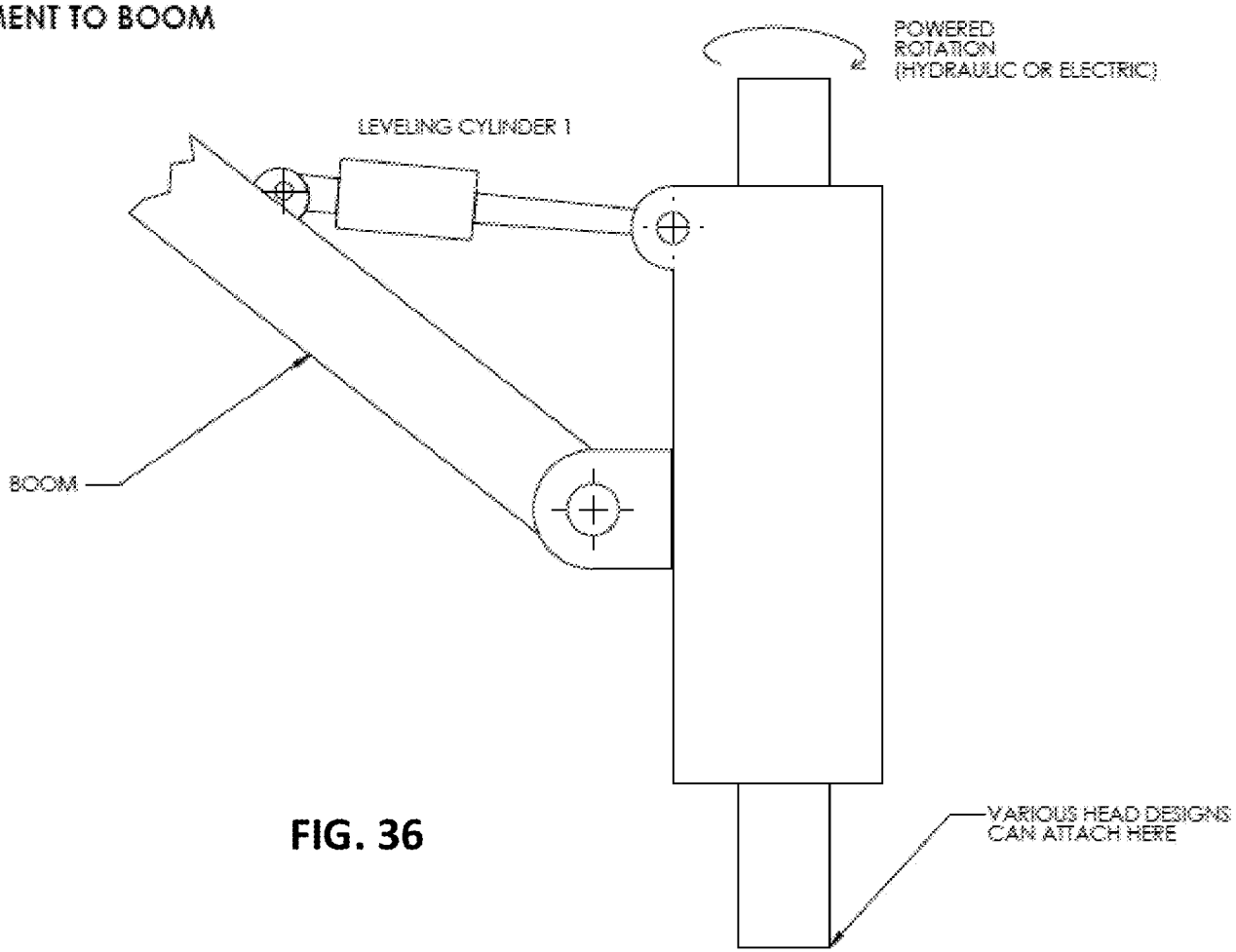
FIG. 36 is a perspective view of a pivoting head mounting mechanism that is operable to rotate the screed head about a generally vertical axis at the outer end of the boom.
Figure 37:
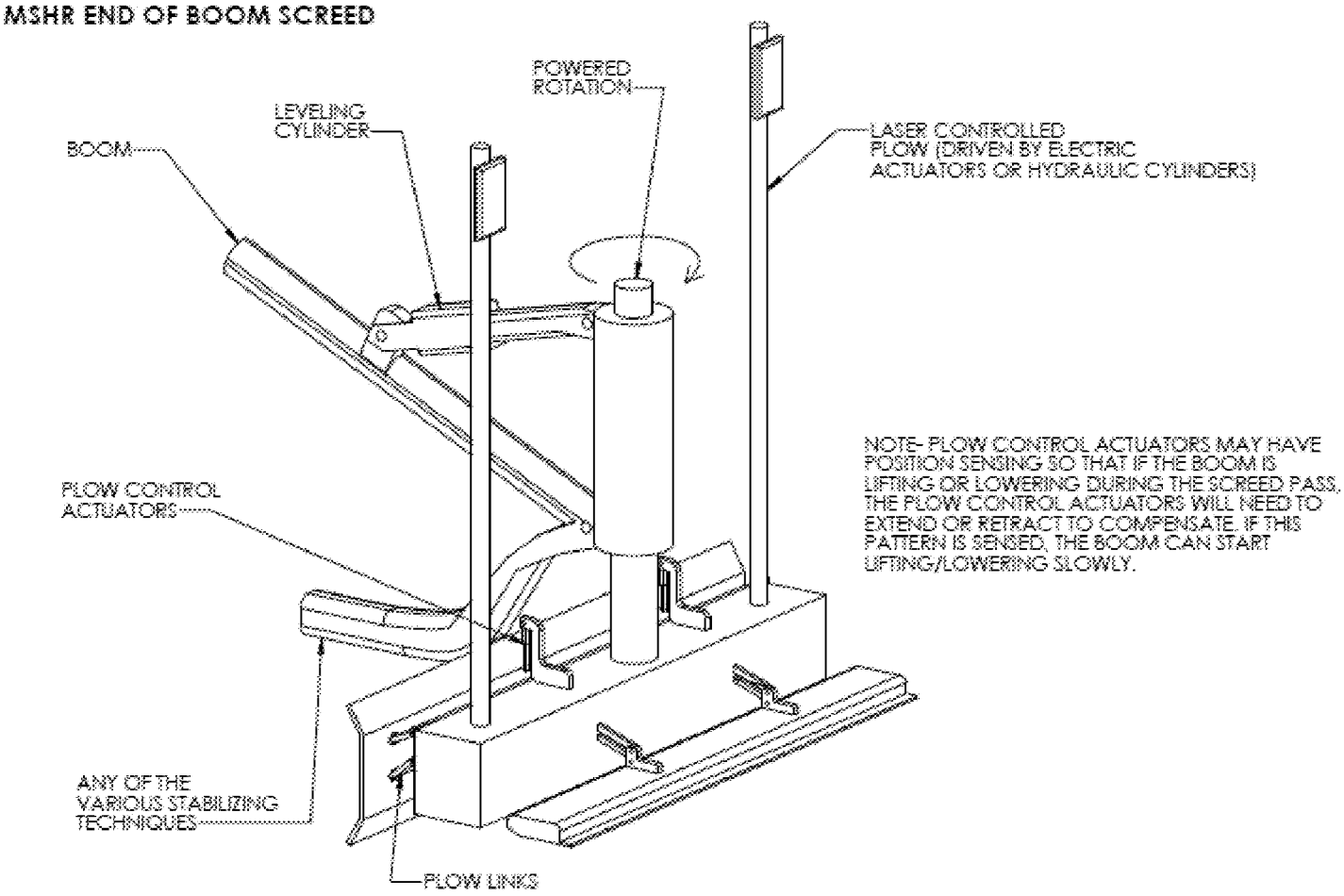
FIG. 37 is a perspective view of a screed head mounted at a pivoting head mounting mechanism at the outer end of the boom, with the screed head having a plow and vibrating element and stabilizer.
Figure 38:
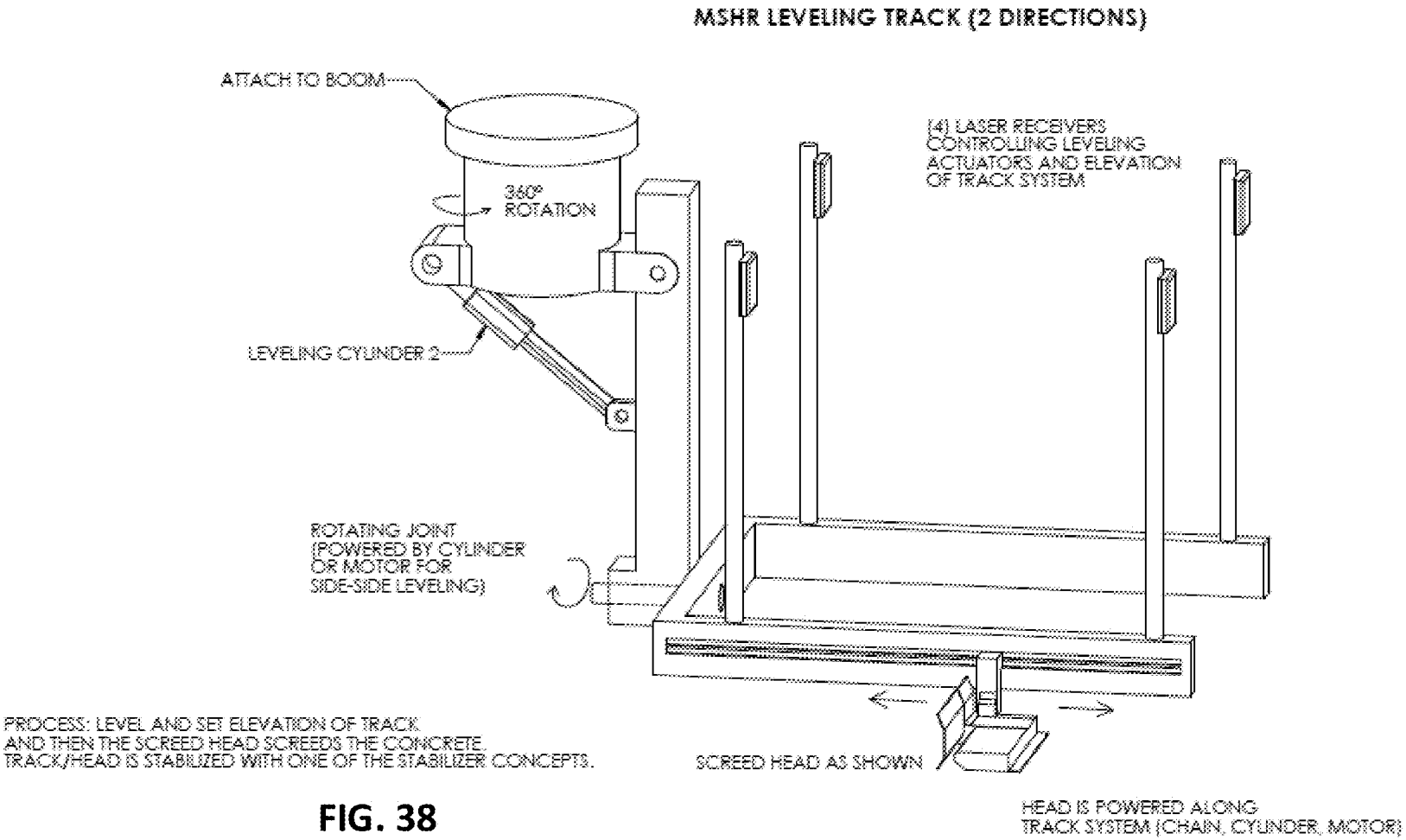
FIG. 38 is a perspective view of a screed head mounted at a pivoting head mounting mechanism at the outer end of the boom, with the screed head having leveling tracks that support the plow and vibrating element, with the tracks being adjustable responsive to four laser receivers.
Figure 39:
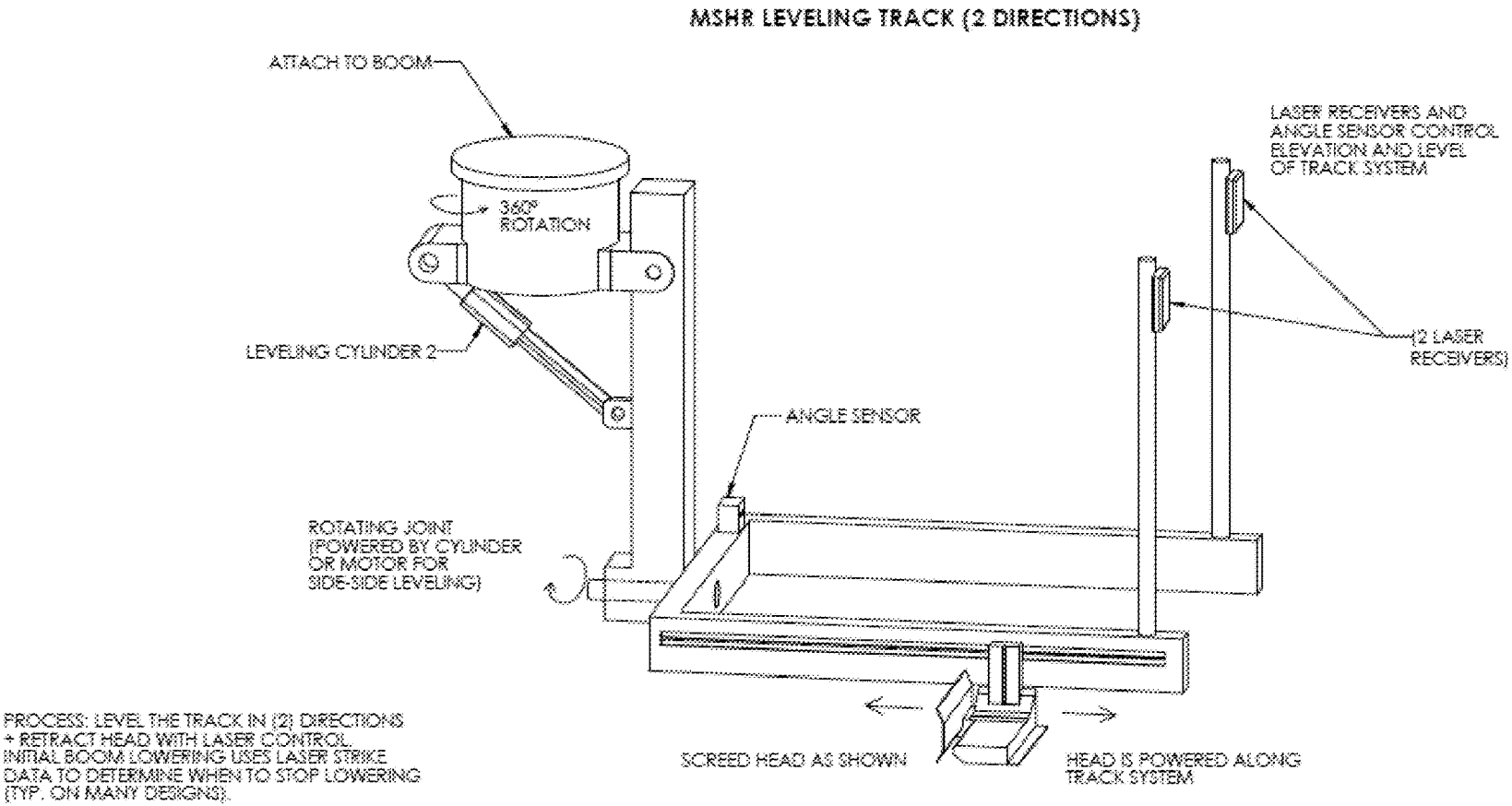
FIG. 39 is a perspective view of a screed head mounted at a pivoting head mounting mechanism at the outer end of the boom, with the screed head having leveling tracks that support the plow and vibrating element, with the tracks being adjustable responsive to two laser receivers and an angle sensor at the tracks.
Figure 40:
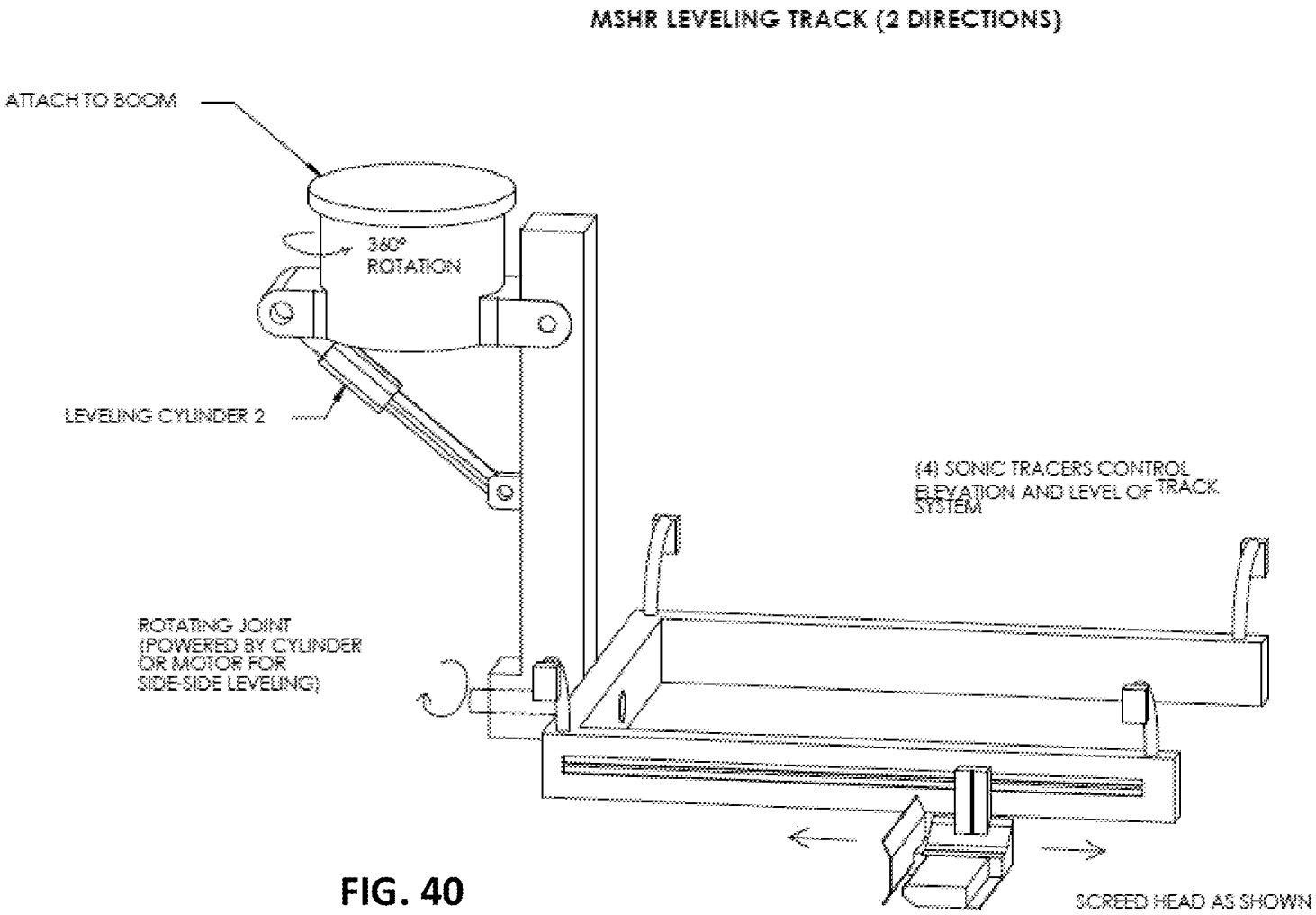
FIG. 40 is a perspective view of a screed head mounted at a pivoting head mounting mechanism at the outer end of the boom, with the screed head having leveling tracks that support the plow and vibrating element, with the tracks being adjustable responsive to four sonic tracers at the tracks.
Figure 41:
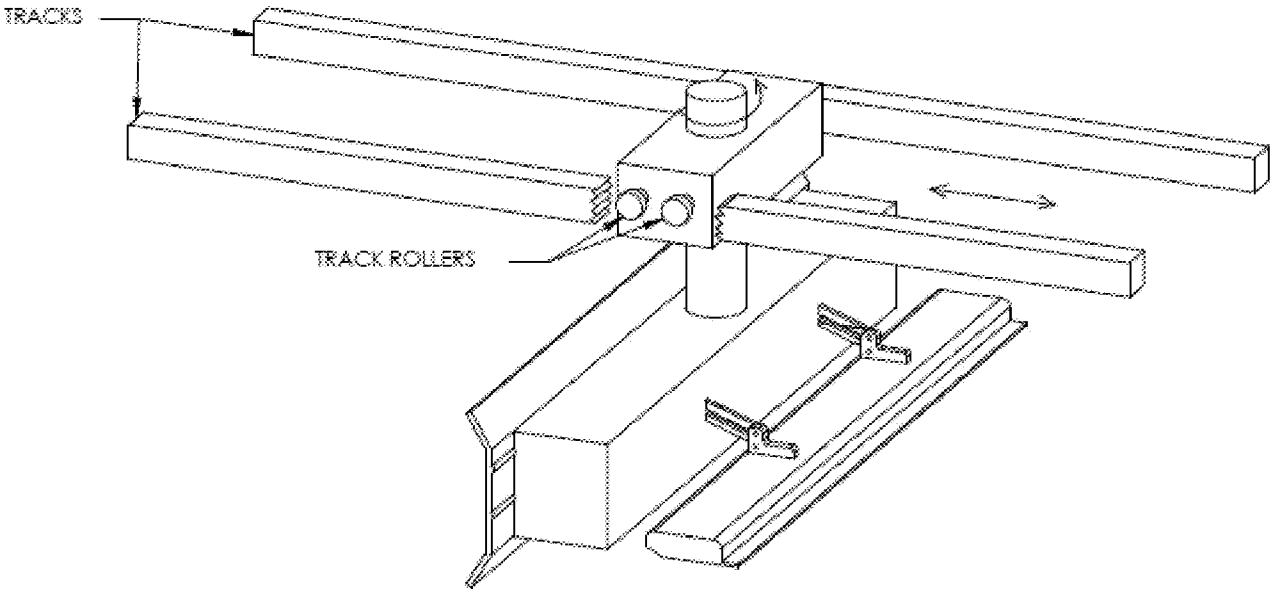
FIG. 41 is a perspective view of the screed head having leveling tracks that support the plow and vibrating element, with the plow and vibrating element movable along the tracks via rollers.

When positioned at a screeding location, the screed head and/or an outer boom section may have a stabilizing element or mechanism that contacts the support surface to assist in holding the screed head steady during the screeding process. Examples of such stabilizing elements or mechanisms are shown in FIGS. 33-35, 35A-35E, and 37. As shown in FIGS. 36 and 37, the screed head may be pivotally mounted at the end of the boom, and may be pivotable or rotatable about a generally vertical pivot axis at the end of the boom, and optionally the screed head may rotate 360 degrees about the pivot axis at the end of the boom, while also being tiltable about a horizontal pivot axis via extension and retraction of the actuator or leveling cylinder.

Figure 42:
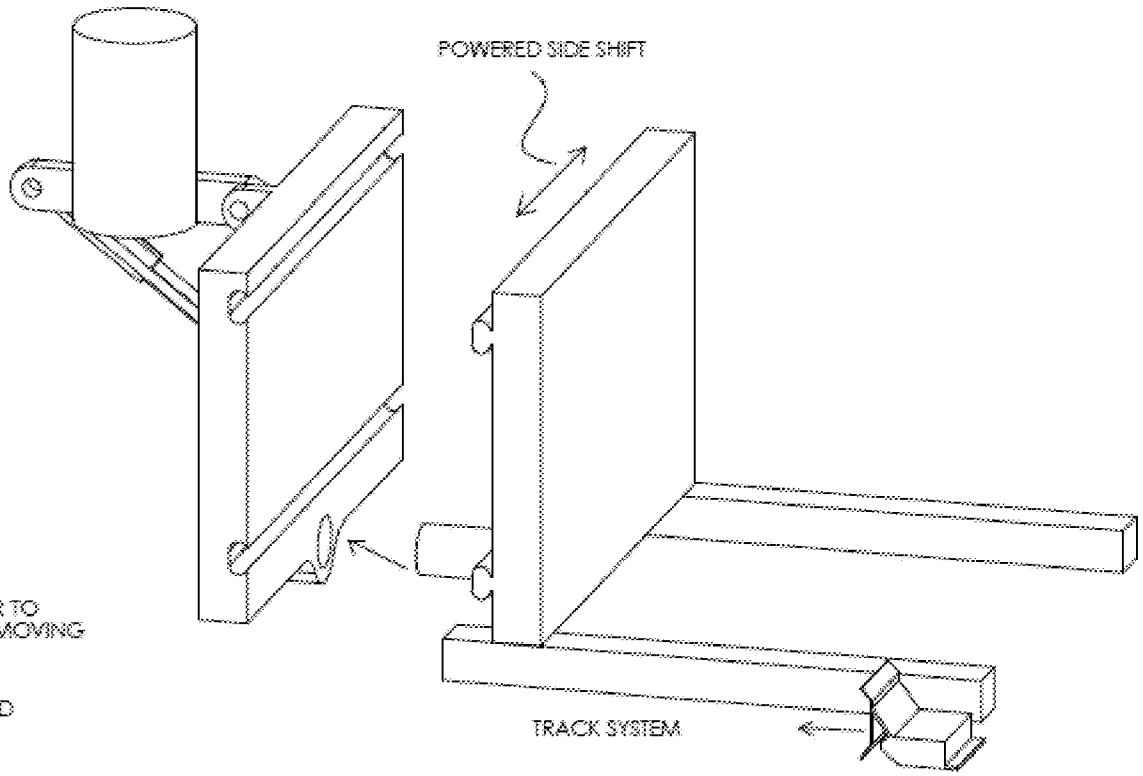
FIG. 42 is a perspective view of the screed head having leveling tracks that support the plow and vibrating element, with the tracks being laterally adjustably mounted at the end of the boom to provide a side shift function to screed two or more side by side passes without moving the boom.
Figures 43, 43A, 43B:
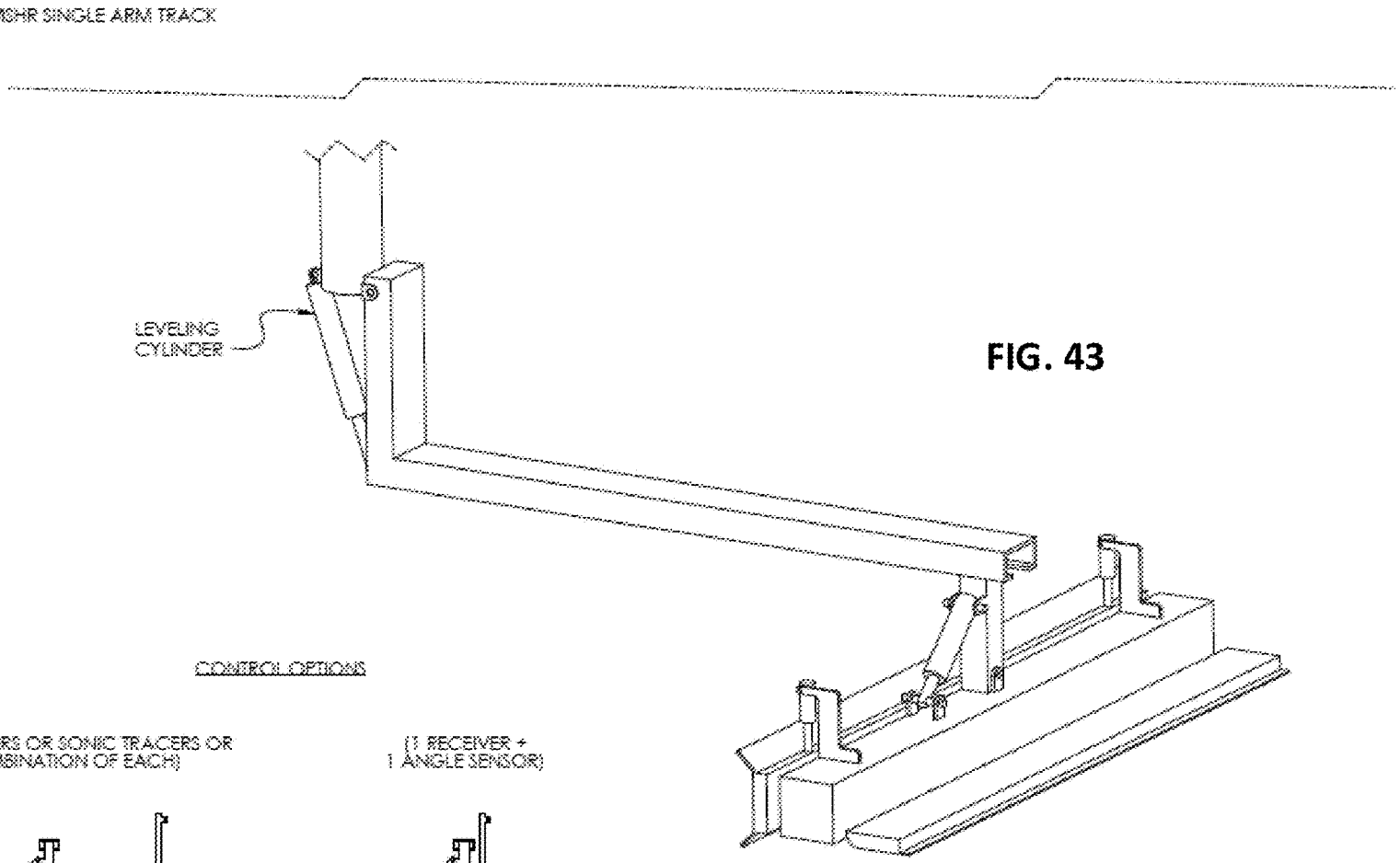
FIG. 43 is a perspective view of a screed head movably disposed at an outer boom section and controlled responsive to two laser receivers or sonic tracers (FIG. 43A) or one laser receiver/sonic sensor and an angle sensor (FIG. 43B)
Figure 44:
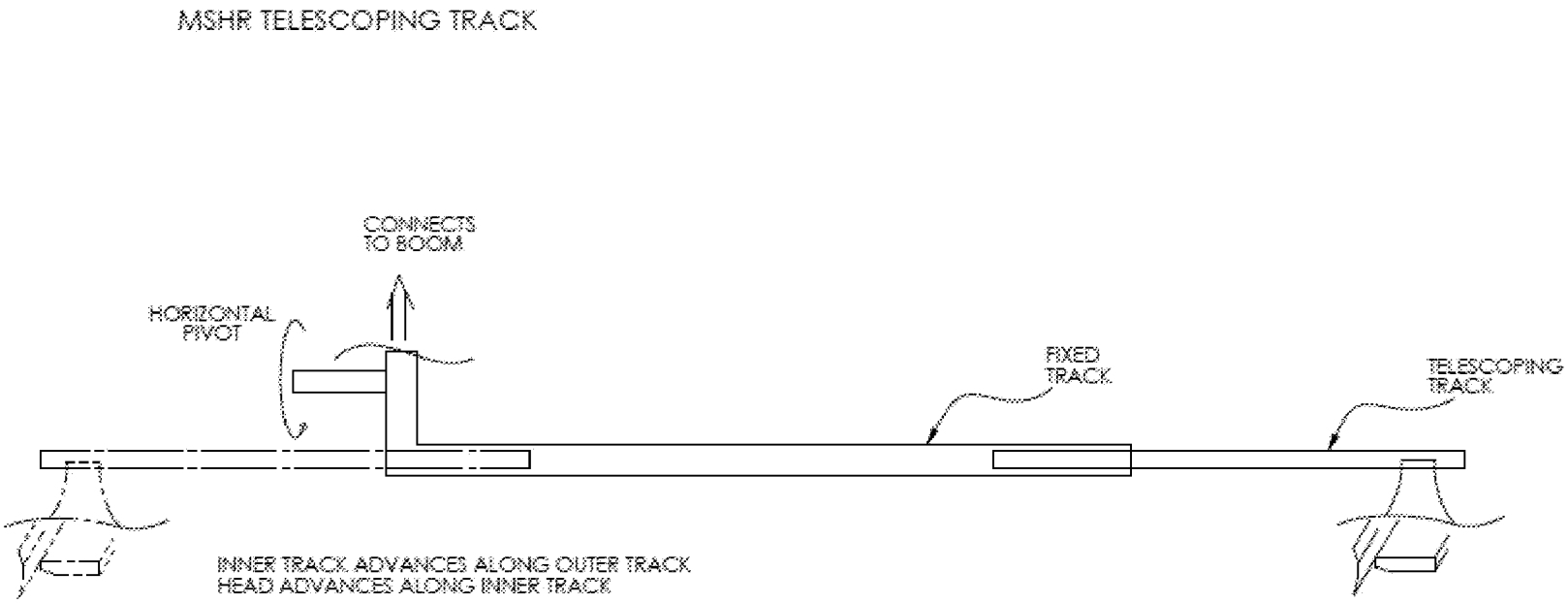
FIG. 44 is a side elevation of a telescoping outer boom section that movably supports the screed head, with the screed head being movable along and relative to an inner track and the inner track being movable along and relative to an outer track of the boom section.

Optionally, the screed head may be movably supported by a frame or track system (FIGS. 38-42), where the track system is maintained at a level or desired orientation responsive to laser receivers and/or sonic tracers and/or angle sensors or the like. The screed head then is supported by and moved along the level tracks to screed the concrete. The tracks may be positioned (by the boom) above the concrete surface and/or may include a stabilizing element or mechanism (such as a ski or wheel or track or the like that may be biased or urged into contact with the support surface) to contact the support surface to further assist in maintaining the orientation of the tracks and of the screed head (see FIGS. 45A-F). Optionally, the track system may be mounted at the end of the boom via a mechanism (see FIG. 42) that allows for sideward movement of the tracks and screed head such that the tracks can be laterally adjusted at the end of the boom to provide a side shift function to screed two or more side by side passes without moving the boom (whereby, upon completion of a first pass, the screed head is moved back out along the tracks while the tracks are moved laterally relative to the boom attachment to position the screed head at the start of a second pass adjacent to the first pass). The track system may include a pair of spaced apart tracks or frame elements, or may comprise a single track (FIGS. 43, 43A, 43B, and 44) with the screed head movably supported along the single track.

Figure 46:
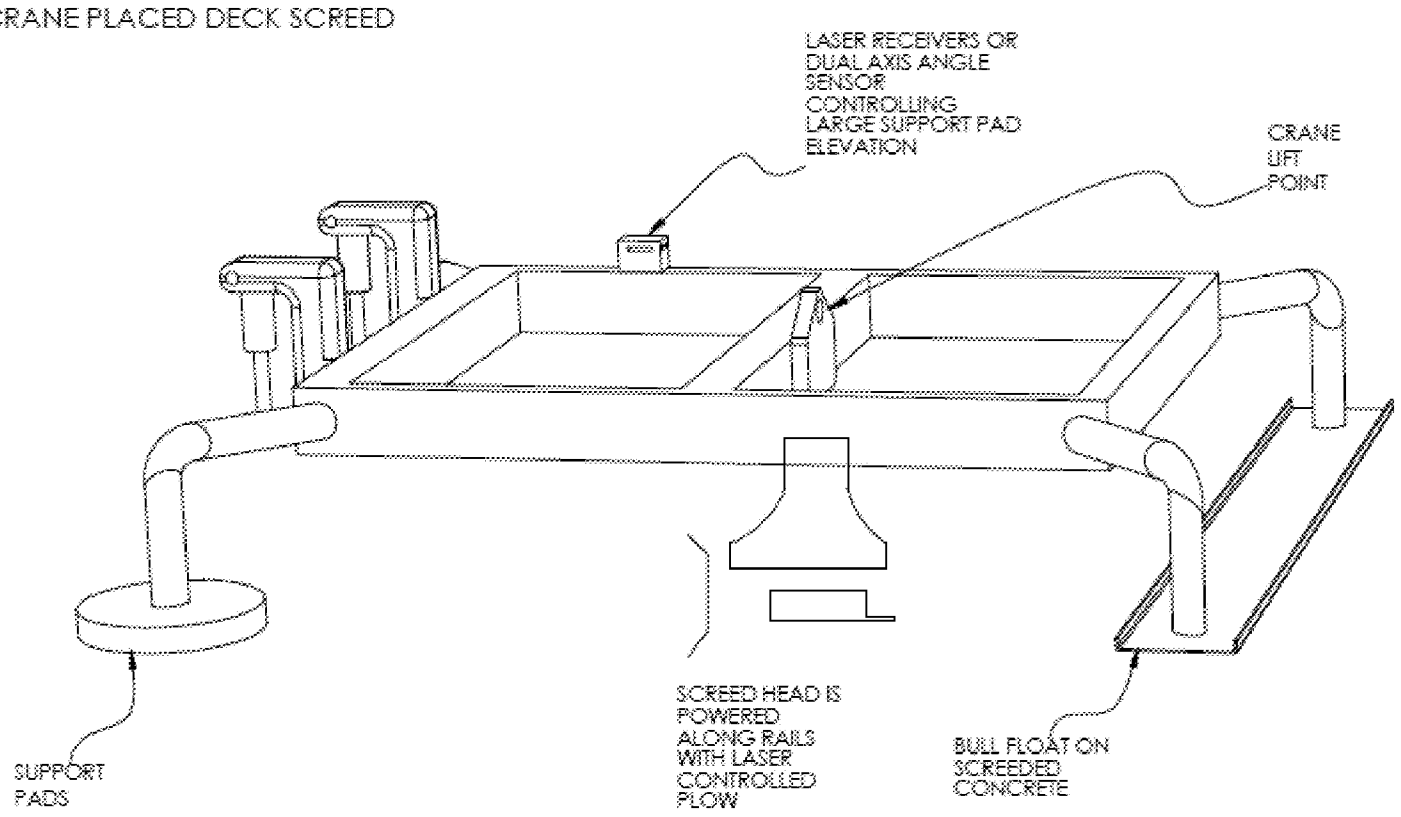
FIG. 46 is a perspective view of a screed head support that is liftable and movable via a boom, with the screed head support being configured to be set at the location for screeding with the screed head movable along rails of the support when set at the desired or appropriate screeding location.
Figure 47:
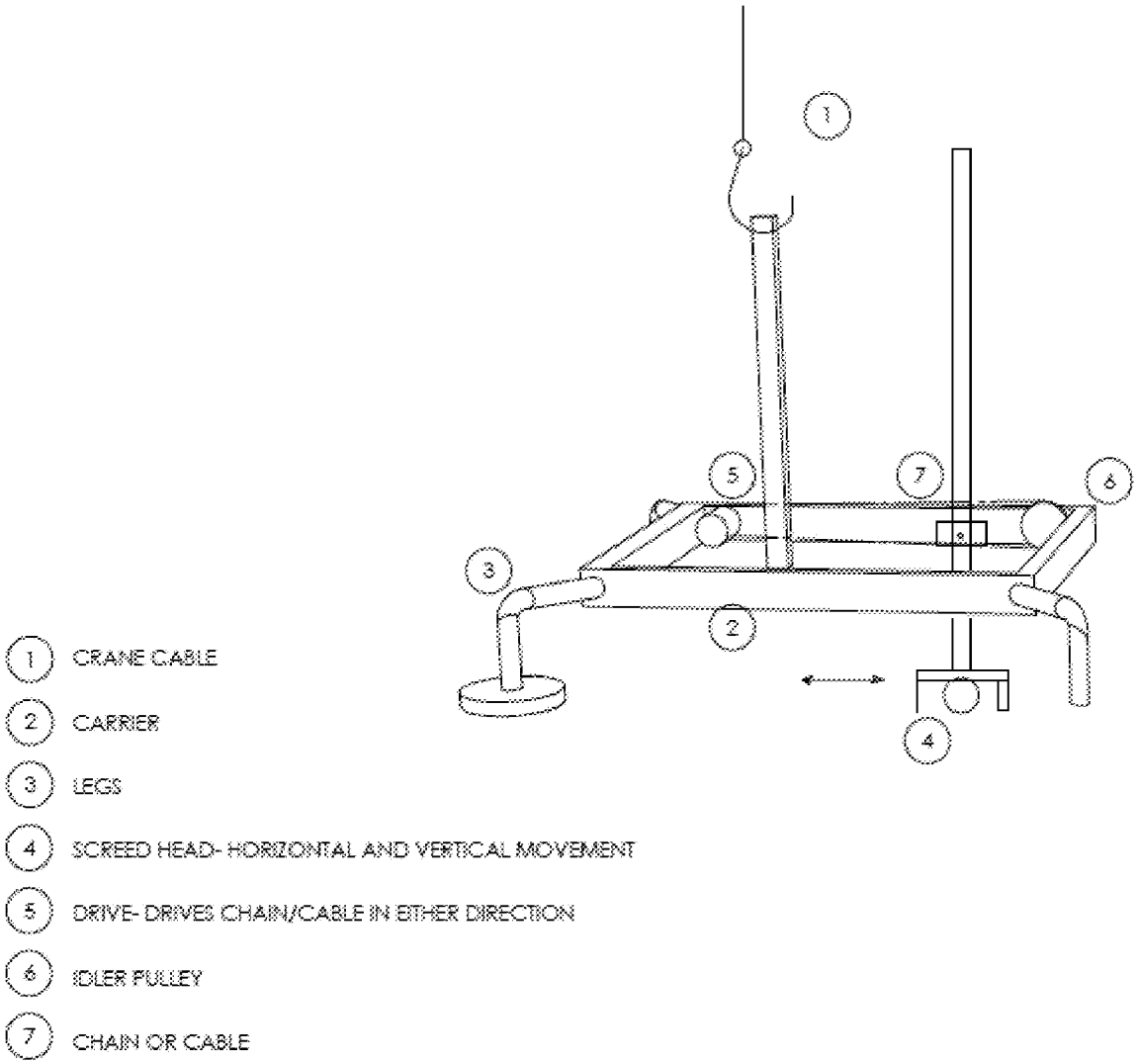
FIG. 47 is a perspective view of a screed head support similar to FIG. 46, showing use of a crane and cable to position the screed head support at the desired or appropriate screeding location.

Optionally, a screed head support structure (that movably supports a screed head thereat) may be liftable by the boom and set or placed at a desired location, where the screed head support structure may include support legs and pads and optionally a bull float or the like that allows at least part of the screed head support structure to be positioned at already screeded concrete (such as shown in FIGS. 46 and 47). After the screed head support structure is positioned at the screeding location, the screed head is moved along the support structure to screed that location.

Figures 48, 48A:
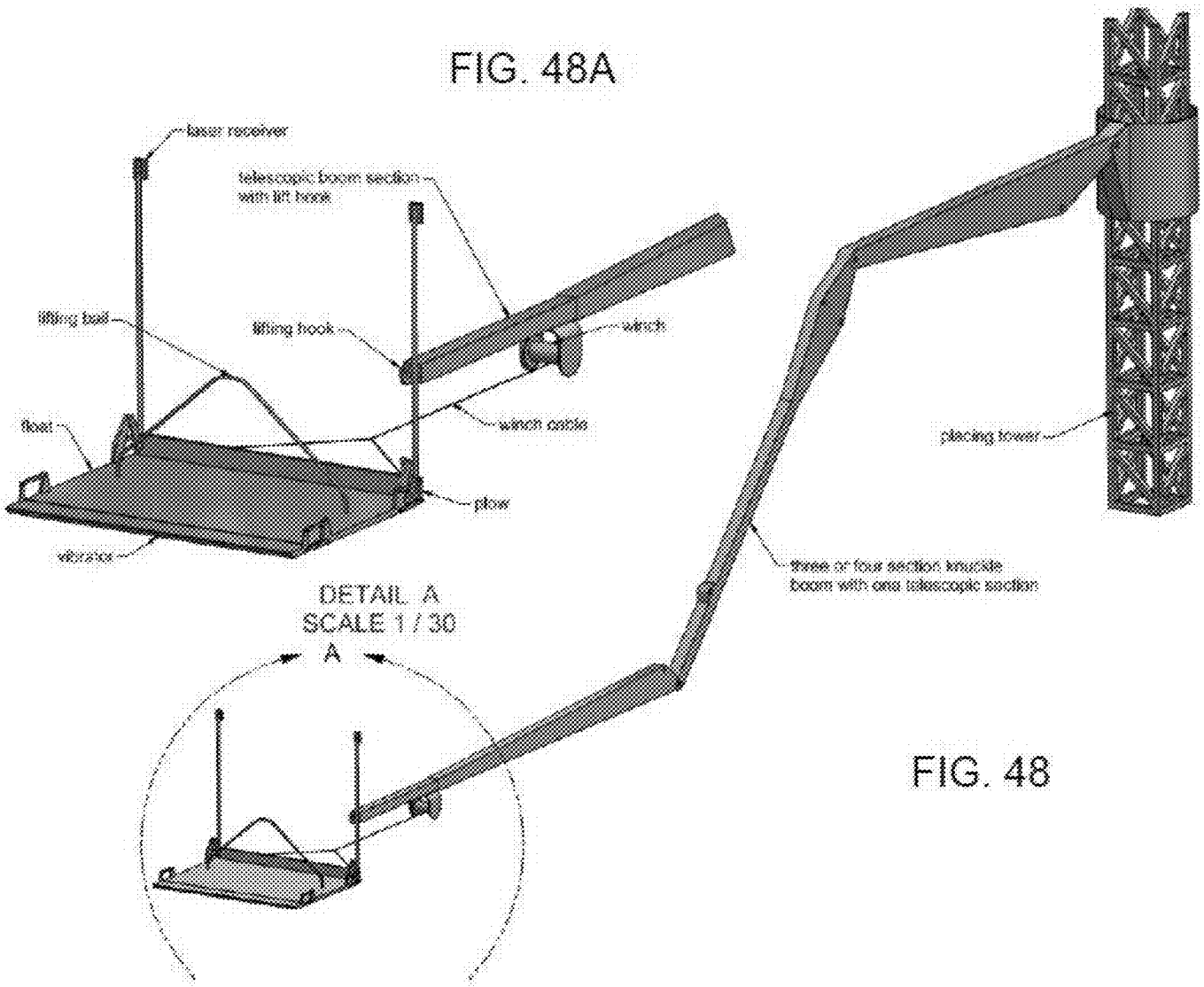
FIGS. 48 and 48A are perspective views of a floating screed head that includes a lifting bail to facilitate lifting and placing of the screed head at a desired or appropriate screeding location by an articulating boom, with the screed head being movable along the concrete surface via a cable and winch attached at the outer boom section of the articulating boom.

Optionally, and such as shown in FIGS. 48 and 48A, a floating screed head includes a vibrating device and plow (adjustable relative to the vibrating device, such as in response to one or more laser receivers) and a float. When placed at a desired screeding area, the screed head is movable along the concrete surface via a cable and winch attached at the outer boom section of the articulating boom, and with the cable connecting to the side regions of the plow or screed head. Thus, when the cable is retracted, the screed head moves along the concrete surface to screed the surface. The screed head includes a lifting bail attached at the float to facilitate lifting and placing of the screed head at a desired or appropriate screeding location by the articulating boom. Such a system allows for movement of a floating screed head along the concrete surface and for ease of moving the screed head from the end of one screed pass to the beginning of another adjacent screed pass.

Figure 49:
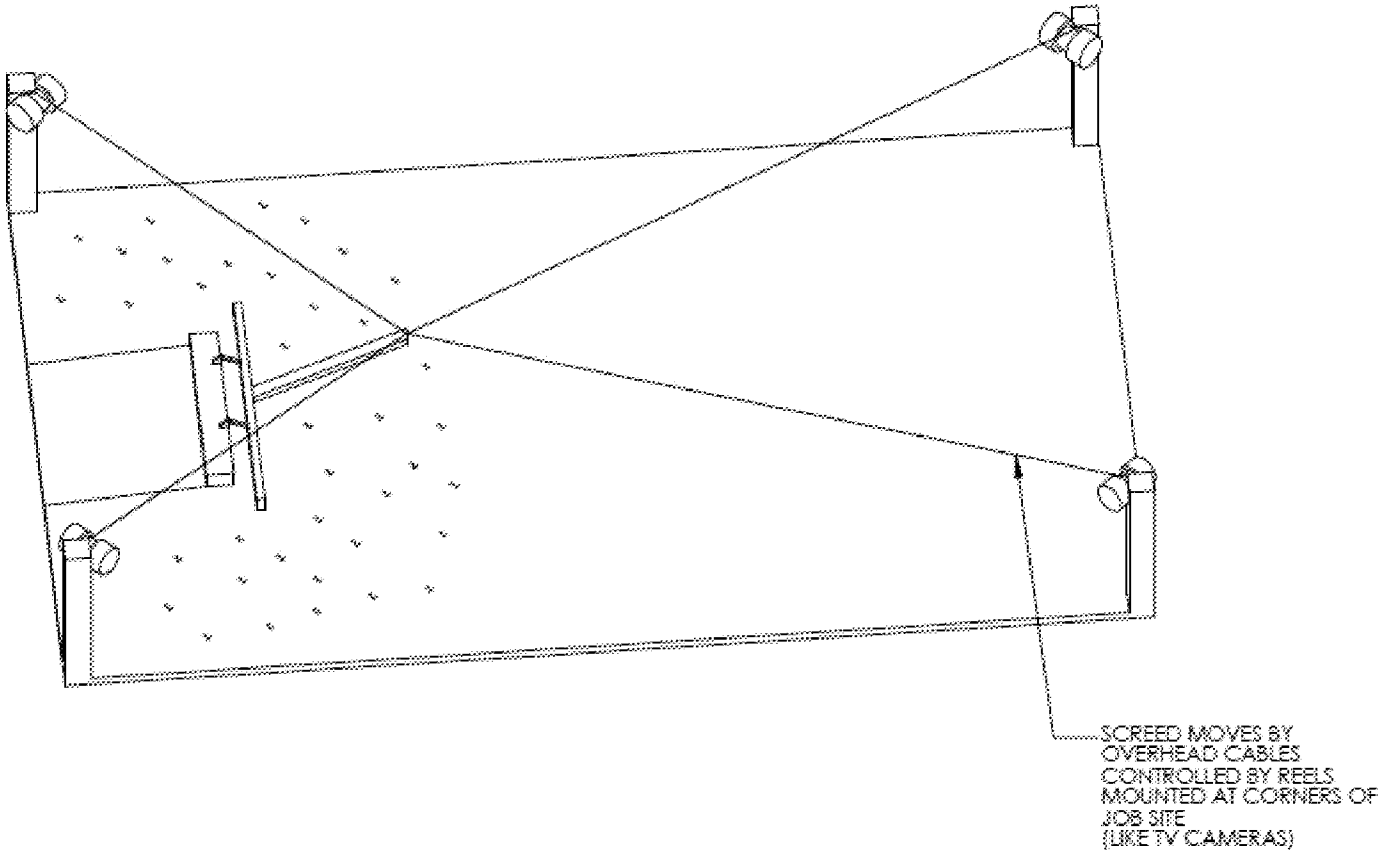
FIG. 49 is a perspective view of a floating screed head that is liftable and lowerable and placeable and movable at a screeding area via a plurality of cables attached at posts at the corners of the screeding area, where the cables are pulled or controlled to impart the desired movement of the screed head to position the screed head at a desired or appropriate screeding location and to move the screed head along the screeding location in one or more screed passes.

Optionally, and with reference to FIG. 49, a floating screed head may be attached to two or more cables that are connected to posts at the corners of the screeding site, whereby the cables are pulled or controlled to impart the desired movement of the screed head to position the screed head at a desired or appropriate screeding location and to move the screed head along the screeding location in one or more screed passes. The control of the cables is similar to what is done with cameras at football games, but at a much slower and more controlled manner to slowly move the screed head over the concrete surface at an appropriate speed without lifting the screed head away from the concrete during the screed pass.

Optionally, other means for moving a floating screed head at the support surface may be implemented while remaining within the spirit and scope of the present invention. For example, a boom may place a floating screed head at a remote location at the job site, whereby the screed head may be self-propelled along the support surface and placed concrete to screed the concrete. For example, The screed head may comprise a drive means, such as wheels or sprockets or the like disposed forward of the plow of the screed head, whereby the drive means are driven to drag the floating screed head along the placed concrete, with the plow establishing the desired grade (responsive to laser receivers at the screed head) and the vibrating device screeding and smoothing the concrete surface. At the end of a screed pass, the boom can lift the screed head and move it back to near where it started so as to be positioned at the start of a subsequent adjacent screed pass.

Figure 50:
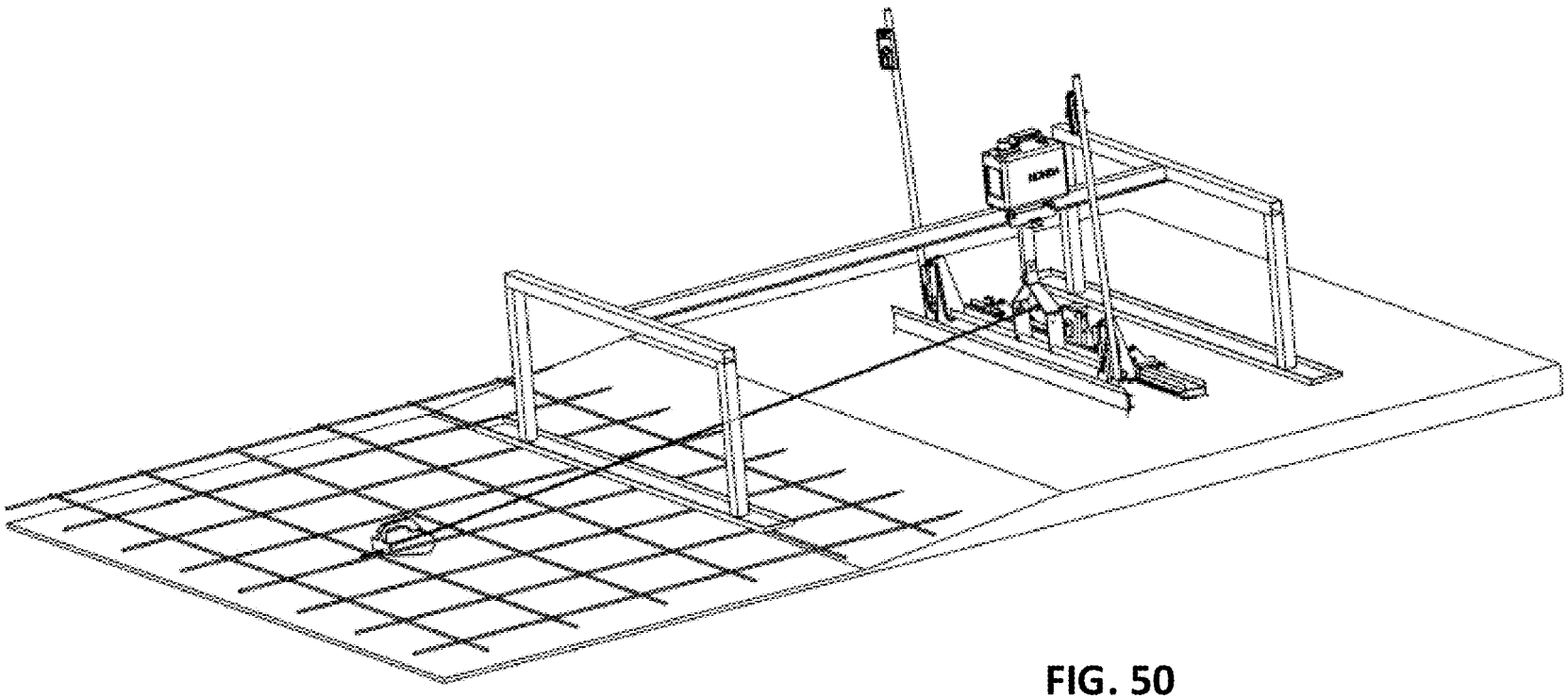
FIG. 50 is a perspective view of a screeding device that is movable along a support beam that may be disposed at or supported at the placed concrete via flat support shoes or members.

Optionally, and such as shown in FIG. 50, a screed head may be mounted at an elongated support beam and movable along the support beam, with the support beam supported above placed concrete via legs or frames at both ends of the beam. The frames and beam may be positioned at a screeding location (such as via a crane or the like) and the screed head may be moved from one end region of the beam to the other end region to make a screed pass. The beam may also be movable laterally relative to the frames to allow for the screed head to make multiple screed passes (where the screed head may be lifted or raised toward the beam and moved from the end of one screed pass to the start of another screed pass). The screed head may be moved along the beam via a drive motor or the like at the beam or via a cable system (as shown in FIG. 50), where a winch is attached at the support surface (such as to the rebar or tensioning cables or the subfloor) and is operable to pull the screed head along the beam via a cable. The screed head may float at the placed concrete surface (and may attach to the beam via an adjustable support element or structure), and a portion of the controls or hydraulic system or the like may be mounted at the beam or at a carriage that moves along the beam to reduce the size of the screed head. The carriage may include wheels that rollingly engage the beam and that may be rotatably driven by a drive motor to drive the carriage and screed head along the beam (such as to move the screed head during a screed pass or to move the screed head back to the start end of the beam for another screed pass).

Figure 51:
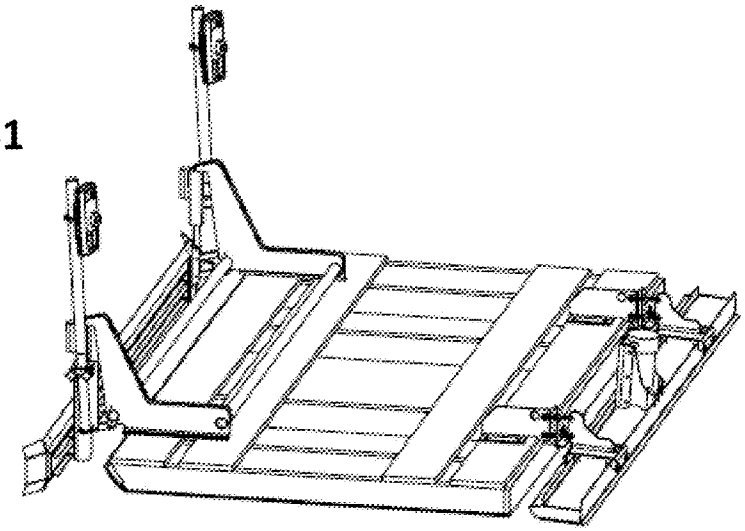
FIG. 51 is a perspective view of a floating screeding device that may be placed at the concrete surface and pulled along the surface via a cable system, shown with a floating support or member between a plow and a vibrating element.
Figure 52:
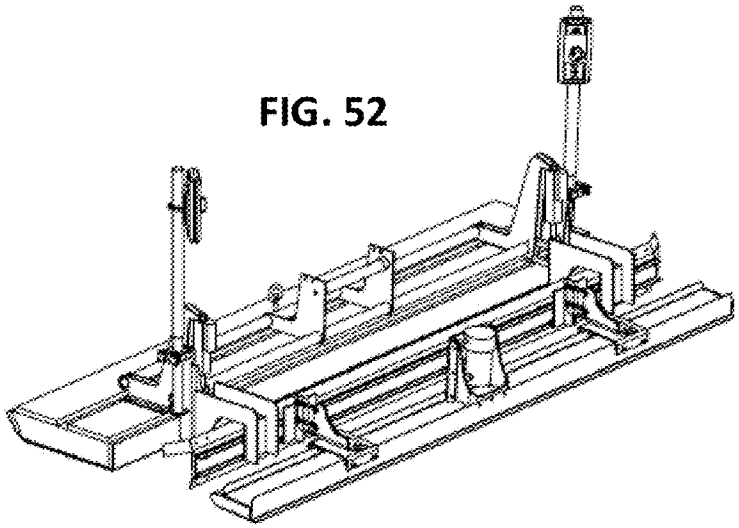
FIG. 52 is a perspective view of another floating screeding device that may be placed at the concrete surface and pulled along the surface via a cable system, shown with a floating support or member in front of a plow and a vibrating element.

The screed head of the screeding system of the present invention may comprise a floating screed head, which may include a floating platform or member with a plow or grade setting element or member adjustably mounted at the floating member and with a vibrating member adjustably mounted at the floating member or the plow. For example, and such as shown in FIG. 51, the floating screed head may comprise a central floating platform, with the plow adjustably mounted (and vertically adjustable responsive to laser receivers) at one end (the front end) of the floating platform, and with the vibrating member adjustably mounted at the opposite end (the rear end) of the floating platform (such as via linkages that allow for the vibrating member move up and down relative to the floating platform so as to generally float on the concrete surface as the floating screed head is moved along the concrete surface). Optionally, for example, and such as shown in FIG. 52, the floating screed head may comprise a front floating platform, with the plow adjustably mounted (and vertically adjustable responsive to laser receivers) at one end (the rear end) of the floating platform, and with the vibrating member adjustably mounted at the plow (such as at the rear of the plow) opposite the floating platform (such as via linkages that allow for the vibrating member move up and down relative to the plow so as to generally float on the concrete surface as the floating screed head is moved along the concrete surface).

Figure 54:
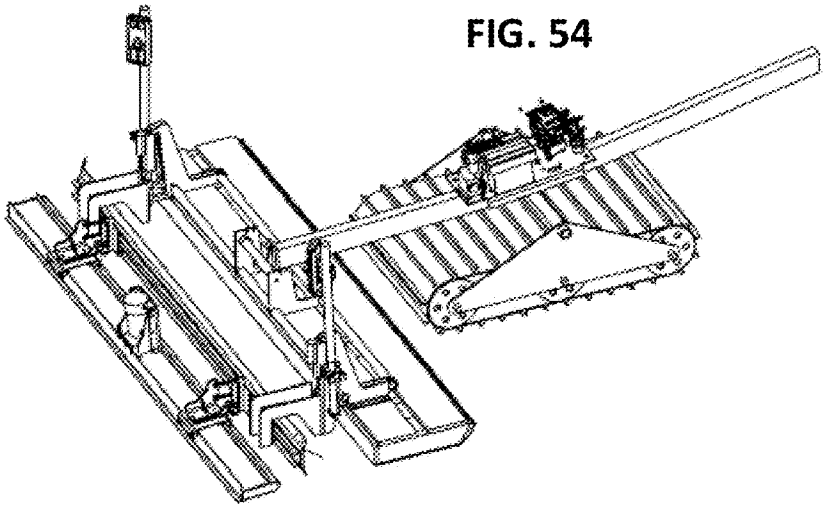
FIG. 54 is an enlarged perspective view of the floating screed head and screed moving machine of FIG. 53.
Figure 53:
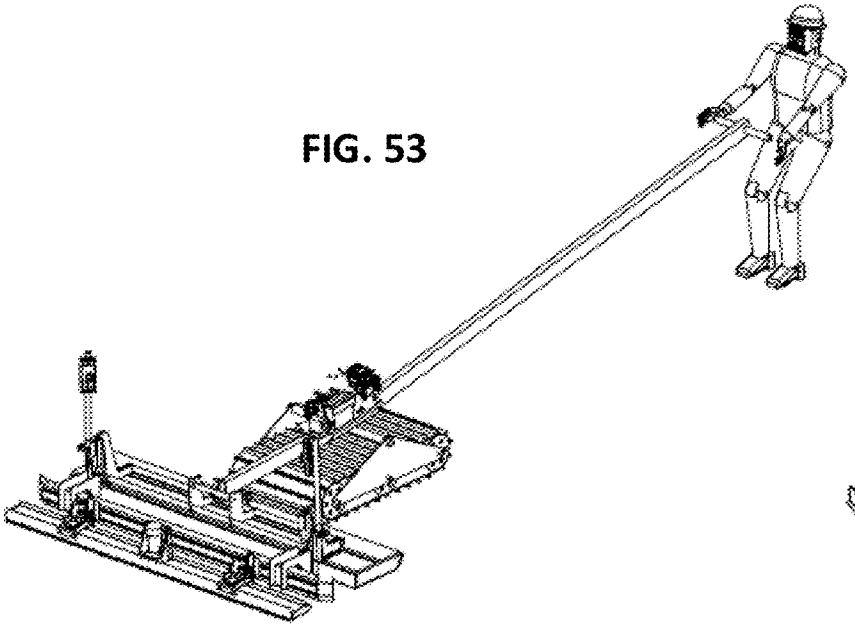
FIG. 53 is a perspective view of a floating screed head or device that is movable to a start position via a screed moving machine, which may comprise a low pressure track unit that is controlled via a remote control or via an operator using an elongated control handle.
Figure 55:
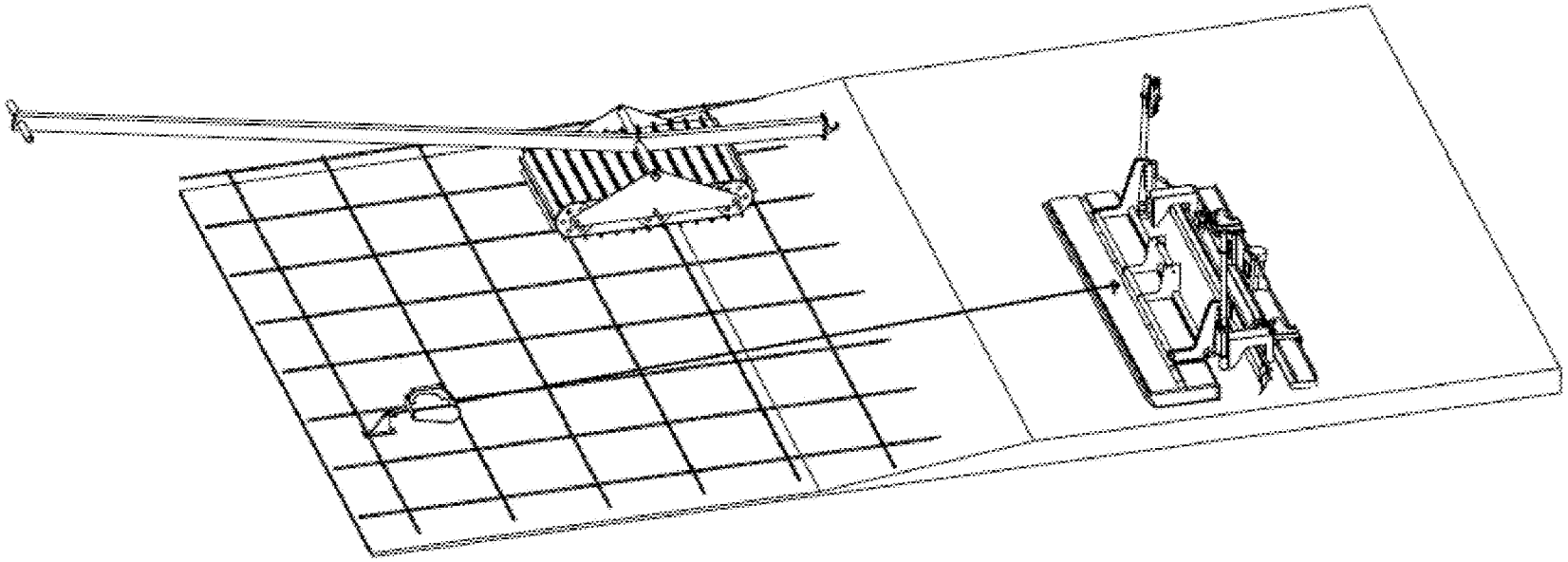
FIG. 55 is a perspective view of the floating screeding device of FIG. 52, shown being pulled along a placed concrete surface via a cable system.
Figure 56:
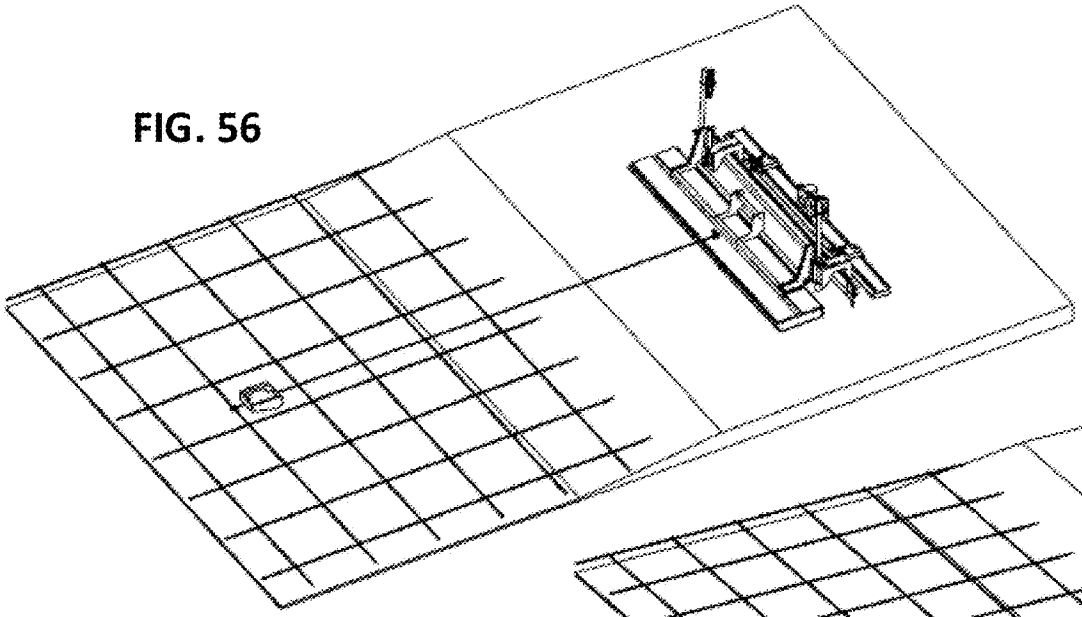
FIGS. 56 and 57 are more perspective views of the floating screeding device and cable system of FIG. 55.
Figure 57:
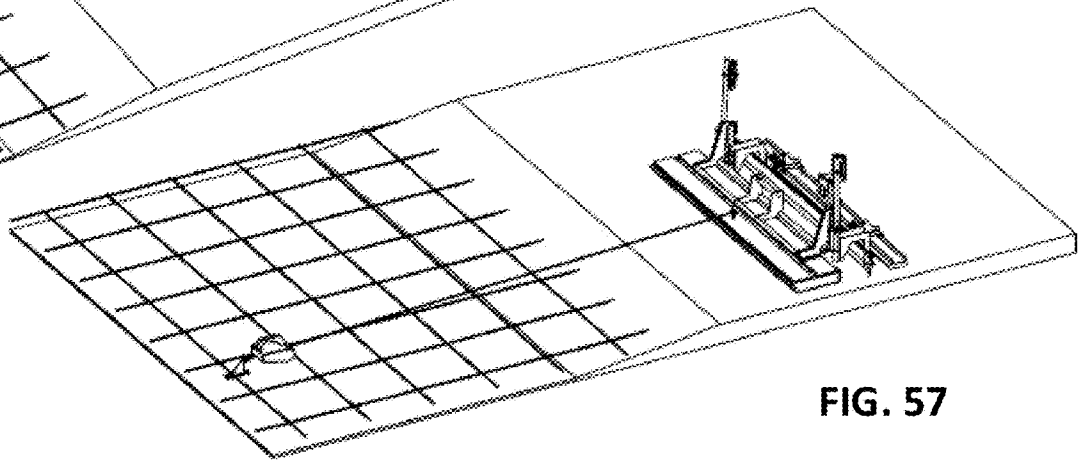
Figure 59:
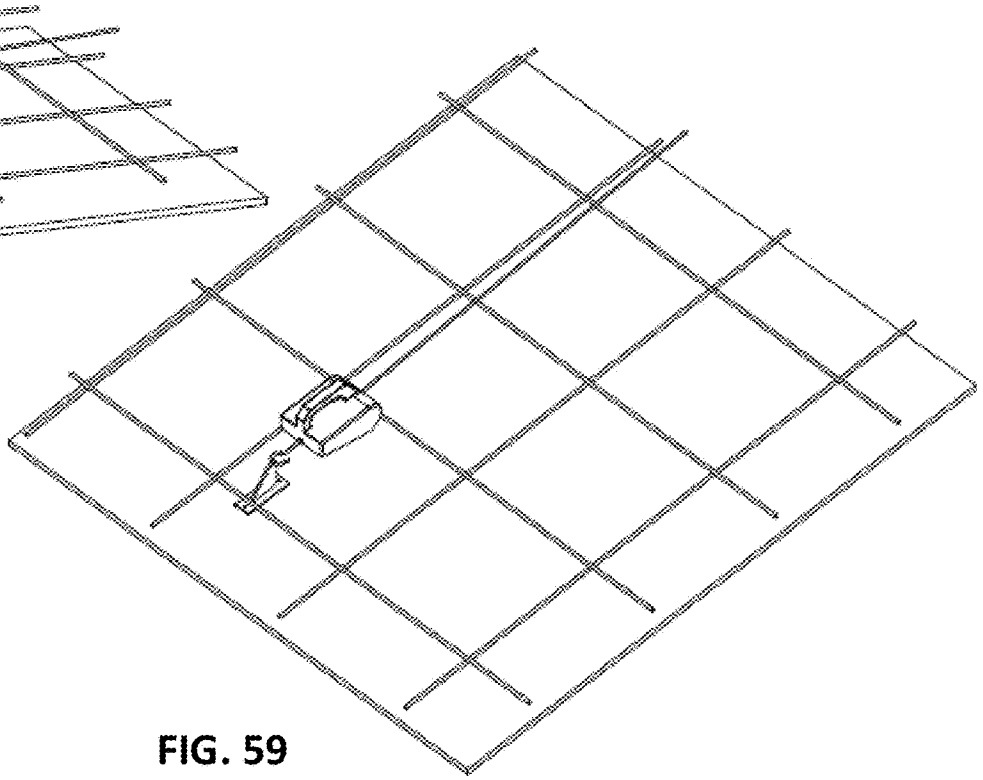
FIGS. 58 and 59 are perspective views of a cable device or winch that attaches an end of the cable to a bracket or anchor at the floor where the concrete is placed, with the other end of the cable attached to a beam screed or floating head or attached to a track machine for propel assist, and with the bracket fastened to the floor and the winch attached or hooked at the bracket.
Figure 58:
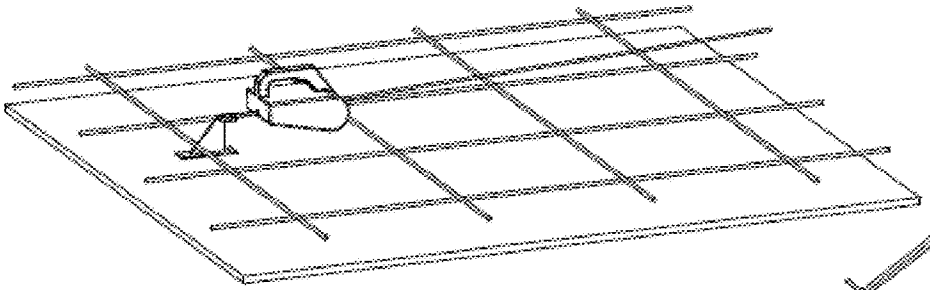

Optionally, the floating screed head may be moved and positioned at a screeding location via a low ground pressure track unit (FIGS. 53-55). The track unit comprises a wide track (or two or more wide tracks) that roll and move over the concrete surface and that have a wide or large footprint so as to limit sinking into the placed and uncured concrete. In the illustrated embodiment, the track is driven via a motor on the unit, and the motor may be controlled via an operator holding an elongated control arm to maneuver the track unit (and the screed head) over the uncured concrete to a starting location for a screed pass. The screed head may be supported at the track unit via an elongated support arm that extends from the unit and that may hook a bracket of the screed head. The track member may be controlled to move the support arm or to adjust an element of the support arm (such as to move or pivot the arm downward to release a hook of the arm from a bracket of the screed head) to release the screed head from the track unit and to place the screed head at a target location (see FIG. 55). The screed head may be attached to a cable system (FIGS. 55-59), whereby a winch of the cable system may be attached at the support surface or floor (or other structure) and may operate to pull the cable and to move the floating screed head over the concrete for a screeding pass.

Figure 60:
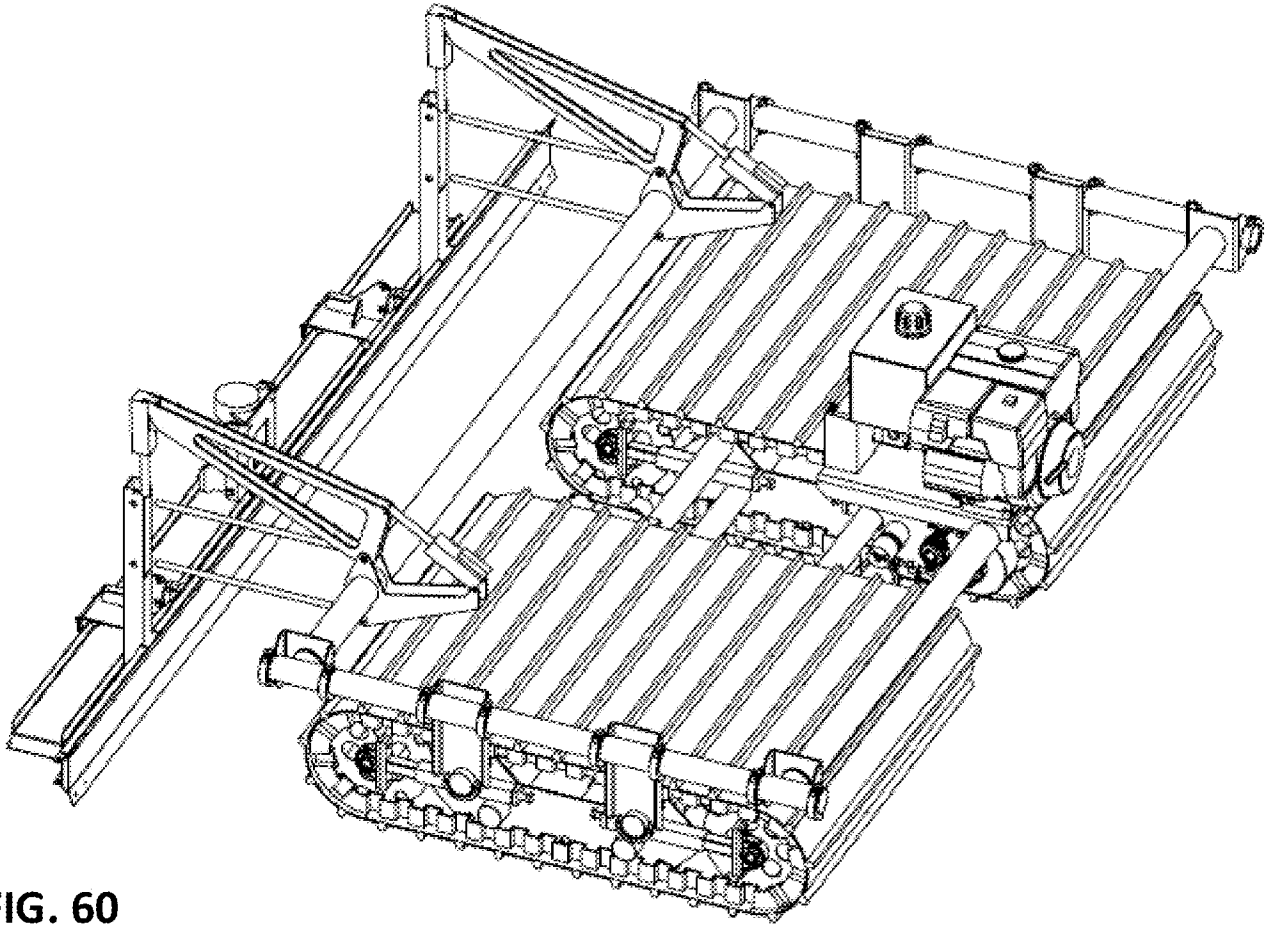
FIG. 60 is a perspective view of a low ground pressure track vehicle that operates on top of a placed concrete surface, with a screed head adjustably supported relative to the vehicle or unit, and with the track vehicle operable via a remote controlled device.

Optionally, a floating screed head may be adjustably supported at a low ground pressure movable unit that is remotely controlled to move the screed head to a screed pass location and to move the floating screed head along the concrete surface during a screeding pass. For example, and such as shown in FIG. 60, a low ground pressure movable unit may comprise two wide track units that are driven via one or more motors to move over and along the placed uncured concrete with limited sinking into the concrete. The tracks of the track unit provide reduced ground pressure (such as less than about one psi, such as, for example, less than 0.25 psi) as compared to an operator's footprint (e.g., such as around 3 psi) and a riding screed device (e.g., such as around 0.75 psi to 1 psi) and the like. The tracks include bumps or ridges thereacross to increase traction of the tracks and the track unit as it is driven and maneuvered over and along the uncured concrete surface.

The track unit includes a frame that has a pair of arms that extend therefrom and that support the screed head. The arms are pivotable relative to the frame to allow for lifting of the arms and the screed head to raise the screed head above the concrete during transporting of the screed head to a screed pass location. The screed head may also be mounted to the frame of the track unit via a pair of parallel linkages at each side region of the screed head, which allows for generally vertical movement of the screed head and floating of the screed head at the concrete surface during a screed pass.

The screed head thus may generally float when the arms are pivoted downward so as to not lift the screed head (but also the arms do not push downward on the screed head). For example, the arms may be connected to the screed head via a cable or via a piston and cylinder or receiver construction. Thus, the arms may be pivoted downward to remove tension in the cable that connects the arms to the screed head frame or to remove a pulling or lifting force from a rod that is received in a cylinder or receiver of the arms. In such an application, when the arms are lowered, the end of rod may be received further into the receiver, and when the arms are raised, the end of the rod moves toward the lower end of the receiver until it engages an end of the receiver and is lifted (along with the screed head). Thus, during a screeding pass, the screed head is free to float on the concrete surface as the track unit pulls the screed head over the concrete surface. At the end of a screeding pass, the arms may be raised to lift the screed head and the track unit may be controlled and maneuvered to a start position for a second or subsequent screeding pass over the concrete surface.

Figure 61:
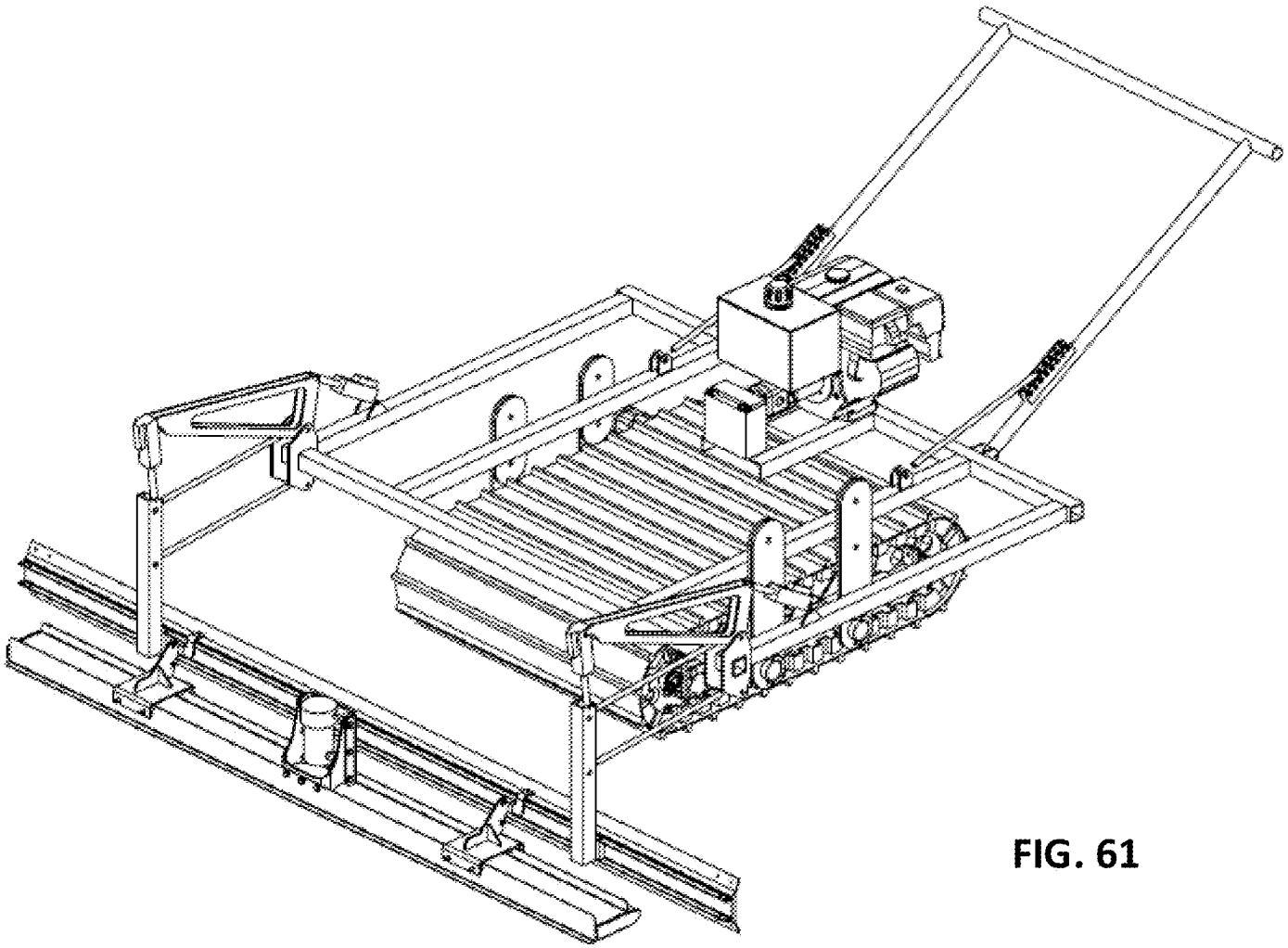
FIG. 61 is a perspective view of another low ground pressure track vehicle and screed head assembly in accordance with the present invention.

Optionally, and such as shown in FIG. 61, a track unit may comprise a single wide track that is controllable via an operator holding a control arm or handle of the track unit. The floating screed head may be adjustably mounted at a frame of the track unit (such as in a similar manner as discussed above) to allow for raising of the screed head to a raised or transporting position and lowering of the screed head to a lowered or screeding position, whereby the screed head generally or substantially floats on the concrete surface as the track unit pulls the screed head over and along the concrete surface.

Figure 62:
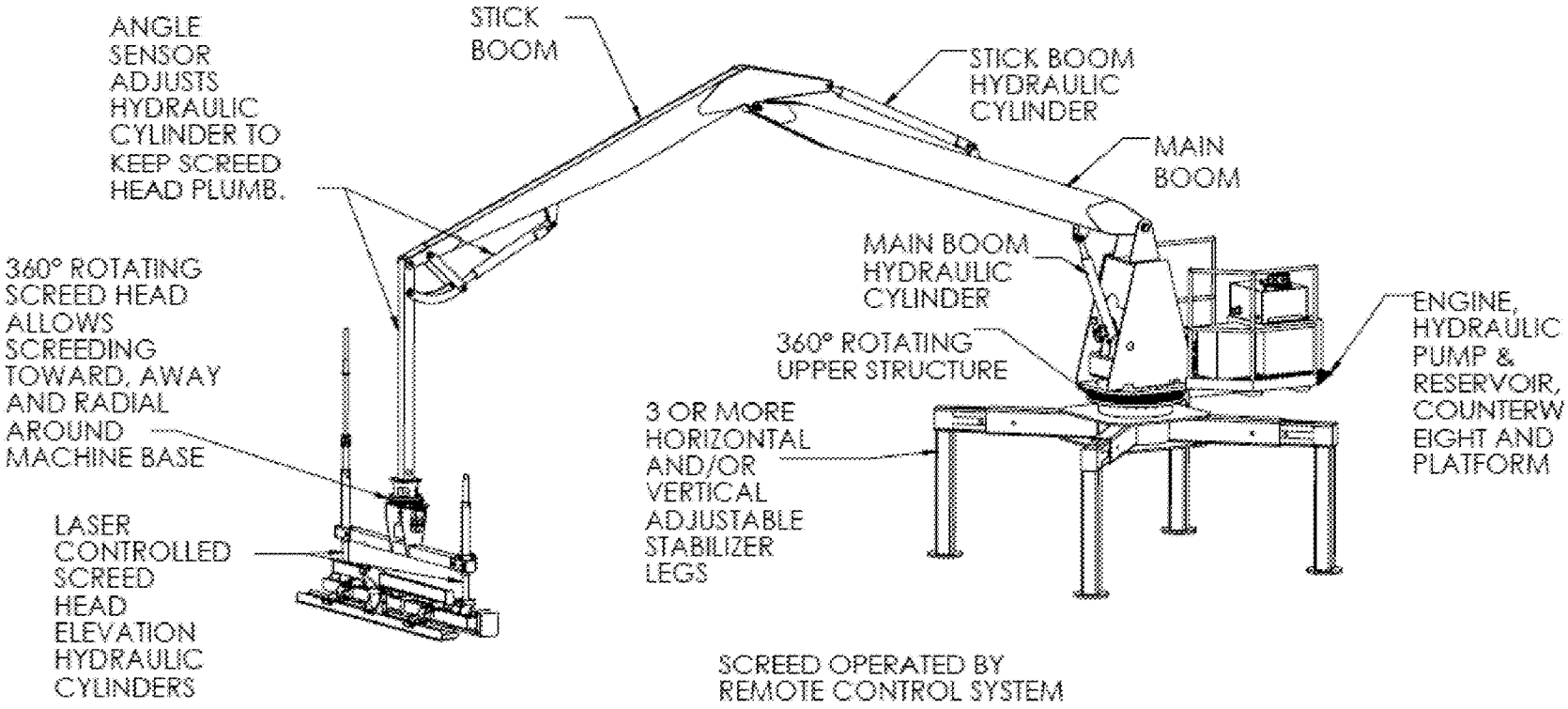
FIG. 62 is a perspective view of another screeding machine in accordance with the present invention.
Figure 63:
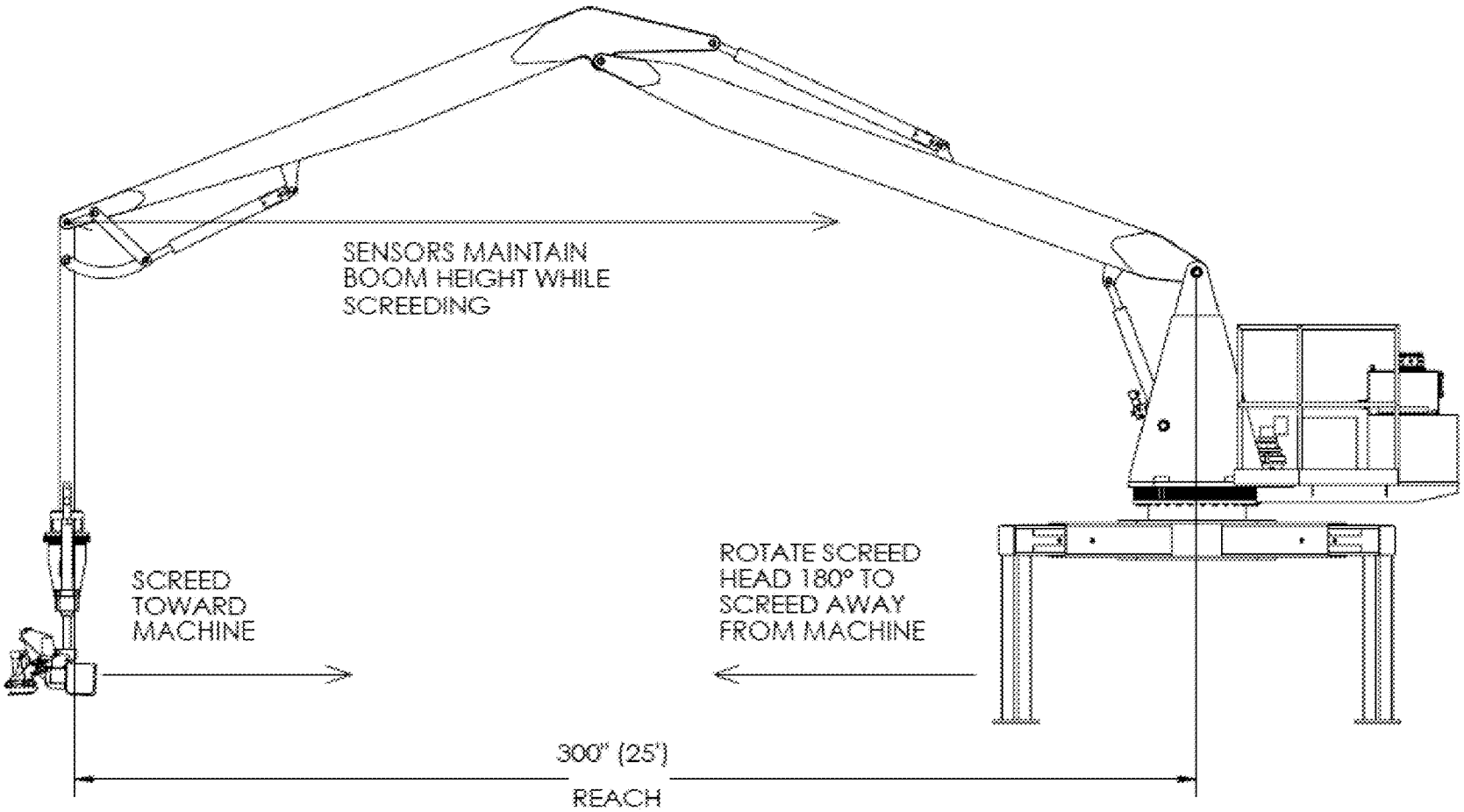
FIG. 63 is a side view of the screeding machine of FIG. 62.
Figure 64:
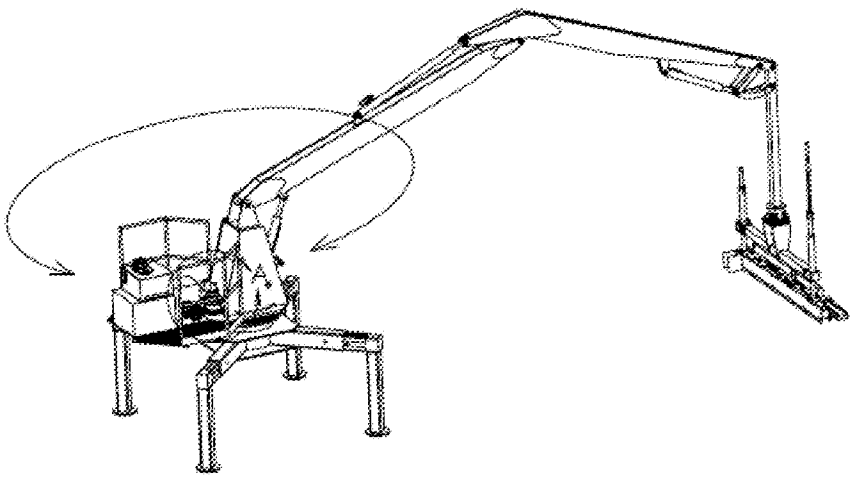
FIG. 64 is another perspective view of the screeding machine of FIG. 62.
Figure 64A:
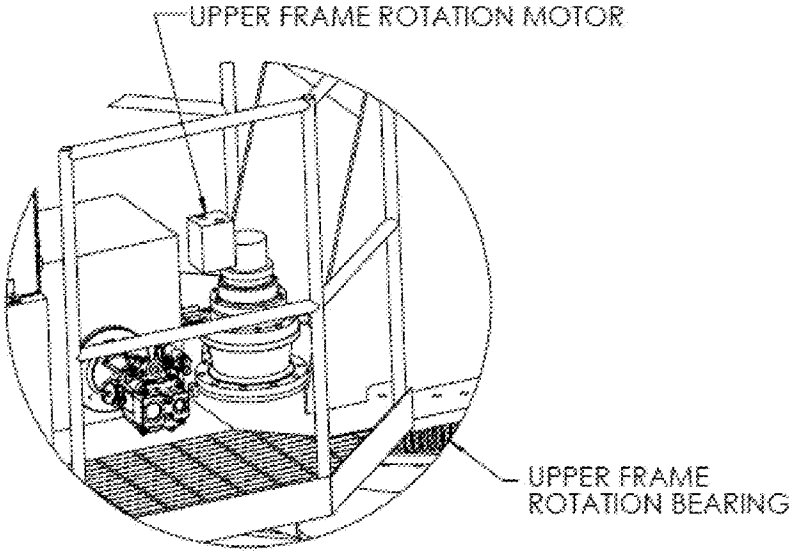
FIG. 64A is an enlarged perspective view of the region A in FIG. 64.
Figure 65:
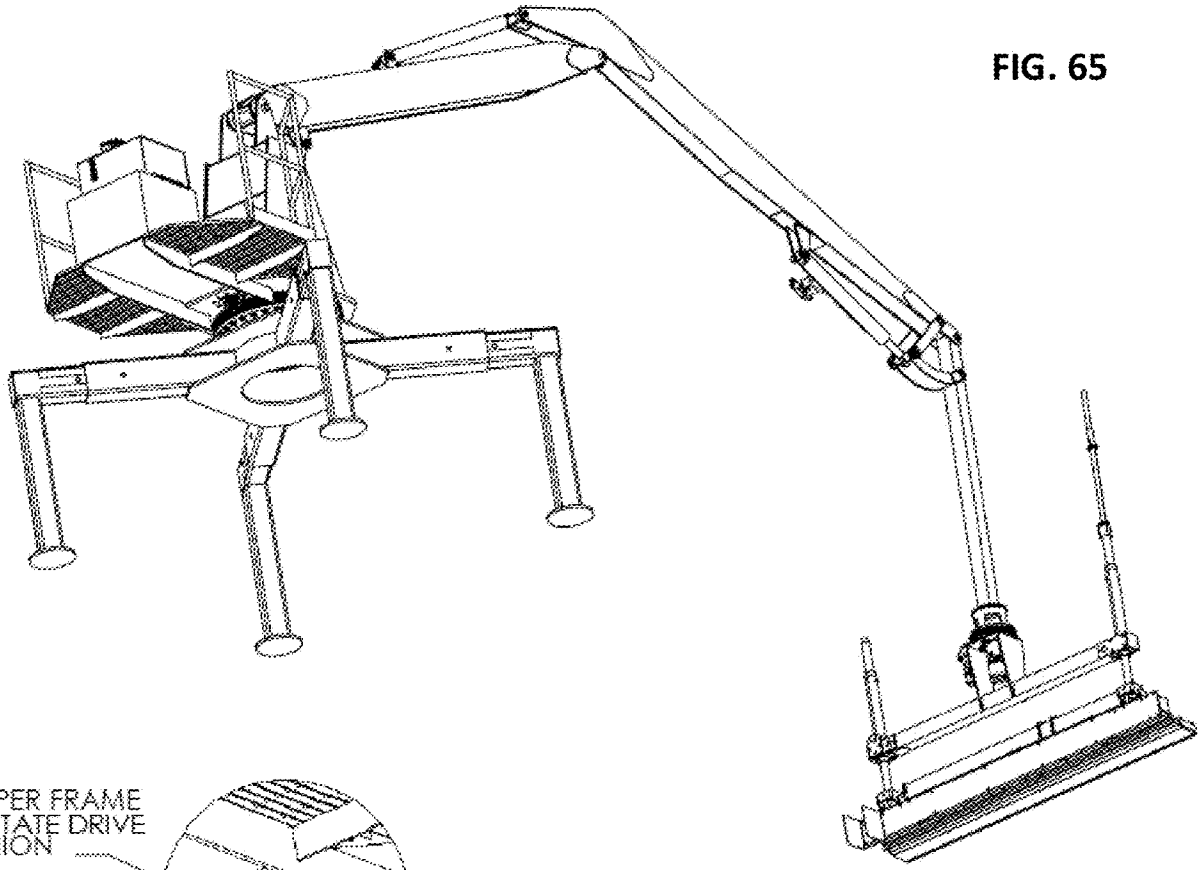
FIG. 65 is an underside perspective view of the screeding machine of FIG. 62.
Figure 65A:
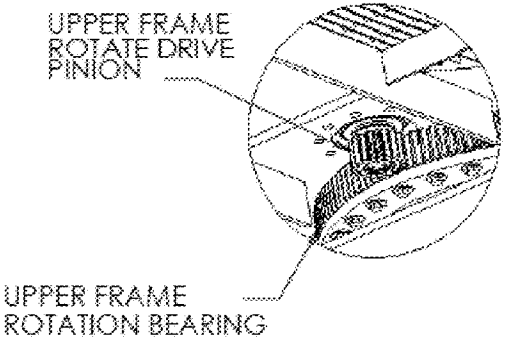
FIG. 65A is an enlarged perspective view of the rotation drive pinion and bearing of the screeding machine.

Optionally, the screed head may be attached at an outer end of an articulating boom, with the base of the boom being pivotally mounted at a base structure that is positionable at selected locations of a floor for screeding selected portions of the floor. For example, and as shown in FIGS. 62 and 63, a base structure may comprise three or more stabilizer legs, which may be horizontally and/or vertically adjustable to adjust the stance and foot print of the base structure to adapt the base structure for placement at various locations at a floor or surface to be screeded (which may have rebar and tensioning cables and the like disposed thereat). The articulatable boom is attached to a rotating base that is rotatably mounted at the base structure and rotatable 360 degrees about a generally vertical axis of rotation. For example, and such as can be seen in FIGS. 62-65A, the rotating base is rotatably driven by an upper frame rotation motor, which rotatably drives an upper frame rotation drive pinion (FIG. 65A), which engages and causes to rotate an upper frame rotation bearing. In the illustrated embodiment, the rotating base includes the drive motor and hydraulic pump and engine to drive the pump, such that the machine is a self-contained device that is operable to control the drive motor (and actuators and screed head) via pressurized hydraulic fluid from the pump at the rotating base.

The articulatable boom comprises two or more boom sections that are pivotable via actuators or hydraulic cylinders, with a main boom section being pivotable relative to the rotating base about an axis generally normal to the axis of rotation of the rotating base, and with a second boom or stick boom pivotable relative to the outer or distal end of the main boom. The boom sections may include level sensors and/or the actuators may include extension/retraction sensors, such that the machine or system is operable to determine the orientation and angles of the boom sections throughout their ranges of motions relative to each other and to the base.

Figure 66:
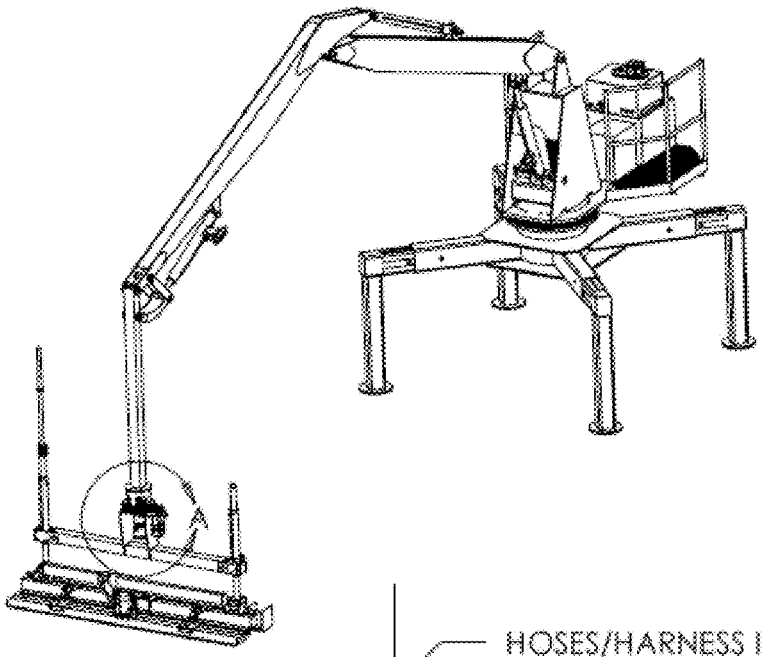
FIG. 66 is another perspective view of the screeding machine of FIG. 62.
Figure 66A:
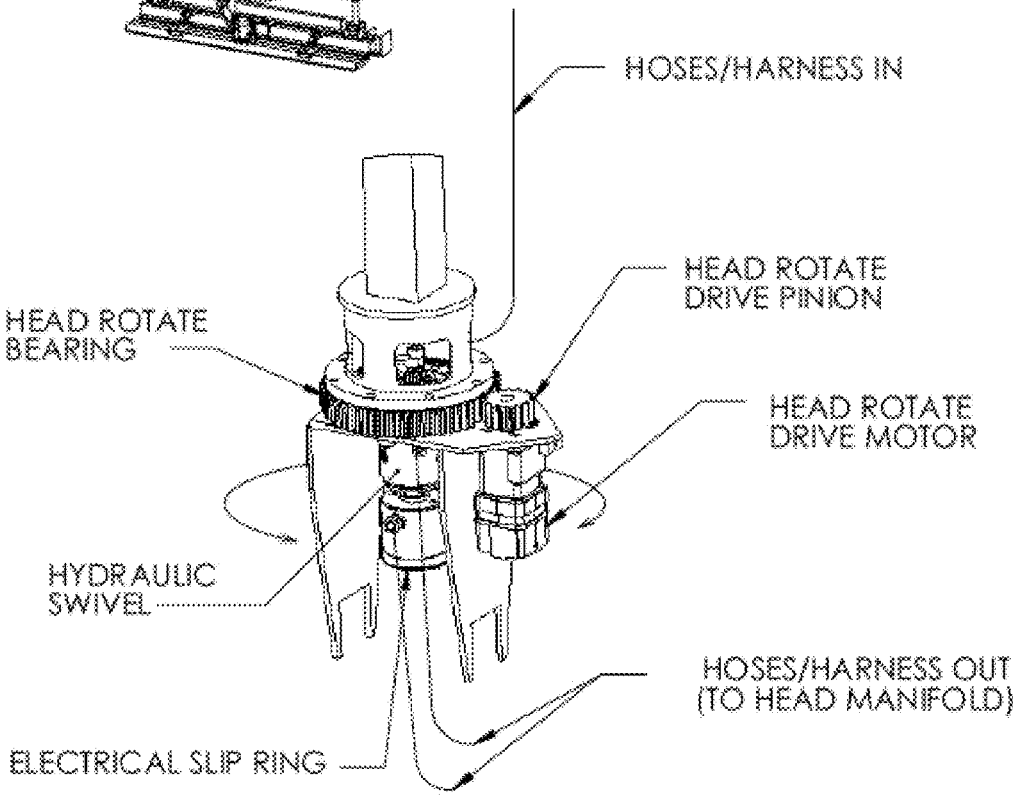
FIG. 66A is an enlarged perspective view of the region A in FIG. 66.

The screed head is rotatably mounted at the distal end of the stick boom, such as via a third boom section or support. In the illustrated embodiment, the third boom section is pivotable relative to the distal end of the stick boom so that the third boom section can be adjusted to be generally vertical throughout all angles or orientations of the stick boom. The screed head is rotatably mounted at the lower or distal end of the third boom section or support so that the screed head can be set to any orientation relative to the base structure and the rotating base and boom sections can be manipulated to move the screed head in any direction to screed a desired or selected ground or floor region. As shown in FIGS. 66 and 66A, the screed head can be rotated relative to the third boom section or screed head support via a head rotation drive motor that rotatably drives a drive pinion that engages and rotates about a head rotation bearing at the end of the boom section. A plurality of hoses and/or harnesses may be routed along the boom (from the hydraulic pump at the rotating base) to the screed head, so as to selectively provide hydraulic pressurized fluid to the head rotate drive motor and/or the elevation actuators of the screed head and/or the plow adjusting actuators of the screed head and/or the vibrating member of the screed head and/or the like. The hose or hoses for the screed head actuators and motors are routed through a hydraulic swivel and to a head manifold of the screed head, so that the screed head can swivel or rotate 360 degrees without tangling or twisting or stressing the hoses and/or harnesses at the pivot/rotation joint at the end of the third boom section. The head manifold is operable to provide pressurized fluid to the appropriate hydraulic cylinder and/or hydraulic motor during operation of the screeding machine and screed head.

Thus, the screed head orientation can be set and the rotating base and boom sections can be manipulated to provide screeding toward the base structure, away from the base structure, arcuately around the base structure or any suitable or selected direction. The screeding machine thus can be placed (such as via a crane or the like) at various locations at a jobsite and the screed head can screed an area around the base structure and around obstacles at the jobsite. When one area or region is completed, the screeding machine can be picked up and moved to another selected location, where the screed head can again screed the area around the placed base structure and around obstacles at the jobsite. The screed head may be placed at locations where the screeding process includes overlapping of screeding areas, such that the second or subsequent screeding process (after the machine is moved to a second or subsequent location) screeds over a portion of the previously screeded area (as screeded by the machine when placed at a first or previous location). The screeding machine may be picked up and placed at multiple locations (such as, for example, six locations or more or less depending on the size of the floor or surface area and the number of and location of non-movable obstacles or structures at the jobsite) to screed a large area of a jobsite in a given day. The screeding machine may be operated by remote control or may be programmed to screed in a particular pattern.

The screeding machine includes angle sensors and/or level sensors and/or the like to assist in maintaining the screed head in the desired or appropriate orientation. The screed head includes laser sensors that sense a laser plane so that the screed head screeds the selected surface region to a desired grade. The screeding machine may include a control and sensors that function to control the actuators to maintain the distal end of the second or stick boom section at a desired or selected or appropriate height throughout the screeding process (as the rotating base is rotating and/or as the boom sections are pivoting to move the screed head over and along the surface in the desired direction or path or trajectory). For example, the machine may include a laser receiver or other suitable sensor at the distal end of the second boom section, with the sensor sensing a laser plane or the like, whereby a control cooperatively adjusts the pivoting of the boom sections to move the screed head through its selected or determined path while maintaining the distal end of the screed head at its appropriate height (optionally, the third boom section or screed head support may be longitudinally adjustable (such as via a telescoping construction or the like) to further adjust the height of the screed head as the boom sections are pivoted).

The control system of the machine allows for remote control of the machine by an operator standing away from the machine. The remote control may include one or more joysticks or the like to provide the desired control of the machine by the operator. The operator can maneuver the joystick in the desired direction that he or she wants the screed head to move, and the control system will automatically cooperatively operate the actuators to provide the desired motion while maintaining the screed head at the desired or selected height. For example, when the operator moves the joystick to retract the head back in an auto mode, the system will coordinate the movement of both boom actuators (with position sensors) to make sure the system retracts the screed head while holding the head level to the ground surface. The laser receivers will still control the head accuracy with individual receivers. The control system may be in the controllers on the machine base unit.

Therefore, the present invention provides a screed head that is positionable at a location remote from its support structure (such as a vehicle or tower or towers). The screed head may be mounted at a distal end of a boom that is attached at a concrete pumping tower or the like, whereby the boom is extendable to reach areas where concrete is placed by the placing boom of the tower. The screed head may float on the concrete surface and may be moved over the concrete surface by a cable or other movable or drivable device to move the screed head relative to the concrete surface and boom and tower. The system of the present invention provides enhanced screeding of locations previously difficult or impossible to reach with a screeding machine.

Changes and modifications to the specifically described embodiments can be carried out without departing from the principles of the present invention, which is intended to be limited only by the scope of the appended claims as interpreted according to the principles of patent law.

The invention claimed is:

1. A concrete screeding device for screeding uncured concrete placed at a support surface, said concrete screeding device comprising:

a screed head comprising a grade setting device and a vibrating member;

an extendable and retractable boom, wherein a base end of said boom is attached at a base structure and said screed head is supportable at a distal end of said boom; and wherein said boom is extendable so as to position said screed head at a distance of at least 20 feet from the base structure, and wherein the screed head is movable between its extended location and the base structure to screed the concrete placed at the support surface.

2. The concrete screeding device of claim 1, wherein said base end of said boom is attached to a tower.

3. The concrete screeding device of claim 2, wherein said base end of said boom is pivotally attached at the tower and said concrete screeding device is operable to pivot said boom at least about 180 degrees about a longitudinal or vertical axis of the tower.

4. The concrete screeding device of claim 1, wherein said base end of said boom is attached to a concrete placing tower.

5. The concrete screeding device of claim 1, wherein at least some of said boom sections pivot relative to other boom sections about a generally vertical pivot axis.

6. The concrete screeding device of claim 1, wherein at least some of said boom sections pivot relative to other boom sections about a generally horizontal pivot axis.

7. The concrete screeding device of claim 1, wherein said distal end of said boom comprises a screed head support that supports said screed head.

8. The concrete screeding device of claim 7, comprising a stabilizing mechanism at said screed head support to stabilize said screed head support at the support surface during a screeding pass of said screed head.

9. The concrete screeding device of claim 8, wherein said screed head is movable along said screed head support to perform a screeding pass when said stabilizing mechanism is engaged with the support surface.

10. The concrete screeding device of claim 1, wherein said screed head comprises a floating screed head, and wherein said boom is adjustable to place said screed head at a location remote from said base end of said boom, whereby said screed head is unsupported by said boom and floats on the placed uncured concrete, and wherein said screed head is movable along the concrete to screed the concrete.

11. The concrete screeding device of claim 10, wherein said screed head is movable along the concrete via at least one cable that is adjustable to pull said screed head in a screeding direction toward said base structure.

12. The concrete screeding device of claim 10, wherein said screed head is self-propelled along the concrete to move in a screeding direction.

13. The concrete screeding device of claim 1, comprising at least one sensor at said boom, wherein said concrete screeding device is operable to control said boom responsive to said at least one sensor.

14. The concrete screeding device of claim 13, wherein said sensor comprises an object sensing sensor, and wherein said concrete screeding device controls said boom to avoid objects detected by said object sensing sensor.

15. The concrete screeding device of claim 13, wherein said sensor comprises a plurality of position sensors, and wherein, responsive to said position sensors, said concrete screeding device controls said boom to position said screed head at the uncured concrete at a desired location and orientation.

16. The concrete screeding device of claim 13, wherein said sensor comprises a position sensor that determines the distance that said screed head is from said base end of said boom, and wherein said concrete screeding device controls a rate of pivotal movement of said boom responsive to said position sensor.

17. A concrete screeding device for screeding uncured concrete placed at a support surface, said concrete screeding device comprising:

a base structure positionable at a selected location of a surface to be screeded;

a rotating base rotatably mounted to said base structure and rotatable 360 degrees about a vertical axis relative to said base structure via a first rotating device;

an articulating boom comprising (i) a first boom section that is pivotally mounted at said rotating base and pivotable about a first horizontal pivot axis via a first actuator, (ii) a second boom section pivotally mounted at a distal end of said first boom section and pivotable about a second horizontal pivot axis via a second actuator, and (iii) a screed head support pivotally mounted at a distal end of said second boom section and pivotable about a third horizontal pivot axis via a third actuator;

a screed head rotatably mounted at a distal end of said screed head support, wherein said screed head is rotatable 360 degrees about a vertical axis via a second rotating device;

wherein said screed head includes a pair of sensors and, responsive to outputs of said sensors, said screed head adjusts a level of a grade setting device or plow of said screed head;

a control operable to cooperatively control said first rotating device, said first actuator, said second actuator, and said second rotating device to move said screed head over and along the concrete surface so as to screed a region of the support surface at or near said base structure; and wherein, during a screeding pass of said screed head, said control cooperatively controls said first rotating device, said first actuator and said second actuator to move said screed head over the concrete surface while maintaining said screed head at a selected level.

18. The concrete screeding device of claim 17, wherein said base structure or said rotating base includes a lifting element that is engagable by a crane to lift said screeding device from a first screeding location and move said screeding device to position it at a second screeding location after said screeding device has screeded the support surface at the first screeding location.

19. The concrete screeding device of claim 17, wherein said control maintains said screed head at the selected level responsive to a sensor at one of (i) said screed head support and (ii) a distal end of said second boom section.

20. The concrete screeding device of claim 17, wherein said control is operable to position said screed head at a starting position for a screed pass, and wherein the screed pass comprises any one of (i) a pass radially toward said base structure, (ii) radially away from said base structure and (iii) arcuately at least partially around said base structure.

21. The concrete screeding device of claim 17, wherein said screed head includes a vibrating member, elevation actuators that adjust a height of said vibrating member relative to a support beam that is rotatably attached at said screed head support, grade setting actuators that adjust a position of a plow relative to said vibrating member responsive to said sensors.

22. The concrete screeding device of claim 21, wherein control of said vibrating member, said elevation actuators, and said grade setting actuators is provided via hoses passing through a hydraulic swivel at said distal end of said screed head support.

23. The concrete screeding device of claim 17, wherein said concrete screeding device comprises a remote controlled device.

24. The concrete screeding device of claim 23, wherein an operator selects and controls a path of travel of said screed head during a screeding pass and wherein said control cooperatively controls said first rotating device, said first actuator, said second actuator, and said second rotating device to move said screed head over and along the concrete surface along the path of travel while maintaining said screed head at the selected level.

25. The concrete screeding device of claim 17, wherein said sensors comprise sensors selected from the group consisting of (i) laser receivers, (ii) sonic tracers and (iii) angle sensors.

26. The concrete screeding device of claim 17, wherein said sensors comprise a pair of laser receivers and, responsive to said laser receives sensing a laser plane generated at the support surface, said screed head adjusts the level of the grade setting device or plow of said screed head.

* * * * *